US008176845B2

(12) United States Patent
Koblinger et al.

(10) Patent No.: US 8,176,845 B2
(45) Date of Patent: May 15, 2012

(54) FORM CYLINDER OF A PRINTING PRESS COMPRISING A PLURALITY OF SECTIONS IN SERIES ON ITS CIRCUMFERENTIAL SURFACE IN ITS AXIAL DIRECTION, AND PRINTING COUPLE COMPRISING SUCH FORM CYLINDER

(75) Inventors: Michael Koblinger, Zellingen (DE); Karl Robert Schäfer, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 694 days.

(21) Appl. No.: 12/310,404

(22) PCT Filed: Jun. 27, 2007

(86) PCT No.: PCT/EP2007/056429

§ 371 (c)(1),
(2), (4) Date: Feb. 24, 2009

(87) PCT Pub. No.: WO2008/025584

PCT Pub. Date: Mar. 6, 2008

(65) Prior Publication Data

US 2009/0320705 A1 Dec. 31, 2009

(30) Foreign Application Priority Data

| | | |
|---|---|---|
| Sep. 1, 2006 | (DE) | 10 2006 041 333 |
| Dec. 22, 2006 | (DE) | 10 2006 061 295 |
| Mar. 2, 2007 | (DE) | 10 2007 010 298 |
| Mar. 26, 2007 | (DE) | 10 2007 014 323 |

(51) Int. Cl.
*B41F 27/12* (2006.01)
*B41F 27/06* (2006.01)

(52) U.S. Cl. ..... 101/378; 101/383; 101/415.1

(58) Field of Classification Search ..... 101/377, 101/378, 383, 409, 415.1
See application file for complete search history.

(56) References Cited

U.S. PATENT DOCUMENTS 5,758,579 A 6/1998 Marmin
(Continued)

FOREIGN PATENT DOCUMENTS

DE 202 20 294 U1 6/2003
(Continued)

*Primary Examiner* — Daniel J Colilla
*Assistant Examiner* — David Banh
(74) *Attorney, Agent, or Firm* — Mattingly & Malur, P.C.

(57) ABSTRACT

A form cylinder of a printing machine includes a plurality of sections in series in an axial direction of the cylinder surface. At least one printing form is arranged in each one of these sections. The form cylinder has at least one channel, also extending in the axial direction of the cylinder. That channel has an opening on the surface of the form cylinder. At least one holding device for each of the sections is arranged in this channel. Each such holding device can be pneumatically actuated in sections. At least one recess, open to the cylinder surface, is formed outside of these sections. A device that is usable to distribute compressed air to the respective sections of the form cylinder is provided in this at least one recess. The device for distributing the compressed air is configured as a plurality of valves. At least one control device is provided outside of the form cylinder and is used to activate the plurality of valves in a non-contact manner. The control device associated with each valve is oriented toward the surface of the form cylinder and acts in a radial direction.

60 Claims, 45 Drawing Sheets

U.S. PATENT DOCUMENTS

| | | | | |
|---|---|---|---|---|
| 5,988,065 | A * | 11/1999 | Schroder et al. | 101/389.1 |
| 6,460,457 | B1 | 10/2002 | Ramsay | |
| 6,684,786 | B2 | 2/2004 | Nagata et al. | |
| 7,210,406 | B2 * | 5/2007 | Schafer et al. | 101/375 |
| 7,320,282 | B2 | 1/2008 | Groβ | |
| 7,650,837 | B2 * | 1/2010 | Schafer | 101/216 |
| 2005/0199147 | A1 * | 9/2005 | Schafer et al. | 101/415.1 |
| 2005/0257706 | A1 * | 11/2005 | Simon et al. | 101/376 |
| 2005/0257707 | A1 * | 11/2005 | Re et al. | 101/376 |
| 2006/0150410 | A1 | 7/2006 | Becker et al. | |
| 2007/0214980 | A1 | 9/2007 | Schafer | |
| 2008/0028966 | A1 | 2/2008 | Schneider et al. | |

FOREIGN PATENT DOCUMENTS

| | | | |
|---|---|---|---|
| DE | 102 44 574 | A1 | 4/2004 |
| DE | 10 2004 021 606 | A1 | 12/2005 |
| DE | 10 2006 017 222 | A1 | 1/2007 |
| EP | 0 678 382 | A1 | 10/1995 |
| EP | 1 101 612 | A2 | 5/2001 |
| EP | 1 101 612 | A3 | 5/2001 |
| EP | 1 308 277 | A1 | 5/2003 |
| WO | WO 2004/020202 | A2 | 3/2004 |
| WO | WO 2004/039591 | A1 | 5/2004 |
| WO | 2004/028809 | A1 | 8/2004 |
| WO | WO 2005/110755 | A1 | 11/2005 |

* cited by examiner

FORM CYLINDER OF A PRINTING PRESS COMPRISING A PLURALITY OF SECTIONS IN SERIES ON ITS CIRCUMFERENTIAL SURFACE IN ITS AXIAL DIRECTION, AND PRINTING COUPLE COMPRISING SUCH FORM CYLINDER

CROSS-REFERENCE TO RELATED APPLICATIONS

This application is the U.S. national phase, under 35 U.S.C. 371, of PCT/EP2007/056429, filed Jun. 27, 2007; published as WO 2008/025584 A1 on Mar. 6, 2008 and claiming priority to DE 10 2006 041 333.4, filed Sep. 1, 2006; to DE 10 2006 061 295.7, filed Dec. 22, 2006; to DE 10 2007 010 298.6, filed Mar. 2, 2007 and to DE 10 2007 014 323.2, filed Mar. 26, 2007, the disclosures of which are expressly incorporated herein by reference.

FIELD OF THE INVENTION

The present invention is directed to forme cylinders of a printing press, each comprising a plurality of sections, in series, on their respective circumferential surfaces in their axial direction. The present invention is also directed to a printing couple comprising the relevant forme cylinder in accordance with the present invention. Each forme cylinder is provided with a plurality of printing forme holding sections that have plate holding devices, these plate holding devices are actuated pneumatically.

BACKGROUND OF THE INVENTION

DE 10 2006 017 222 A1 describes a forme cylinder of a printing press having a plurality of sections, in series, on its circumferential surface and aligned in its axial direction. At least one printing forme can be positioned in each of these sections. The forme cylinder has at least one groove extending in its axial direction, with an opening of the groove being situated on the circumferential surface of the forme cylinder. At least one holding device, which is assigned to one of the sections, is arranged in the groove, or in each groove. Each of the respective holding devices can be pneumatically actuated by section. Outside of the sections, at least one recess, which is open on the circumferential surface of the forme, cylinder is provided. The at least one groove leads into this recess or into at least one of the recesses. The forme cylinder has only a single compressed air input for actuating all of the holding devices that are arranged in this forme cylinder. A device for use in distributing the compressed air supplied to the forme cylinder to the respective sections is provided in the at least one recess.

A forme cylinder of a printing press, with a plurality of printing formes arranged side by side in its axial direction is known from WO 2004/028 809 A1. Individually actuable holding devices, which are arranged in a groove of the forme cylinder, are assigned to respective ones of these printing formes. Each of the holding devices can be actuated using a positioning assembly that can be acted upon by a pressure medium. Control valves, which are situated in the forme cylinder, control the action of the pressure medium on the respective positioning assemblies. Each of the control valves can be controlled, for example, using an electromagnetic actuator.

A forme cylinder of a printing press is known from WO 2004/039 591 A1. It is provided with at least one groove extending in its axial direction, and with an opening on the circumferential surface of the forme cylinder. The forme cylinder has at least one recess that is open on its circumferential surface, near its end face. The at least one groove leads into the recess or into at least one of the recesses in the forme cylinder.

SUMMARY OF THE INVENTION

The object of the present invention is to provide forme cylinders of a printing press comprising a plurality of sections in series on their respective circumferential surfaces in their axial direction, and to also provide a printing couple comprising the relevant forme cylinder, and in which holding devices, which are arranged in the forme cylinder, can be remotely actuated.

The object in accordance with the present invention is attained with the provision of the forme cylinder having a plurality of sections arranged in series and axially on the cylinder's circumference. At least one printing forme can be positioned in each one of these sections. Holding devices are located in a cylinder groove and are usable to hold the printing formes in place. These holding devices are pneumatically actuable by section. At least one recess is located on the cylinder periphery and is usable to receive a device for supplying compressed air to the holding devices. The compressed air is distributed by a plurality of valves through a control device.

The benefits to be achieved with the present invention consist, in particular, in that holding devices, which are arranged in the forme cylinder, can be remotely actuated. The forme cylinder can be used for an automated mounting and/or removal of printing formes to be arranged, by section, on the forme cylinder.

The forme cylinder in accordance with the present invention is a component of a printing couple of a rotary printing press, for example, and preferably is a component of a printing couple of a printing press that prints using an offset printing process, such as, for example a printing press used in newspaper printing. For example, the printing press can employ a conventional wet offset printing process, which uses a dampening agent for the printing process, or it can print in a so-called dry offset printing process, in which the use of a dampening agent is not necessary. To execute the printing process, a plurality of printing formes are preferably mounted on at least one forme cylinder of the printing press. These printing formes are supplied either manually or automatically to the relevant forme cylinder.

The rotary printing press preferably has a plurality of printing couples, each with at least one forme cylinder. Each such forme cylinder has a plurality of mounting positions on its circumferential surface, both in its axial direction and preferably also in its circumferential direction. One printing forme can be mounted in each position. The forme cylinder is typically embodied as either a 4/2 or a 6/2 forme cylinder, for example, with either four or six printing formes arranged side by side in its axial direction, and with two printing formes arranged one in front of another respectively in the circumferential direction, for example. The circumference of the forme cylinder typically measures between 280 mm and 410 mm, for example. Its axial length can be up to 2,600 mm. The forme cylinder can be used in a 9-satellite printing unit or in an H printing unit, for example. The forme cylinder, and a transfer cylinder that cooperates with it, are both configured as double-circumference cylinders, for example. A web of material that passes through the respective printing unit, such as, for example, a web of paper, is preferably used as the print substrate.

In multicolor printing, it is necessary to place the printing formes, which are used in the printing process, on the respective forme cylinder true to register. This must be done in order to ensure the correct overprinting of the ink colors being used to produce a page of a printed product. The technique of providing at least one register element on or in the forme cylinder, which at least one register element is usable to properly align the respective printing forme during its respective mounting on the forme cylinder, is generally known. In cases in which the respective printing forme is automatically supplied to the forme cylinder, it is advantageous to accomplish the trueness of the register of the respective printing forme as it is being supplied to the forme cylinder.

Devices for use in mounting a printing forme on a forme cylinder of a printing press are also known from WO 2004/020202 A2. At least one activatable frictional body presses a printing forme against a corresponding abutment during the mounting of that forme on a forme cylinder. This occurs as soon as a suspension leg, which is bent at the leading end of the printing forme, has become hooked onto an edge of a groove opening that is formed on the surface of the forme cylinder. The frictional body, and its abutment, are preferably arranged perpendicular to the direction of conveyance of the printing forme. They act as a brake or as blocks, which secure the printing forme in a defined manner as its slides between the frictional bodies and their abutments, while the printing forme is being mounted on the forme cylinder via rotation of the forme cylinder. The activated frictional bodies cause the printing forme to be drawn tightly onto the forme cylinder, and cause the printing forme to rest against the edge of the groove opening of the forme cylinder, free from play.

The printing forme has one suspension leg, for example, at least on its leading edge, i.e., on its edge that faces the forme cylinder as it is being mounted. That leading edge suspension leg is bent at a right angle or preferably is bent at an acute angle relative to the extended length of the printing forme, and is suspended from the edge of the groove opening preferably in a positive connection. The printing forme can also have a suspension leg on its trailing edge, i.e., on its edge that faces away from the forme cylinder as it is being mounted. This trailing edge suspension leg, which is formed on the printing forme trailing edge, is bent at an obtuse angle or preferably is bent at approximately a right angle relative to the extended length of the printing forme, for example. Both the suspension leg on the leading edge of the printing forme and the suspension leg on the trailing edge of the printing forme are bent in the direction of the reverse side or the inner side of the printing forme. The reverse or inner side of the printing forme is its surface that is without an image. The printing forme inner surface extends between its leading edge and its trailing edge, and is the surface with which the printing forme rests on the circumferential surface of the forme cylinder once the printing forme has been mounted on the forme cylinder. The printing forme, which is made of a flexible, and preferably of a metallic material, is flexible at least along its length, with this flexibility allowing it to conform to the curved periphery of the forme cylinder, for example.

Prior to the mounting, of the printing forme on the forme cylinder at least one plate or forme holding assembly holds the printing forme on its reverse side, which bears no image, by virtue of a non-positive connection. The printing forme, that is to be suspended on the forme cylinder, is curved along its length, by a force acting upon it, in such a way that this curvature causes the reverse side of the printing forme to move toward the at least one plate holding assembly, which is positioned separate from the forme cylinder, until preferably direct contact is established between the printing forme to be mounted and the plate holding assembly. The non-positive connection between the at least one plate or forme holding assembly, which is positioned separately from the forme cylinder, and the printing forme can be achieved, for example, either pneumatically, via a suction force or via a magnetic force. The use of a magnetic force to form the non-positive connection is clearly not suitable if the printing forme is made of a non-ferromagnetic material, such as aluminum, for example. In a narrower sense, the mounting of the printing forme involves primarily the drawing of that printing forme onto the forme cylinder, and the fastening of that printing forme onto the forme cylinder. The steps of supplying of the printing forme to the forme cylinder, and the alignment of the printing forme to the forme cylinder are process steps which prepare for the mounting of the printing forme and which therefore precede the actual mounting of the printing forme onto the forme cylinder.

The at least one plate or forme holding assembly, which is positioned separately from the forme cylinder, aligns the printing forme in its position relative to the forme cylinder true to register, preferably at a time when the respective forme cylinder is in its idle position, and therefore is not rotating. Once the printing forme has been aligned true to register, in terms of its position relative to the forme cylinder, the forme cylinder draws the printing forme, which has been suspended from it, onto its circumferential surface by virtue of a rotational movement of the forme cylinder.

The at least one plate or forme holding assembly preferably moves away from the forme cylinder, thereby exerting a tractive force, which is directed away from the forme cylinder, on the printing forme, which printing forme is suspended by its leading edge. When the forme cylinder draws the printing forme, which is suspended from it, onto its circumferential surface, this occurs, for example, counter to the tractive force that is being exerted on that printing forme. The at least one plate or forme holding assembly that holds the printing forme can thereby be pulled against the force of a spring element in the direction of the forme cylinder.

To ensure that the printing forme does not slip as it is being mounted on the circumferential surface of the forme cylinder, which slippage would cause it to lose its trueness to register, the printing forme may be pressed against the circumferential surface of the forme cylinder by a pressure element which is engaged against the forme cylinder, and which pressure element is positioned stationary relative to the forme cylinder. The at least one plate or forme holding assembly, which is positioned separately from the forme, cylinder is released from the printing forme once the printing forme is pressed, by the pressure element, against the circumferential surface of the forme cylinder. The tractive force, which is exerted by at least one plate or forme holding assembly that is positioned separately from the forme cylinder, is terminated as soon as the printing forme is pressed, by the pressure element, against the circumferential surface of the forme cylinder.

In the case of rotary printing presses which are typically used in newspaper printing, in most cases a plurality of printing formes are suspended side by side in the axial direction of the respective forme cylinder and are then mounted on the circumferential surface of the forme cylinder. In this case, all of the printing formes, which are suspended side by side in the axial direction of the forme cylinder, for example, are pressed against the circumferential surface of the forme cylinder by a pressure element that is engaged against the forme cylinder and which is positioned stationary relative to the respective forme cylinder. The plurality of printing formes, which are typically suspended side by side in the axial direction of the forme cylinder, can also be mounted substantially simultaneously, for example.

The processes of mounting and removing at least one printing forme on the circumferential surface of a forme cylinder will be described in greater detail in the discussion which follows, and taken in reference to the corresponding figures. Each printing forme which is to be mounted, is automatically aligned true to register. In the case of a plurality of printing formes that are arranged side by side in the axial direction of the forme cylinder, forme end holding assemblies that are provided in the respective groove of the relevant forme cylinder can be selected and activated separately.

BRIEF DESCRIPTION OF THE DRAWINGS

Preferred embodiments of the present invention are represented in the set of drawings and will be described in greater detail in what follows.

The drawings show

DESCRIPTION OF THE PREFERRED EMBODIMENTS

Figure 1:
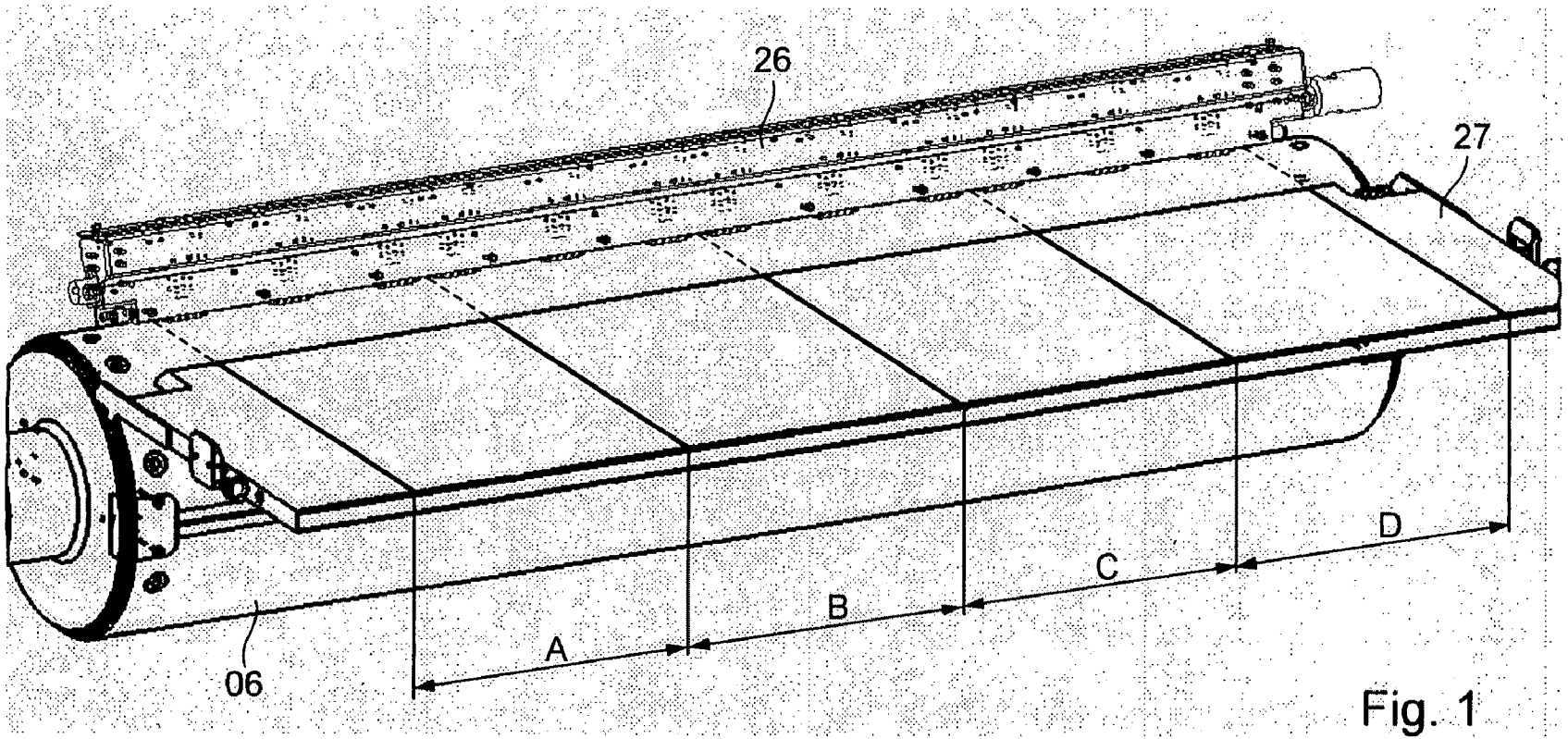
FIG. 1 a perspective representation of a forme cylinder and with an infeed device engaged against it.

Referring initially to FIG. 1, these may be seen a forme cylinder 06 of a printing press and at least one forme infeed device for printing formes 01 to be arranged on this forme cylinder 06, in a sequence of plate installation and removal, as shown in FIGS. 29 to 38. A plurality of printing formes 01, such as, for example, four such printing formes 01, can be arranged, side by side, in the axial direction of the forme cylinder 06. In a different embodiment from that shown in FIG. 1, two, six or eight printing formes 01, for example, can be arranged, side by side, in the axial direction of the forme cylinder 06. The forme infeed device has a support surface 27, which is embodied in the form of a table, for example, and on which table, each respective printing forme 01 to be supplied to the forme cylinder 06 can be, and is placed. The support surface 27 of the infeed device preferably extends in the axial direction of the forme cylinder 06 over its entire length. A plurality of printing formes 01, which are to be supplied to the forme cylinder 06, can be placed side by side on this support surface 27.

Figure 2:
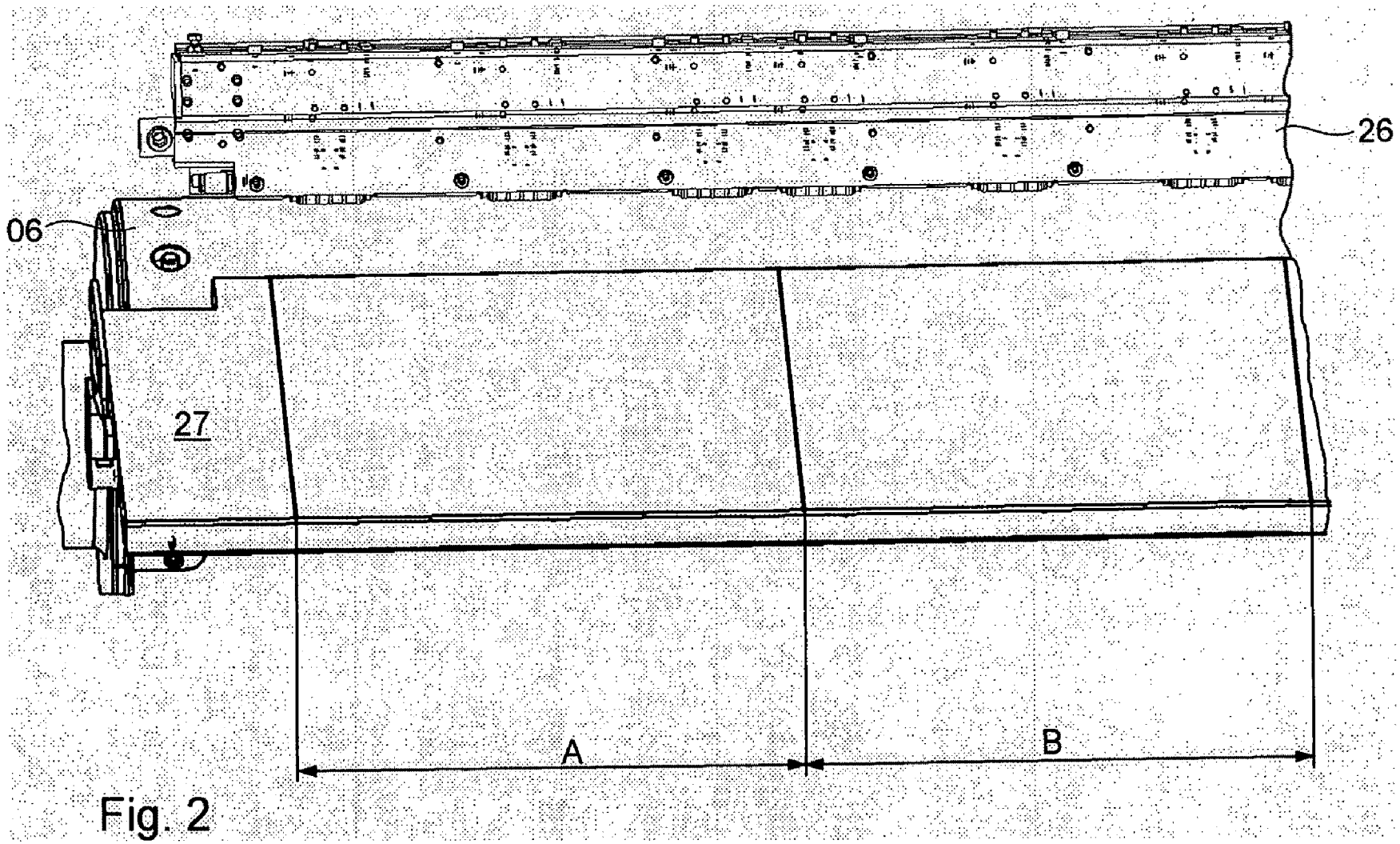
FIG. 2 another perspective representation of a section of a forme cylinder in accordance with FIG. 1.

FIG. 1 shows one separate section A; B; C; D for each of the printing formes 01 allocated to the forme cylinder 06, which formes 01 can be arranged side by side in the axial direction of the forme cylinder 06. An axial extension or width of each section A; B; C; D preferably corresponds to approximately the width of the printing forme 01 to be supplied in the respective section A; B; C; D. The sections A; B; C; D also extend over the support surface 27 of the infeed device, which is preferably engaged tangentially against the circumferential surface of the forme cylinder 06. The sections A; B; C; D of the forme cylinder 06, which are arranged side by side, and the similar sections A; B; C; D of the at least one infeed device assigned to the forme cylinder 01, are preferably equal to one another in width. FIG. 2 shows a section of the arrangement of FIG. 1 from a different perspective.

Figure 3:
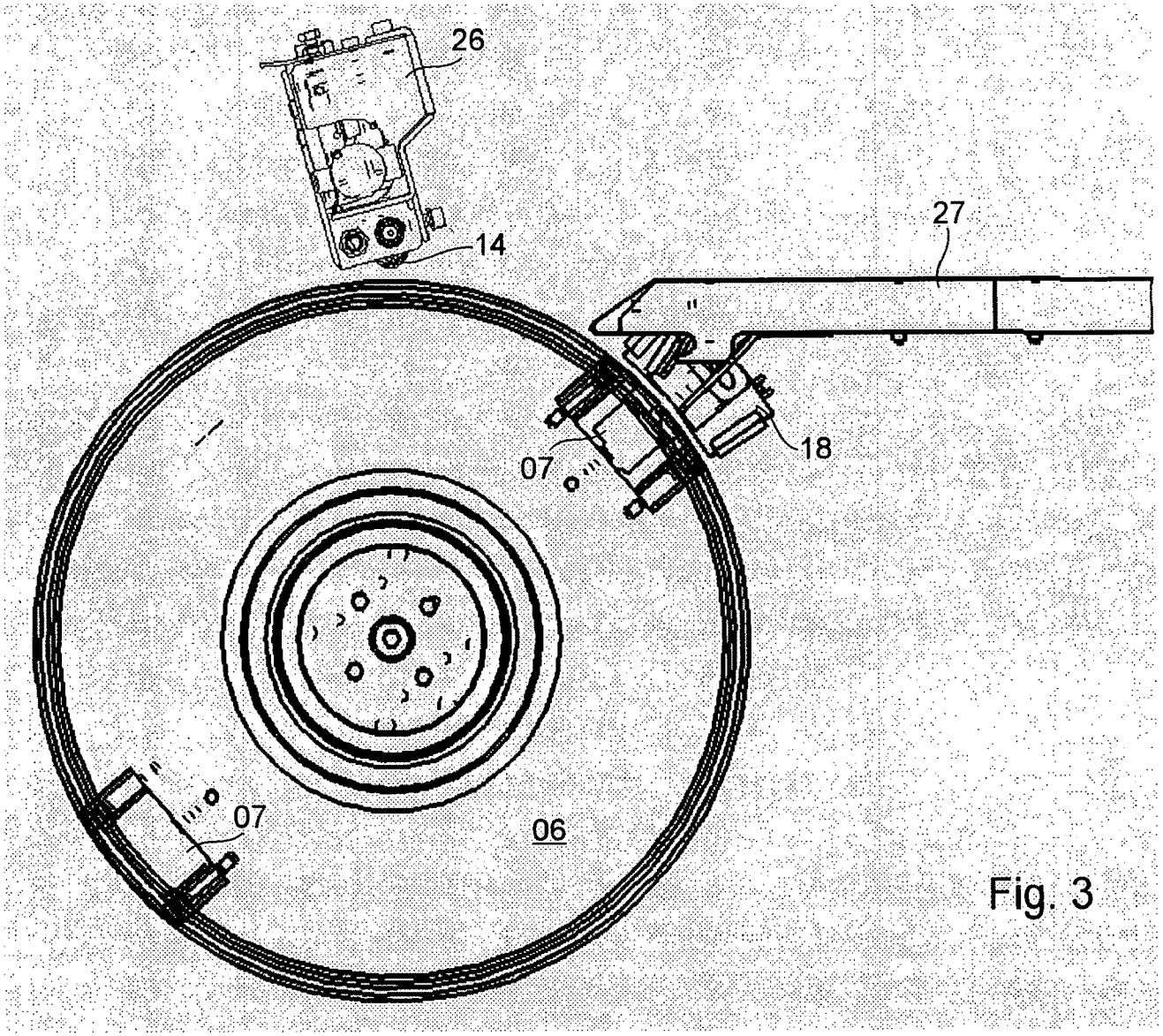
FIG. 3 a schematic side elevation view of the forme cylinder in an operating mode in which rolls of the infeed device are disengaged from the circumferential surface of the forme cylinder.
Figure 4:
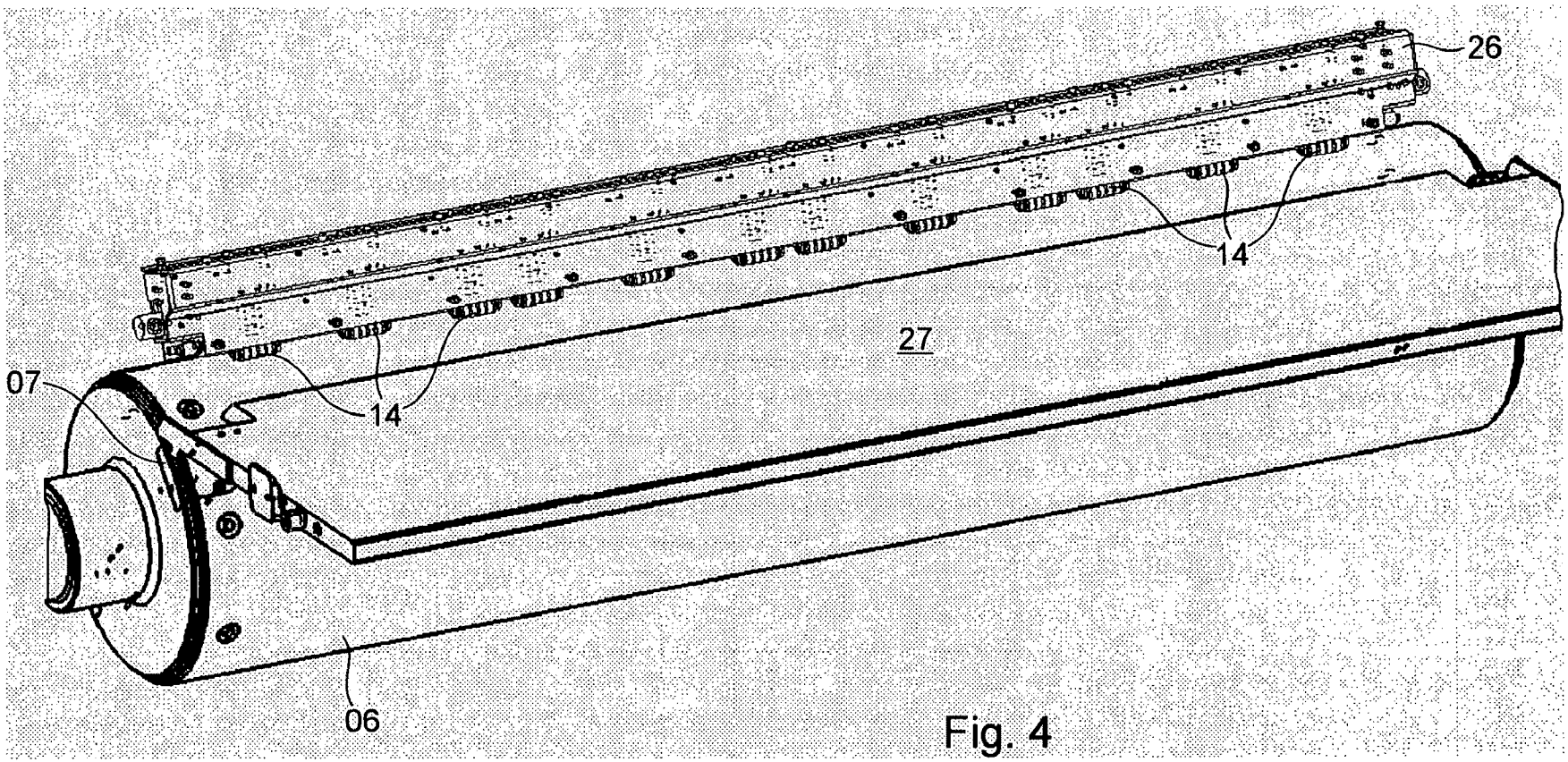
FIG. 4 another perspective representation of the forme cylinder and the infeed device.
Figure 5:
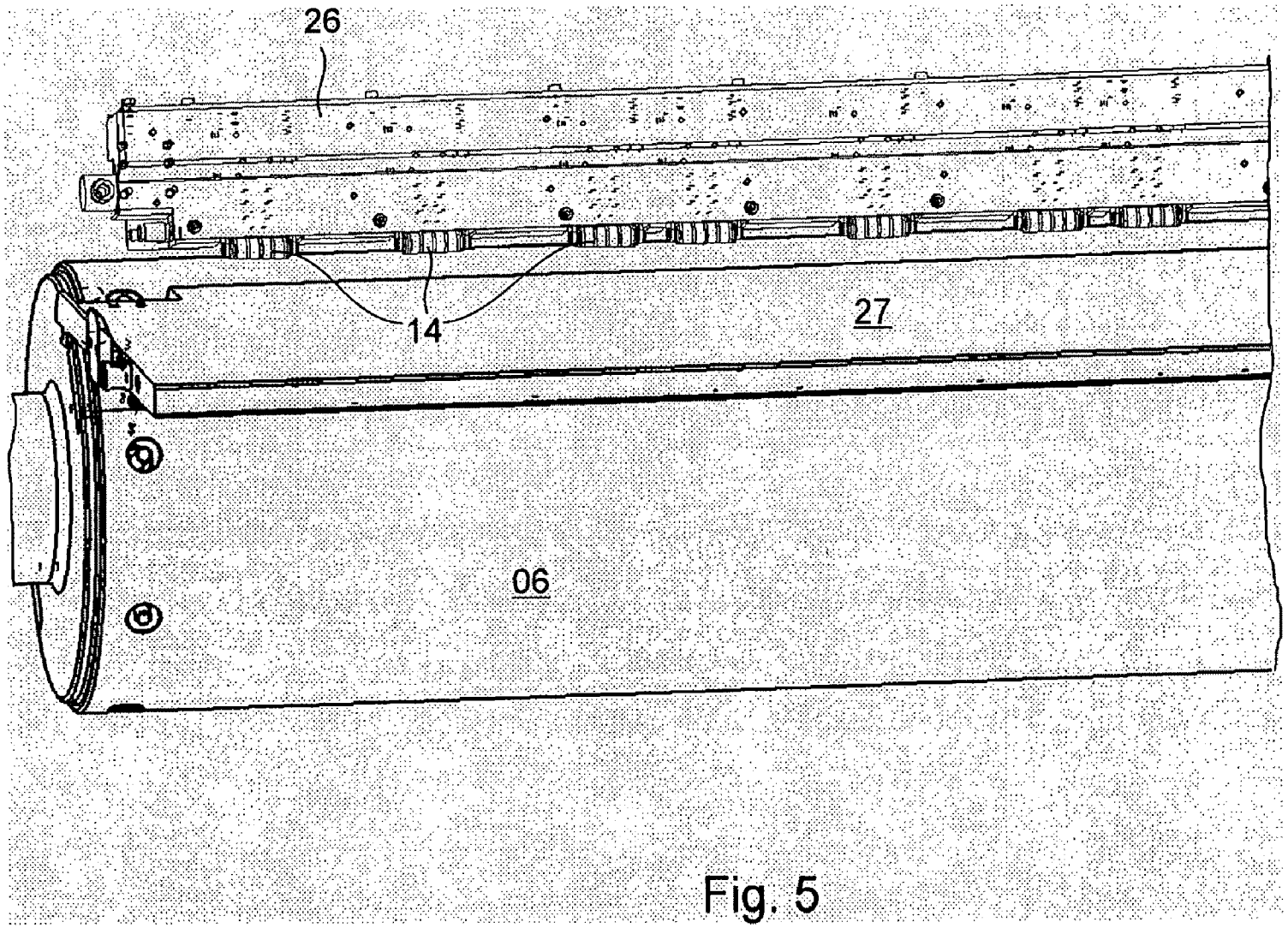
FIG. 5 another perspective representation of a section of a forme cylinder in accordance with FIG. 4.
Figure 6:
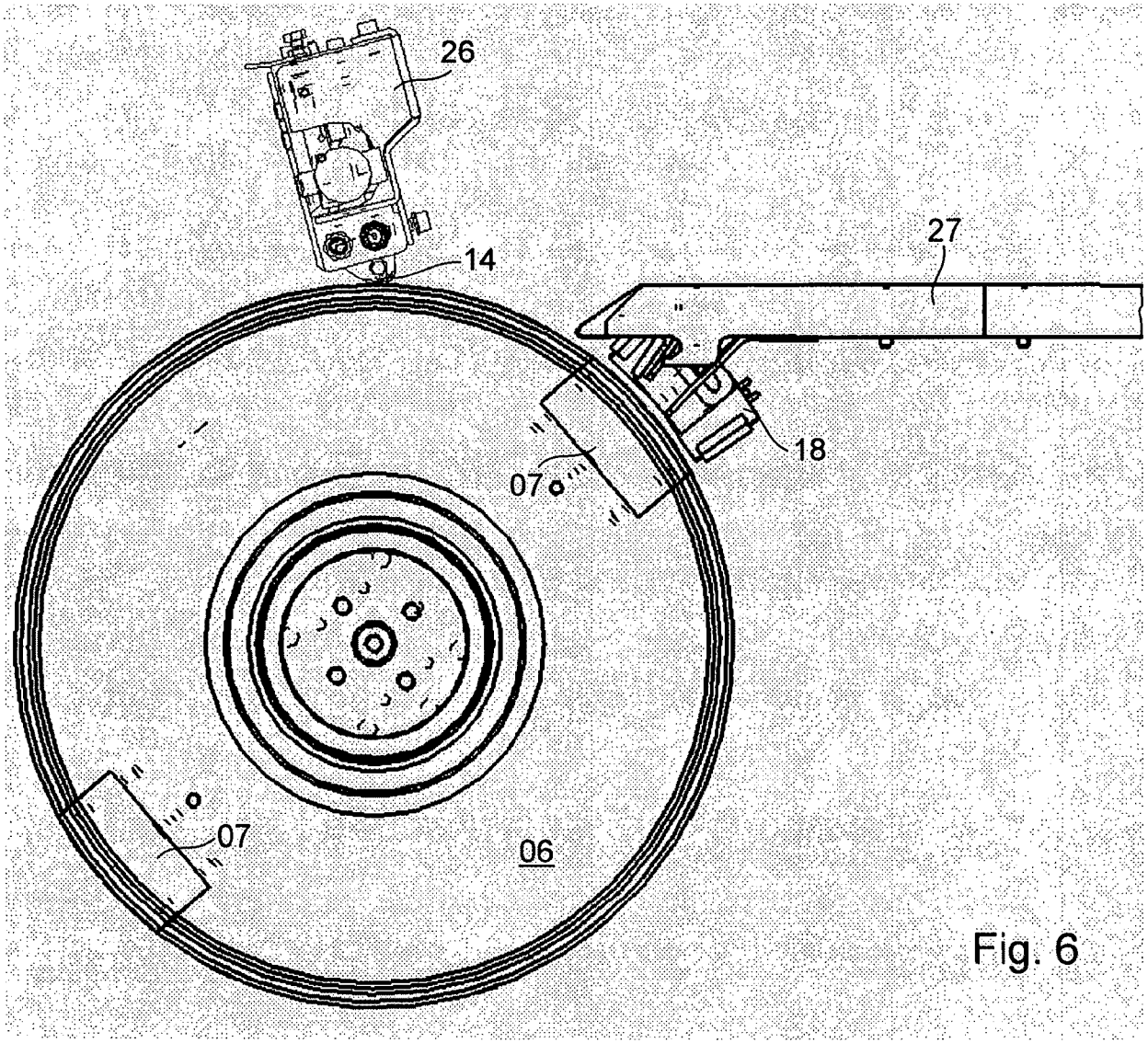
FIG. 6 a schematic side elevation view of the forme cylinder in an operating mode in which rolls of the infeed device are engaged against the circumferential surface of the forme cylinder.

A pressure strip 26, such as, for example, a roller strip 26, is preferably allocated to the forme cylinder 06, as may be seen in FIGS. 1 to 6, and extends axially parallel to the forme cylinder 06. Roller strip 26 can be structured either separately or as a component part with the infeed device, for example. The roller strip 26 is preferably held at both ends in a frame of the printing press, which frame is not specifically shown, and is spaced somewhat from the circumferential surface of the forme cylinder 06. The roller strip 26 preferably has a plurality of roller elements 14, preferably rollers 14, assigned to the respective sections A; B; C; D, in the axial direction of the forme cylinder 06, and may have, for example, three such rollers 14 per section A; B; C; D. The rollers 14, which are assigned to a specific section A; B; C; D, can be engaged against the circumferential surface of the forme cylinder 06 independently of the rollers 14 in another section A; B; C; D or in all other sections A; B; C; D, for example. All of the rollers 14 in the roller strip 26, and which are arranged side by side, may be engaged, only all together against the circumferential surface of the forme cylinder 06, as seen in FIGS. 4 to 6. FIGS. 1 to 3 show the roller strip 26 with rollers 14 disengaged from the circumferential surface of the forme cylinder 06. The rollers 14 in the example shown in FIGS. 4 to 6, which relates to the same arrangement as that of FIGS. 1 to 3, are engaged against the circumferential surface of the forme cylinder 06. FIG. 5 shows a section of the arrangement, which is also represented in FIG. 4, from a different perspective. FIGS. 3 and 6 are each cross-sectional representations which are both oriented perpendicular to the axis of the forme cylinder 06. FIG. 3 shows an operating status in which the rollers 14 are disengaged from the circumferential surface of the forme cylinder 06. In contrast, FIG. 6 shows an operating status in which the rollers 14 are engaged against the circumferential surface of the forme cylinder 06.

The sectional representations of FIGS. 3 and 6, and taken especially in combination with FIG. 1, show that the forme cylinder 06 has multiple, and preferably has two, axially parallel grooves 07, with these two grooves 07 preferably being diametrically opposite one another and being offset circumferentially. Each of these axially extending grooves 07 is preferably configured as an angular groove, for example, or as a bored hole, which is located on the circumferential surface of the forme cylinder 06. Each of the grooves 07, which are extending in the axial direction of the forme cylinder 06, has a slit-type opening 08 on the circumferential surface of the forme cylinder 06, preferably in each of the sections A; B; C; D. Each such slit-type opening 08 is configured with a slit width of less than 5 mm, and through which slit opening 08 at least one end of a printing forme 01 to be arranged in the relevant section A; B; C; D on the forme cylinder 06 can be inserted into the respective groove 07. This relevant printing forme end is then secured in the forme cylinder groove 07 and the relevant printing forme 01 is thereby fastened onto the circumferential surface of the forme cylinder 06. The slit width of the opening 08, measured in the circumferential direction of the forme cylinder 06, preferably ranges from 1 mm to 3 mm.

Figure 7:
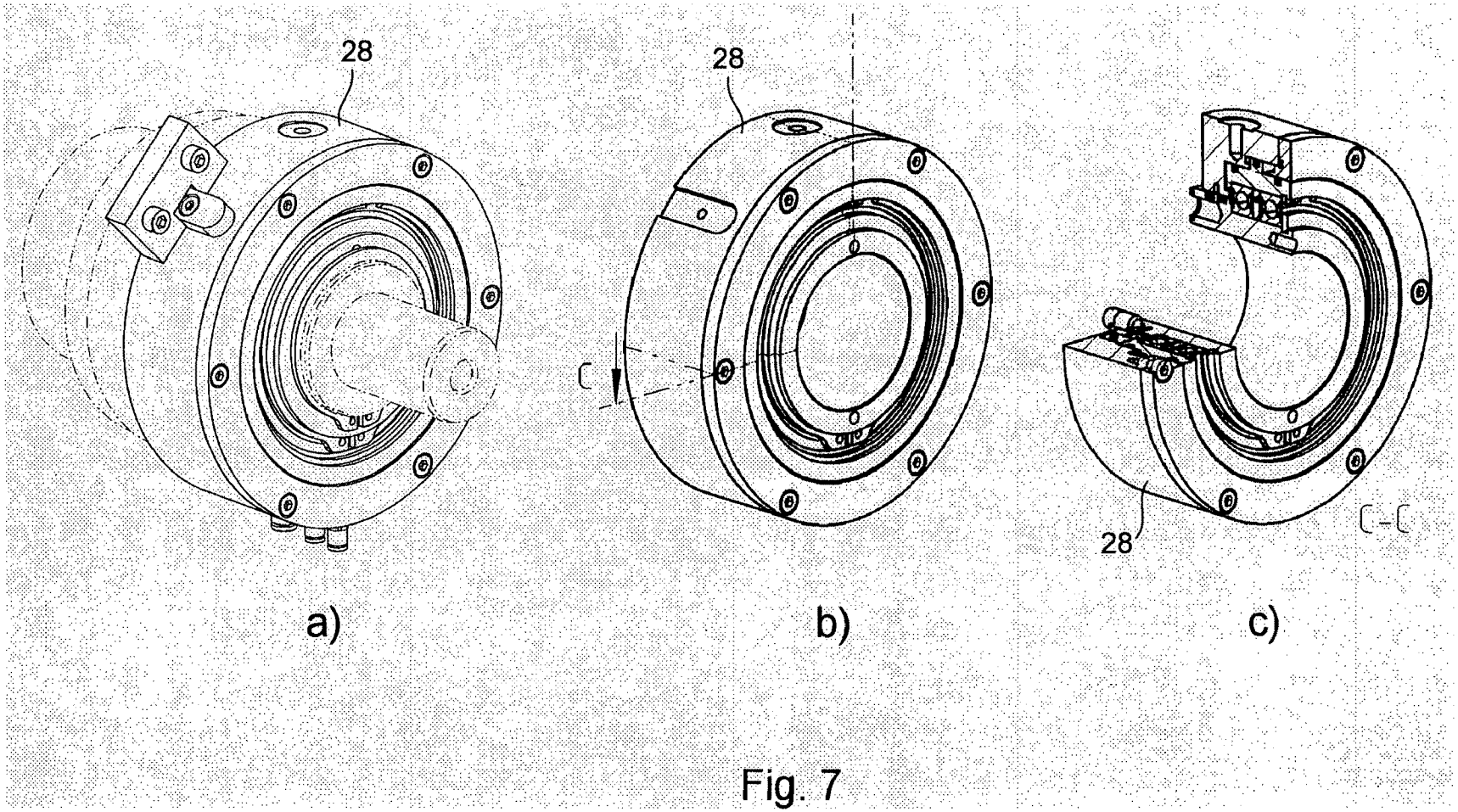
FIG. 7 perspective representations a), b) and c) of a compressed air intake device.
Figure 8:
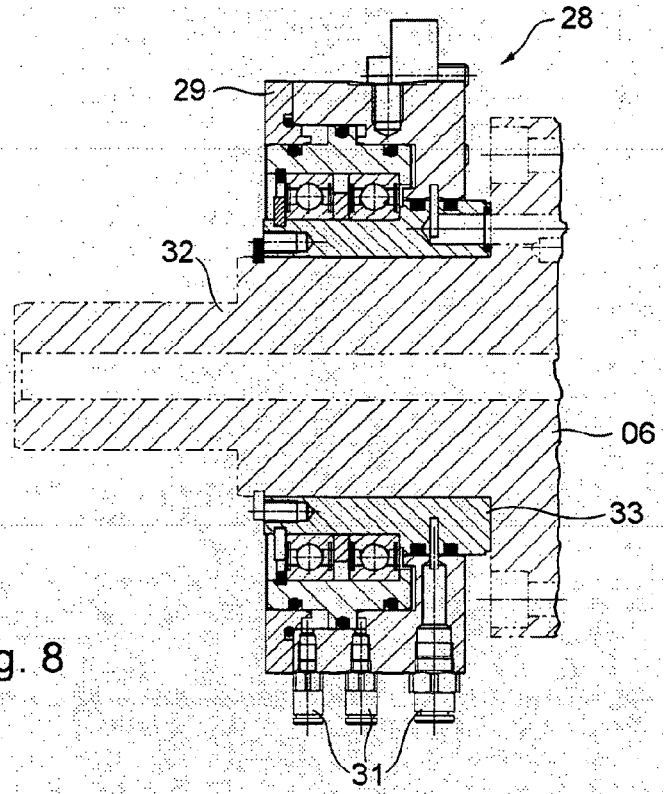
FIGS. 8 to 9 a longitudinal cross-section of the compressed air intake device in accordance with FIG. 7.
Figure 9:
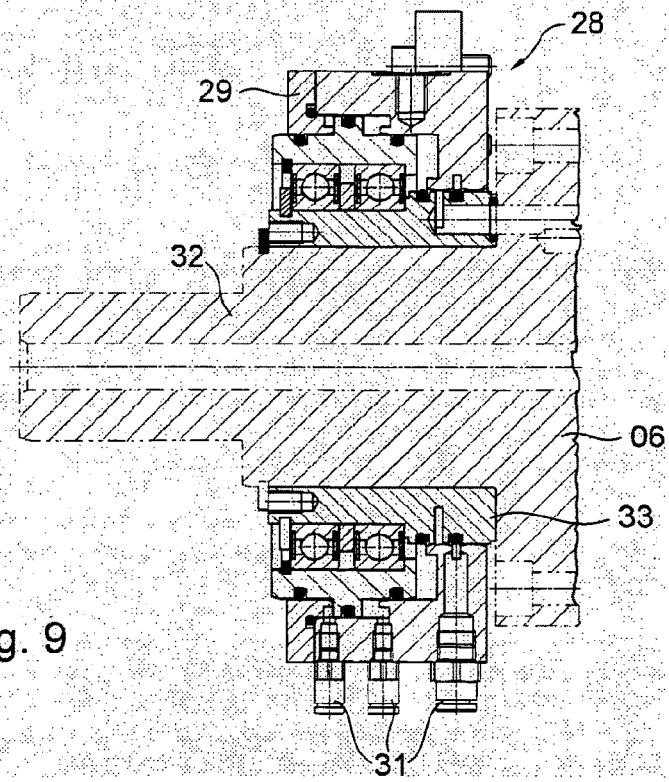
Figure 16:
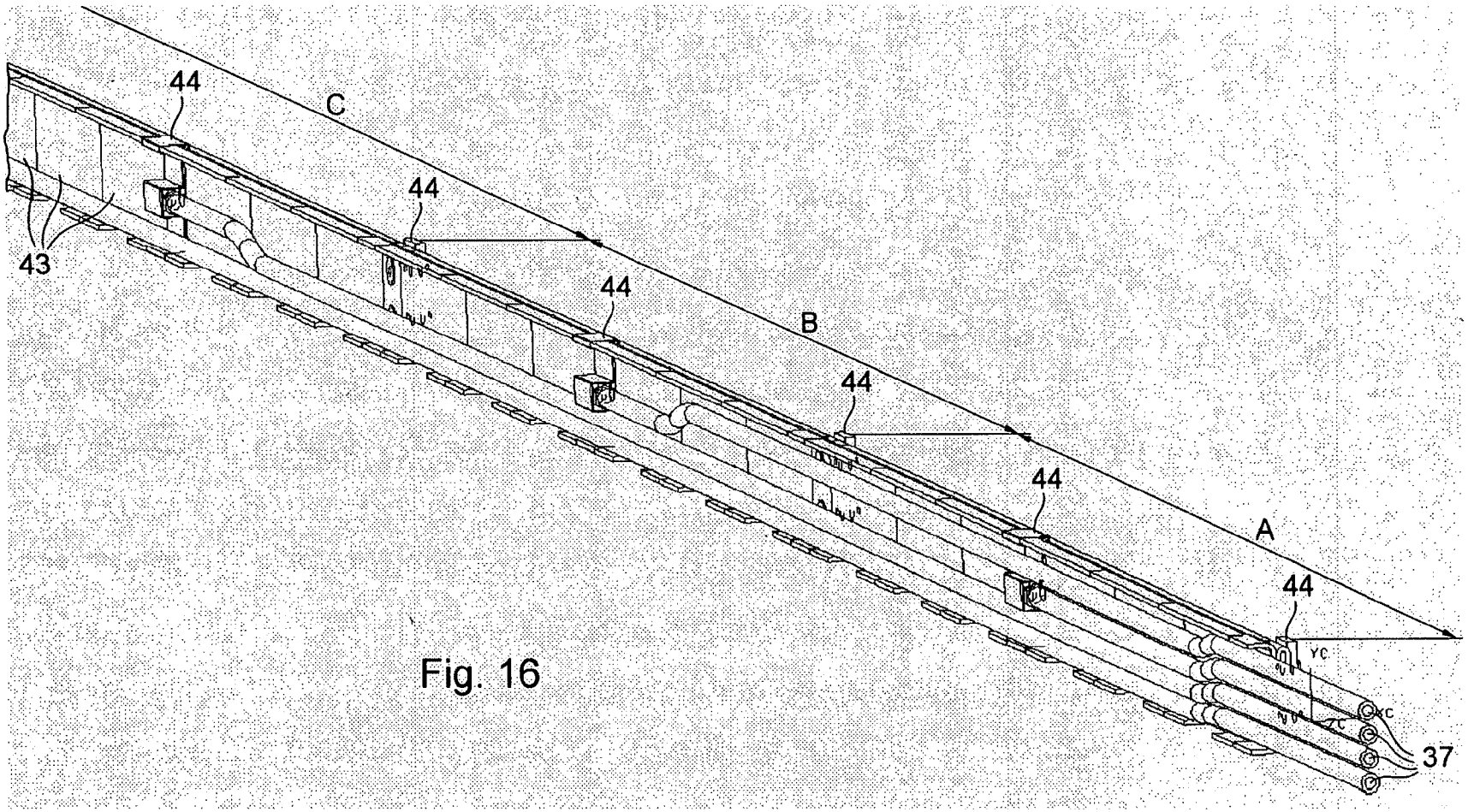
FIG. 16 a perspective representation of a part of a plate or forme end holding device positioned in the forme cylinder.

In each of the grooves 07 of the forme cylinder 06, pneumatically actuable plate or forme end holding devices are arranged, as depicted in FIG. 16; 17. Compressed air is supplied to the forme cylinder 06 via a compressed air intake device 28 that can be attached to an end surface of the relevant forme cylinder 06. In FIG. 7 the compressed air intake device 28 is shown, in the partial drawing a), in its status attached to the forme cylinder 06. It is shown in the partial drawing b) as a separate component. It is also shown, in the partial drawing c), in a sectional representation. FIGS. 8 and 9 each show a longitudinal cross-section through this compressed air intake device 28, which is represented in FIG. 7. This compressed air intake device 28 has a non-rotatable, annular outer section 29, on which ports 31 for the supply of compressed air are formed, and an inner section 33, which is connected to axial journals 32 of the forme cylinder 06. The inner section 33 can be rotated together with the forme cylinder 06. Therefore, this type of compressed air intake device 28 is also called a rotary intake. A part of the non-rotatable outer section 29 of the compressed air intake device 28, which is mounted, for example, on a roller bearing, can be displaced axially in relation to its inner section 33. The outer section 29 thus has at least two operational positions, namely a first operational position in which compressed air supplied from the outside is transferred to the inner section 33 and is then introduced into the forme cylinder 06, and a second operational position in which the supply of compressed air to the forme cylinder 06 is blocked. In this second position, compressed air, which is supplied from the outside, cannot be transferred to the inner section 33. Only a single compressed air intake device 28 is provided on the forme cylinder 06, and is thus provided on only one of its end surfaces.

Figure 10:
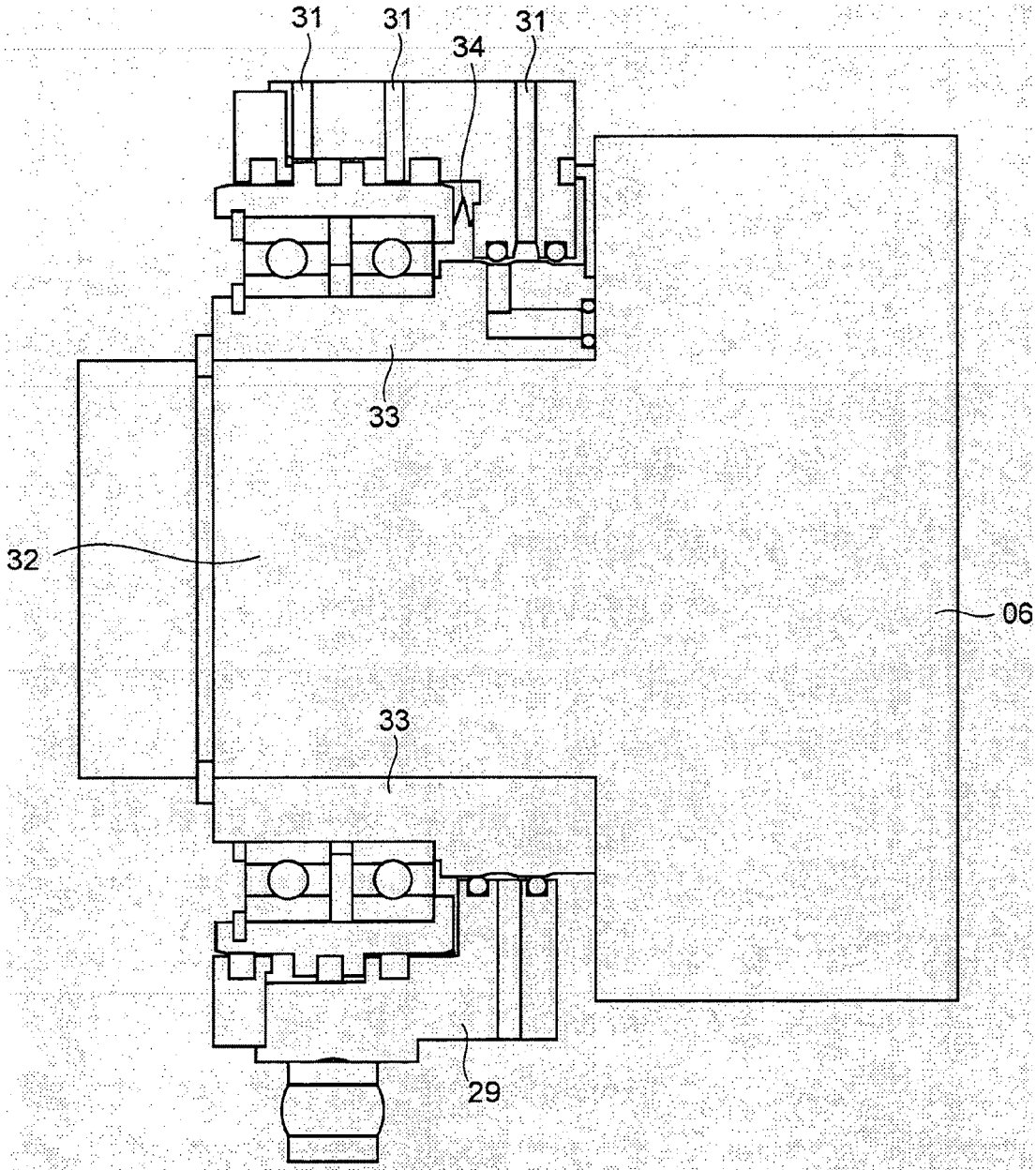
FIG. 10 a schematic representation of a compressed air intake device in a longitudinal section.
Figure 11:
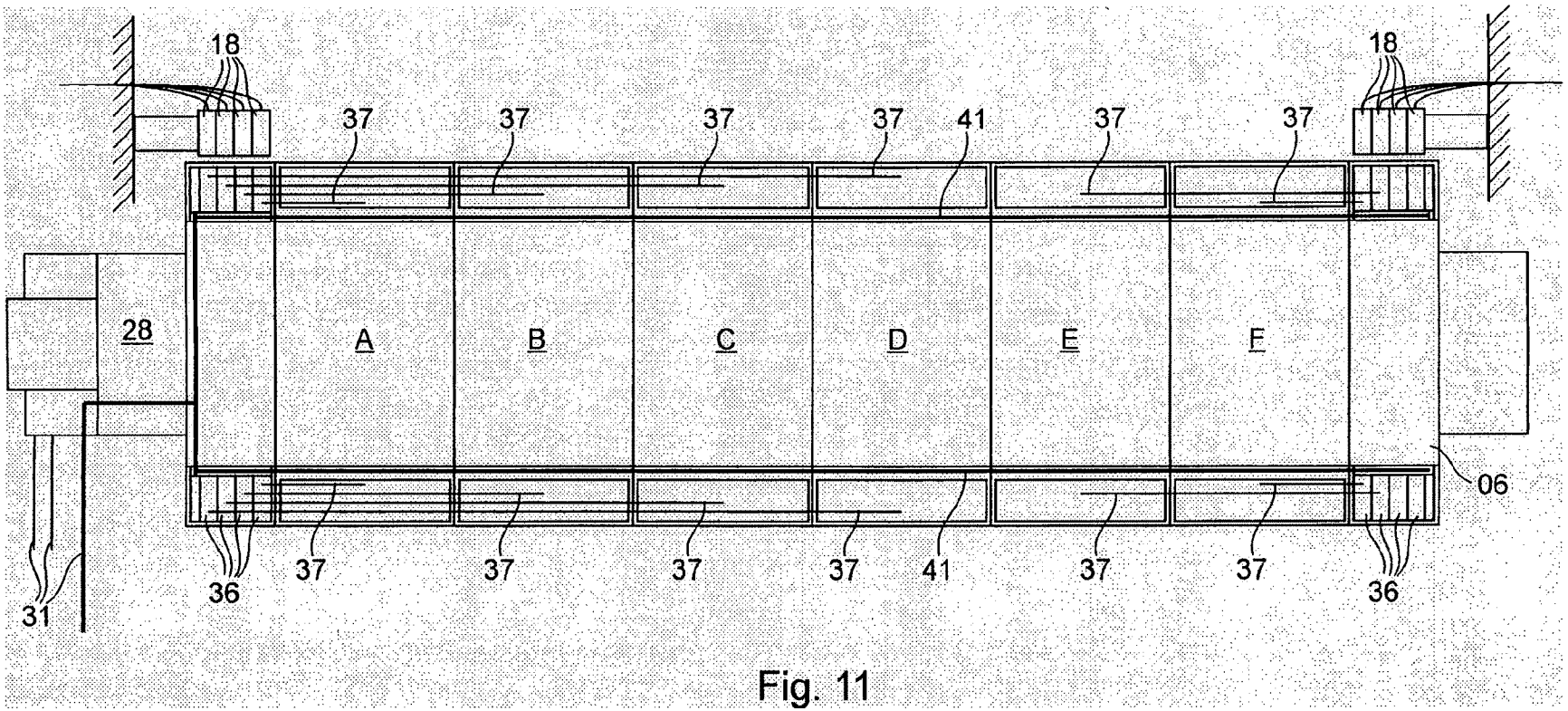
FIG. 11 a schematic representation of a front elevation view of a forme cylinder in accordance with FIGS. 1 to 4.

FIG. 10 again shows a longitudinal section of the compressed air intake device 28, in a schematic representation. The pneumatic or compressed air port 31, which is close to the barrel of the forme cylinder 06, and which is represented as being enlarged in FIGS. 8 through 10 by way of example, serves to supply compressed air to be introduced into the grooves 07. The two smaller pneumatic ports 31, which are especially apparent in FIGS. 8 and 9, serve to actuate the outer section 29, which is capable of being displaced relative to the inner section 33, to thereby select the respective operational position. The compressed air intake device 28 is preferably remotely actuable. In FIG. 10, a spring element 34 is depicted, which spring element 34 acts in the axial direction of the forme cylinder 06 and shifts the outer section 29, after a change in its operational position, back to its original position in relation to the inner section 33 by virtue of a spring force. Preferably, the compressed air, which is to be distributed on the forme cylinder 06 to its respective holding devices, is transmitted via only a single line from an outer pressurized medium source to the rotating or to the at least rotatable forme cylinder 06. The compressed air to be distributed to the forme cylinder 06 is preferably introduced radially into the outer section 29 of the compressed air intake device 28. It is then transferred coaxially from the inner section 33 of the compressed air intake device 28 to the forme cylinder 06. In other words, it is introduced in an end surface of the forme cylinder 06, as shown in FIGS. 8 to 11. The so-introduced compressed air is then distributed from this single line via at least one compressed air distribution device which is located in a recess in the forme cylinder 06, which recess is preferably located near the end surface, especially outside of the sections A; B; C; D; E; F and which is thus outside of the printing area of the circumferential surface of the forme cylinder 06, as seen in FIG. 11.

FIG. 11 shows a schematic representation of a longitudinal section through the forme cylinder 06, represented, for example, in FIGS. 1 and 4. In this embodiment, recesses, which are especially apparent in FIGS. 1, 3 and 6, and that open up like pockets in the circumferential surface of the forme cylinder 06, are formed at both ends of the forme cylinder 06 near its end surfaces. One of the axially parallel grooves 07 leads into each of these recesses. A length of each of these recesses, in the axial direction of the forme cylinder 06, ranges from 50 mm to 100 mm, for example. Preferably, in all four recesses of the forme cylinder 06, namely at both recesses which are provided at both ends of each of the two grooves 07, controllable valves 36 are positioned, with which the compressed air distribution to the forme cylinder 06 can be controlled. These controllable valves 36 thus embody the previously recited device for distributing compressed air. In the forme cylinder 06, preferably only a single line is provided, which single line conveys the compressed air, that is transmitted to the forme cylinder 06 via the compressed air intake device 28, to the valves 36 which are arranged in the respective recesses.

In the embodiment which is shown in FIG. 11, the forme cylinder 06 has six sections A; B; C; D; E; F which are arranged side by side in its axial direction. Because of the provision of forme cylinder 06 with two grooves 07, which are offset diametrically from one another, two printing formes 01 can be arranged one in front of another in the circumferential direction in each of the six sections A; B; C; D; E; F on the circumferential surface of the forme cylinder 06, so that a total of twelve printing formes 01 can be arranged on this forme cylinder 06. Each of the six sections A; B; C; D; E; F is assigned plate end holding devices, which can be actuated by section in the two grooves 07, and with which the printing formes 01, which are arranged in the respective sections A; B; C; D; E; F, are each held on the circumferential surface of the forme cylinder 06. Using only a single compressed air line, compressed air is transmitted to the barrel of the forme cylinder 06 by the use of the compressed air intake device 28, as described in connection with FIGS. 7 to 10, which device 28, as seen in FIG. 11, is attached at the left end surface of the forme cylinder 06. In the forme cylinder 06, the compressed air is fed via lines to the valves 36 which are located in the recesses of the forme cylinder 06. Each of the six sections A; B; C; D; E; F is assigned one valve 36 in each groove 07. Therefore, at least as many valves 36 are provided in the forme cylinder 06 as that forme cylinder 06 has sections A; B; C; D; E; F. In the embodiment which is represented in FIG. 11, a block that is comprised of four valves 36 is arranged in each of the four recesses. In the two recesses which are positioned close to the compressed air intake device 28, all four valves 36 are used in each case. From each of these valves, a branch line 37 leads respectively to one of the sections A; B; C; D; E; F, and preferably leads to one of the closest four sections A; B; C; D, which are arranged side by side. In each groove 07, one compressed air line 41 leads to the recess that is farthest from the compressed air intake device 28. Only two of the valves 36 which are located in these remote recesses, which are located at the other end surface of the forme cylinder 06, are used. From two of these valves 36, a respective branch line 37 leads respectively to one of the sections A; B; C; D; E; F, and namely preferably leads to those sections A; B; C; D; E; F that are not supplied from the recesses that are close to the compressed air intake device 28. In an alternative embodiment, all of the sections A; B; C; D; E; F of the forme cylinder 06 can also be supplied with compressed air via valves 36 that are located at the same end surface. However, in terms of standardization in the embodiment of the recesses and the blocks of valves 36, the embodiment shown in FIG. 11 offers some advantages. At both end surfaces of the forme cylinder 06, Schmitz rings can optionally be attached. If a Schmitz ring is attached to an end surface of the forme cylinder 06, this Schmitz ring delimits the at least one recess of this forme cylinder 06 at its end surface.

As is apparent in FIG. 11, control devices 18, which are oriented toward the circumferential surface of the forme cylinder 06, are provided outside of the forme cylinder 06 and at its two end surfaces. These control devices 18 are allocated to the valves 36, and are oriented in a radial line of action. With these control devices 18, the valves 36, which are respectively positioned in the recesses of the forme cylinder 06, can be actuated selectively, individually and independently of one another, in a contactless fashion, without direct mechanical contact. The respective control devices 18, which can preferably be electrically and therefore remotely actuated, are preferably arranged fixed to the frame in the printing press. These control devices 18 can be actuated via a computer unit, which is part of the printing press. Such a computer unit can be located in a control station that is a part of the printing press, for example. The control devices 18 can employ a preferably magnetic or inductive principle of operation to actuate the respective valves 36. The respective valves 36 can also be actuated via a radio signal. If a magnetic or an inductive operating principle is employed, and in order to prevent an override in the control of the valves 36 that are situated in the same recess, and to thus improve their selective actuation, valves 36 that are located in the same recess are preferably arranged spaced somewhat from one another in the axial direction of the forme cylinder 06. A spacing distance between adjacent valves 36 may range from 1 mm to 15 mm, for example, and preferably may range from 8 mm to 14 mm, and ideally will range from 10 mm to 12 mm. The devices for actuating the valves 36, which are located in the same recess, can also be arranged offset circumferentially from each other in an alternating fashion, for example, so that the devices for actuating the first and third valves 36 of the same valve block and the devices for actuating the second and fourth valves 36 of that valve block, for example, are aligned with one another in the axial direction of the forme cylinder 06.

Figure 12:
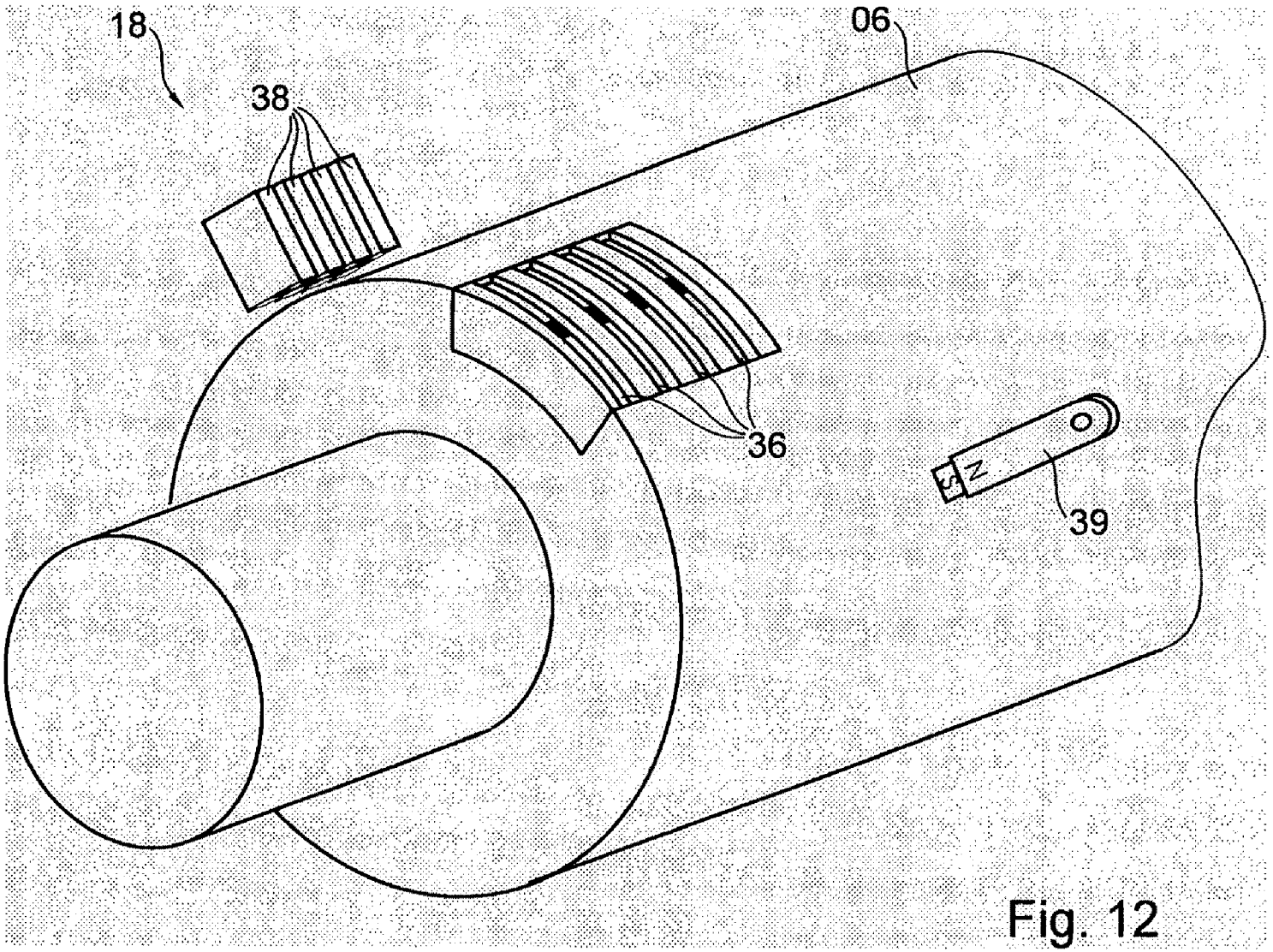
FIG. 12 a perspective representation of a portion of the forme cylinder in accordance with FIG. 11.

FIG. 12 shows a perspective view of a section of the forme cylinder 06 that is represented in FIG. 11, with a recess formed at the end surface and with a valve block positioned inside this recess, and with four valves 36 arranged in a row in the axial direction of the forme cylinder 06. Each of these valves 36 is magnetically actuable, for example. A control device 18, comprising four electrically controllable magnets 38 arranged side by side, is provided near the periphery of the forme cylinder 36, and is assigned to the valves 36 which are arranged in the forme cylinder 06. Each of these valves 36 can be actuated with the control device 18 when the device for actuating the valve 36 to be actuated is situated radially beneath the relevant magnet 38 of that control device 18, as a result of a rotation of the forme cylinder 06. Alternatively, or additionally, the device for actuating each respective valve 36 can also be activated by use of a hand-held magnet 39, which is manually placed in active connection with the respective actuation device. Rather than being configured as a separate tool, such a hand-held magnet 39 can also be attached in, or can be secured onto a glove which may be worn by the printing press operator, for example. A radial distance between the control device 18 and the respective device for actuating the particular valve 36 to be activated measures between 2 mm and 50 mm, for example, preferably measures between 5 mm and 30 mm, and ideally measures between 6 mm and 10 mm. The valve block, which is located in the recess, is preferably covered by a non-metallic cover, such as, for example, a cover which is made of a plastic, which cover fits into the recess, and thereby protects the valve block from becoming soiled.

Figure 13:
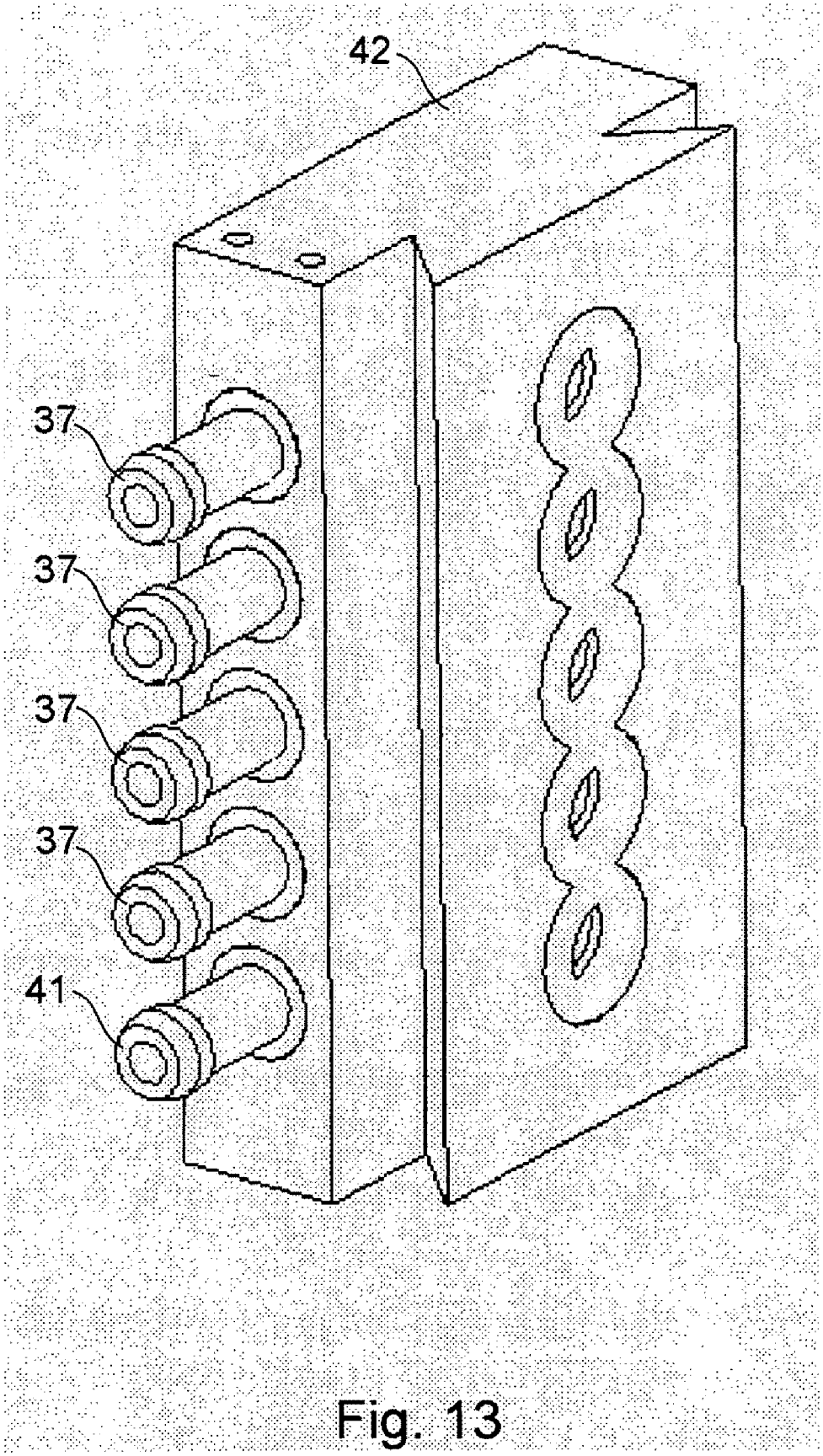
FIG. 13 a perspective representation of a valve block in accordance with the present invention.
Figure 14:
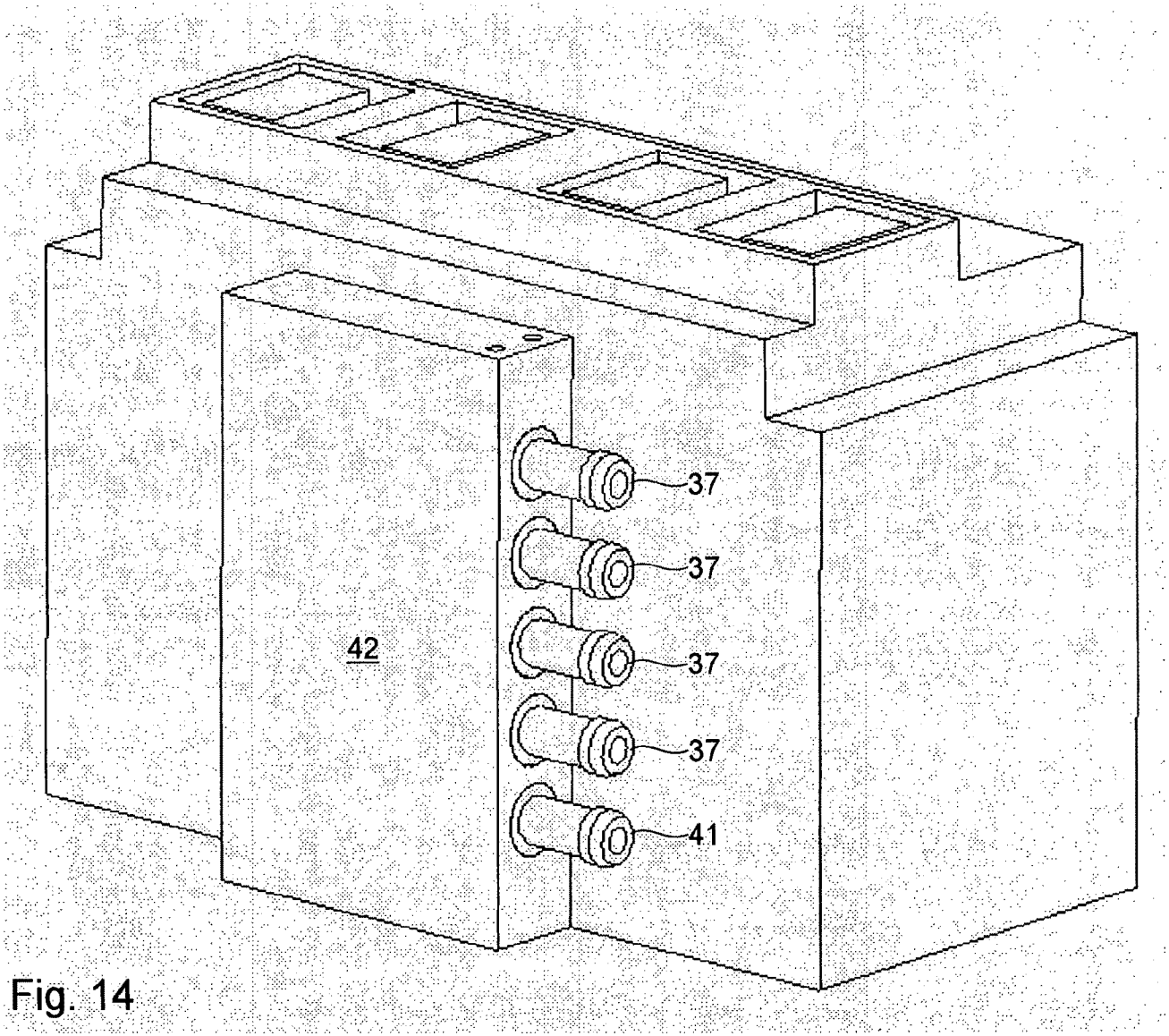
FIG. 14 a perspective representation of a junction box.
Figure 15:
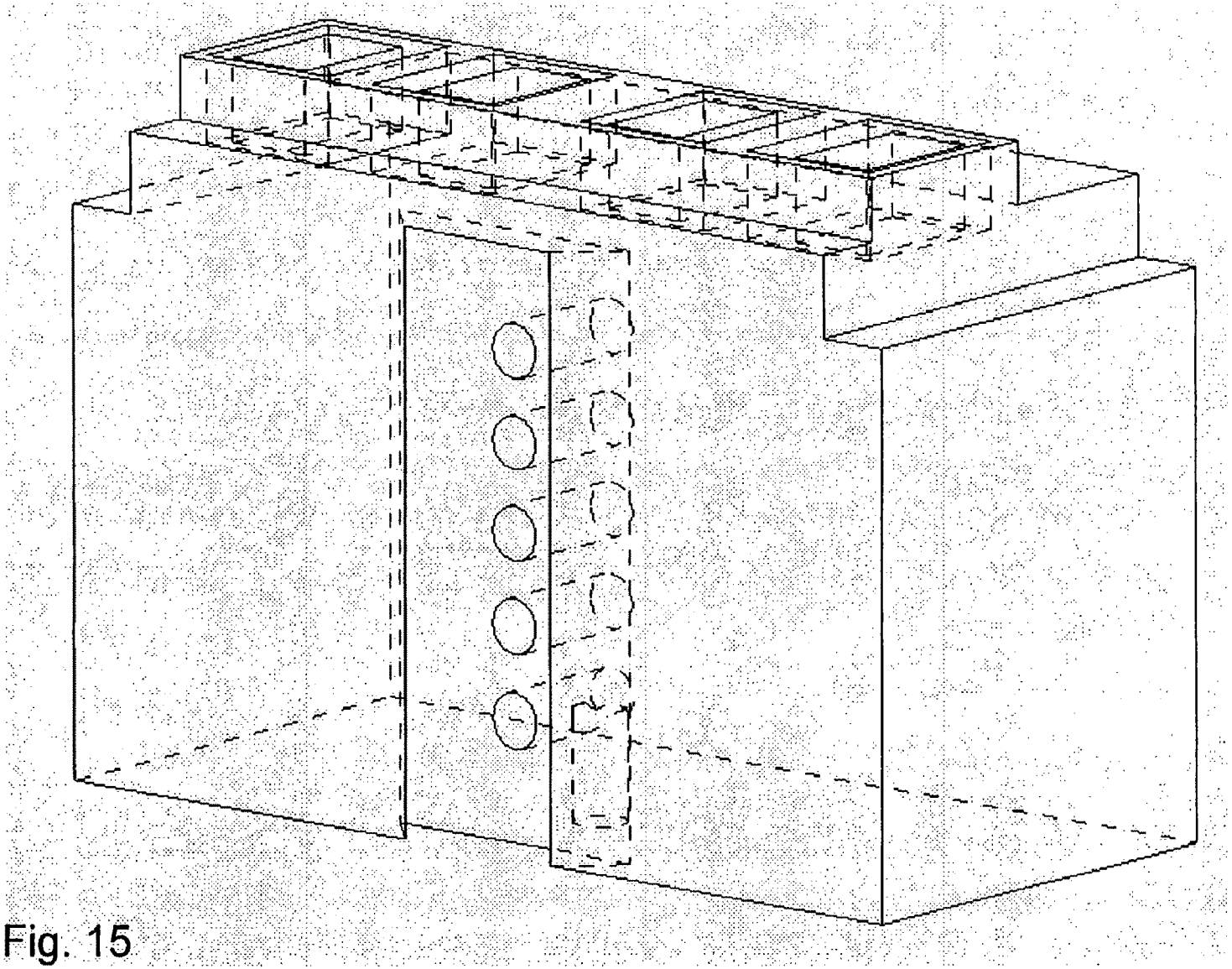
FIG. 15 a perspective representation of a valve block without junction box, in accordance with FIG. 14.

FIG. 13 shows a junction box 42 which is part of a valve block that can be positioned in one of the recesses of the forme cylinder 06. A plurality of branch lines 37, such as, for example, four such lines, leading to the respective sections A; B; C; D; E; F, and one compressed air line 41 that passes through the respective groove in the forme cylinder 06, for example, can be connected to this block. This junction box 42 is equipped with connectors for the respective pneumatic lines 37 that are positioned in the groove 07. The respective pneumatic lines 37 can be plugged onto the connectors on the junction box 42. The junction box 42 can be configured to be pushed onto the valve block and can be secured by the use of a quick connection, such as, for example, by a dovetail connection. FIG. 14 shows the junction box 42 attached to the valve block. The valve block which is shown in FIG. 14 has four actuation devices, arranged side by side in a row, spaced somewhat from one another, on its upper side. These four actuation devices can be used, for example, for the selective actuation of the respective valves 36 of this valve block. FIG. 15 shows this valve block without the junction box 42. The valve block, which can be positioned in one of the recesses of the forme cylinder 06, can advantageously be easily replaced, in case of a malfunction for example, by separating the valve block from its junction box. No pneumatic lines 37 need to be removed from the valve block itself, as these pneumatic lines 37 are connected only to the junction box 42. The junction box 42 thus also performs the function of a quick connector that produces the quick connection. The junction box 42 can be separably, and securely connected to a wall of the respective groove 07, for example, so that the respective valve block is merely pushed onto the dovetail connection of the valve block.

Figure 17:
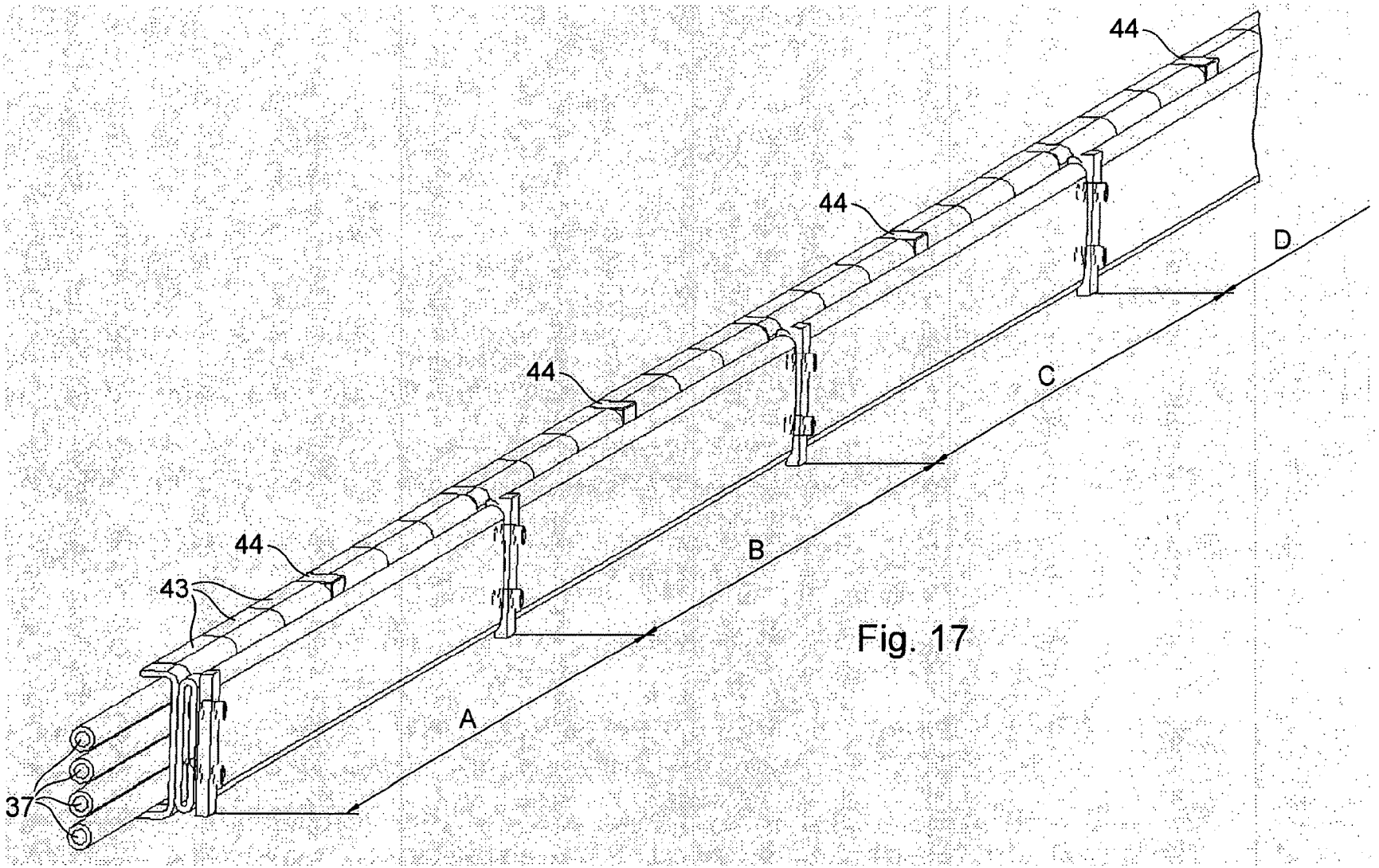
FIG. 17 a schematic representation of a view from the rear of the plate or forme end holding device in accordance with FIG. 16.

FIG. 16 shows a perspective view of a part of an arrangement of holding devices to be positioned in one of the grooves 07 of the forme cylinder 06, and extending over several sections A; B; C; D; E; F. Each of these holding devices, which are each assigned to one of the sections A; B; C; D; E; F, has at least one clamping element 43. Preferably, a plurality of clamping elements 43 are arranged side by side in the relevant section A; B; C; D; E; F. Preferably, each of the pneumatic lines 37 to be connected to the junction box 42 of a valve block carries the compressed air to a respective one of the sections A; B; C; D; E; F which are arranged side by side. In each case, the respective pneumatic line 37 is preferably routed to the center area of one of the sections A; B; C; D; E; F, where the respective pneumatic line 37 then ends. When one or more of the pneumatic lines 37 are filled with compressed air, by an actuation of the respective valve 36, clamping elements 43 in the section A; B; C; D; E; F, and connected to the relevant pneumatic line 37, which clamping elements 43 are arranged inside or along one of each of the sections A; B; C; D; E; F, are moved outward toward the periphery of the forme cylinder 06, thereby releasing the clamping force being exerted by the clamping elements 43. When the clamping elements 43 are in this released position, an end of a printing forme 01 can be inserted into the groove 07 in the relevant section A; B; C; D; E; F. Once the pressure of the compressed air in the respective pneumatic line 37 drops below a previously established level, the clamping elements 43, which are arranged in the respective section A; B; C; D; E; F, change their operating position and return to their clamping mode. In the example shown in FIGS. 16 and 17, in each case, six clamping elements 43 are provided in each section A; B; C; D; E; F, and are arranged side by side in the axial direction of the forme cylinder 06. In each such case, three of these clamping elements 43 are combined to form a group. For example, between two adjacent groups of clamping elements 43, all of which are located in the same section A; B; C; D; E; F, or in the center of each section A; B; C; D; E; F, for example, a register element 44 is provided. This register element 44 is utilized to ensure that the relevant printing forme 01 will be positioned on the forme cylinder 06 true to register. Each respective register element 44 determines an axial position of the relevant printing forme 01. FIG. 17 shows a rear view of the configuration of a part of the holding devices to be arranged in one of the grooves 07 of the forme cylinder 06, shown in FIG. 16.

Figure 18:
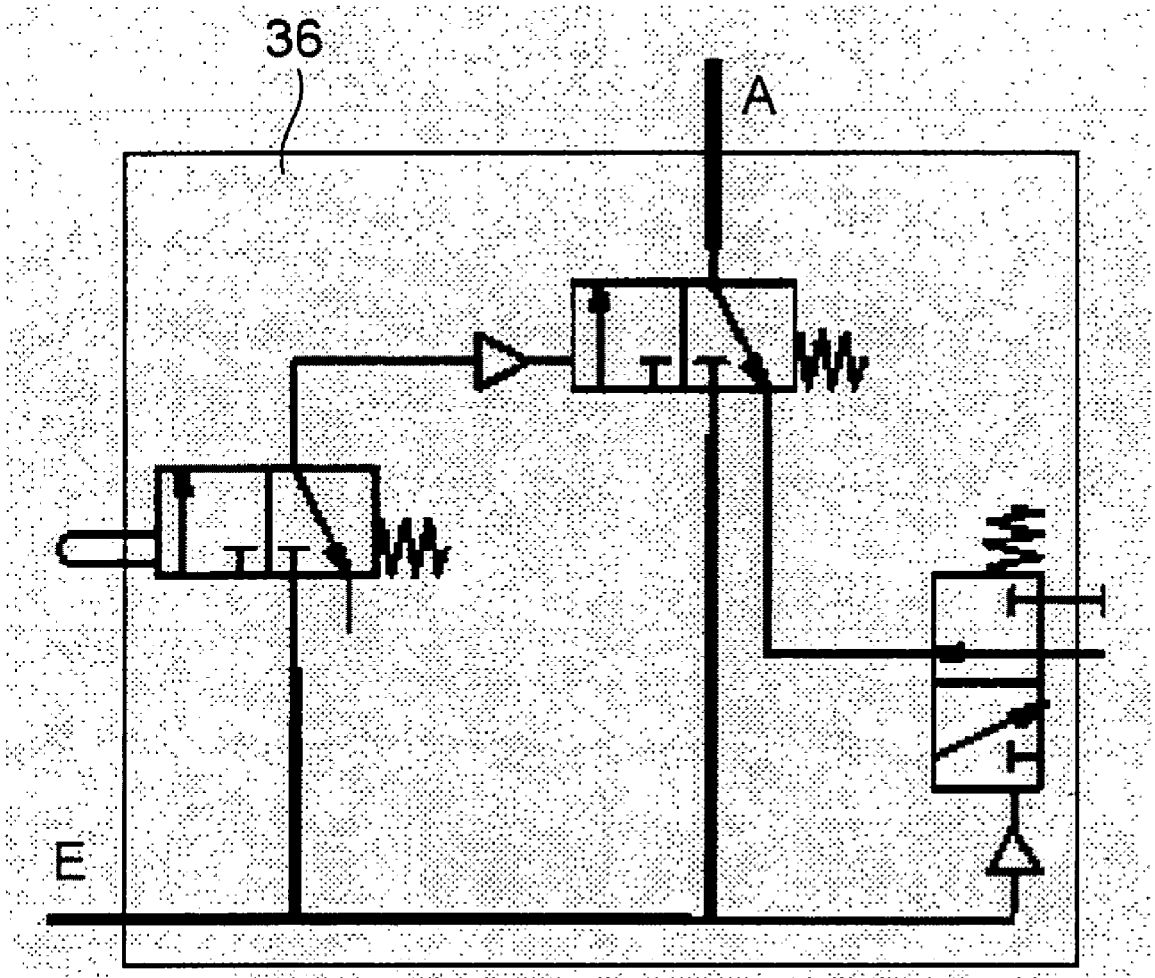
FIGS. 18 to 20 three different embodiments of the pneumatic circuit for one of each of the valves positioned in one of the grooves of the forme cylinder.
Figure 19:
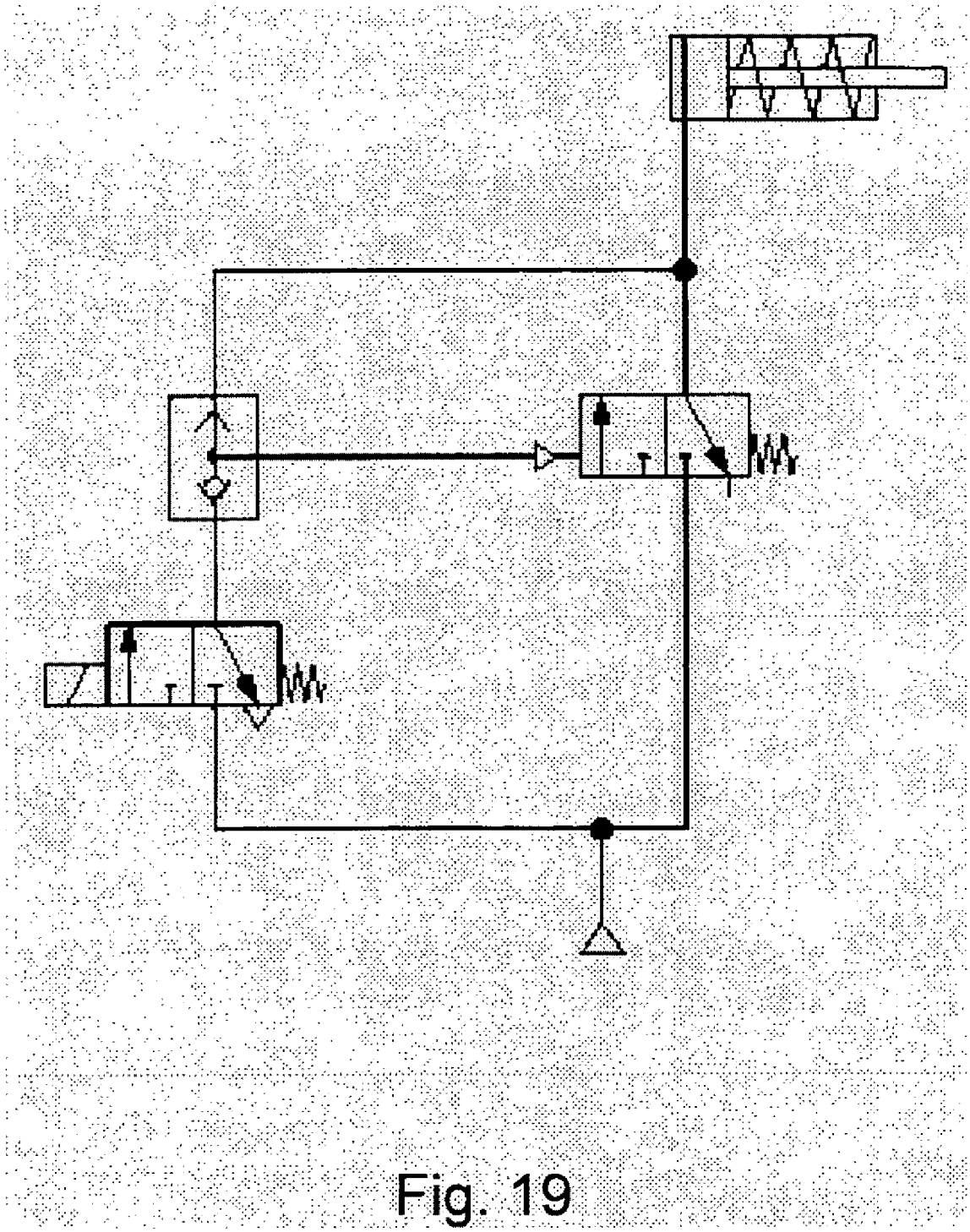
Figure 20:
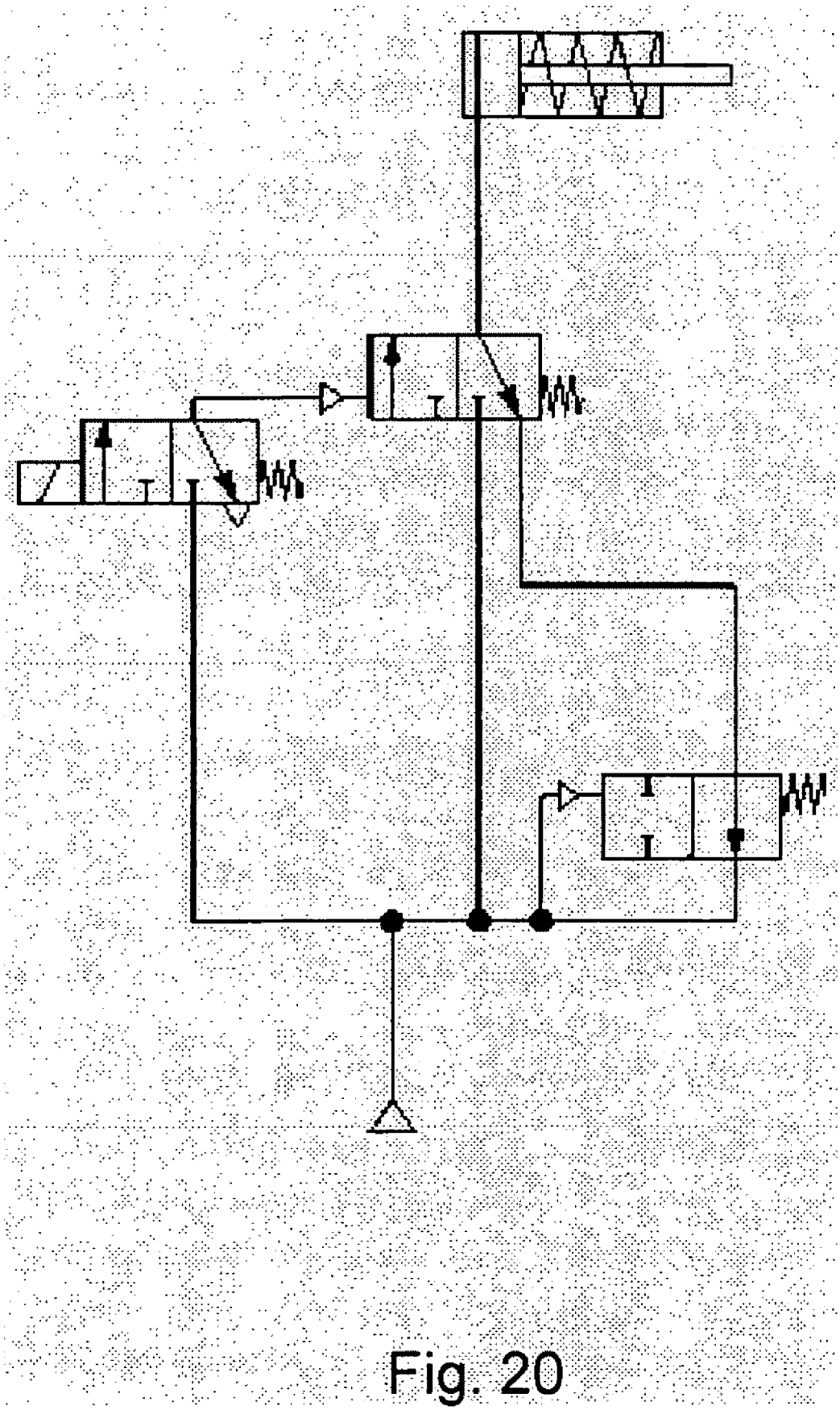

FIGS. 18 through 20 show three different embodiments of the respective pneumatic circuitry of one of each of the valves 36 which are arranged in one of the grooves 07 of the forme cylinder 06, by way of example. Once they have been actuated, the valves 36 preferably remain locked. This is especially the case once the actuation of a valve 36, which is assigned to at least one of the holding devices or clamping elements 43 situated in the groove 07, has triggered a change from the holding position to the released position of this holding device.

In FIGS. 19 and 20, a working cylinder, which is connected to the valve circuit, indicates schematically the holding device in the groove 07 of the relevant forme cylinder 06, which holding device is to be actuated via the valve 36. The valves 36 are actuated mechanically, for example, but preferably are actuated without physical contact, and are especially activated magnetically or electromagnetically. In FIG. 18, the letter "E" denotes the compressed air intake into the pneumatic circuit for this valve 36, and the letter "A" denotes the compressed air outlet from this pneumatic circuit.

Figure 21:
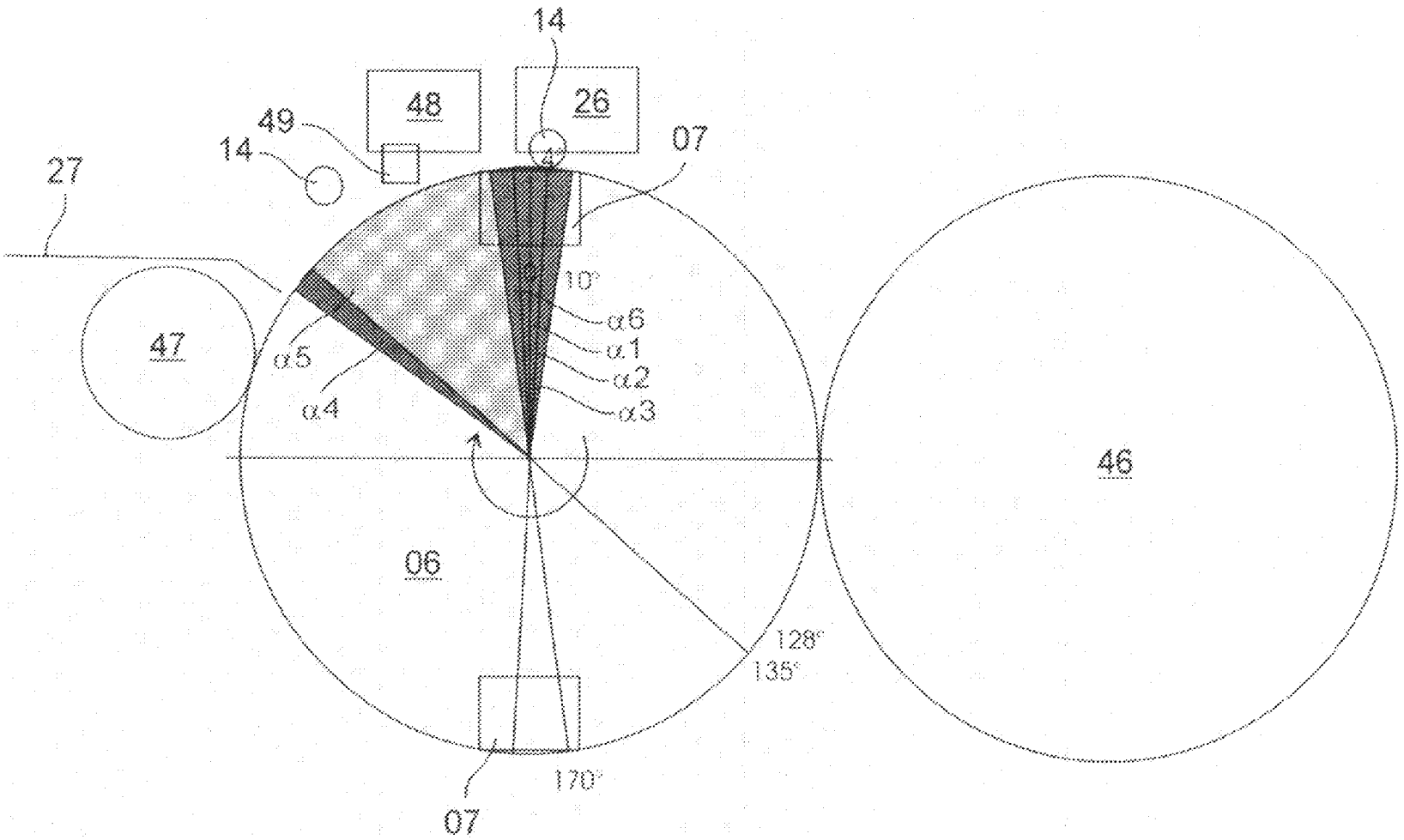
FIG. 21 a schematic representation of a sequence control in accordance with the present invention.

FIG. 21 shows a schematic representation of a sequence control for at least one of the valves 36 that is located in one of the grooves 07 of the relevant forme cylinder 06. In FIG. 21, the forme cylinder 06, and a transfer cylinder 46 that cooperates with it, together with a roller of an inking unit 47, which applies ink to at least one printing forme of the forme cylinder 06, are shown. In FIG. 21, a printing forme 01 to be mounted on the forme cylinder 06, and which is not specifically shown, is fed to the forme cylinder 06 from the left, on a horizontally aligned support surface 27 of an infeed device, for example. A register strip 48, which uses at least one lateral stop 49 to align the respective printing forme 01 true to lateral register, as it is being fed to the forme cylinder 06, and a roller strip 26 having rollers 14 that can be engaged against the forme cylinder 06, as seen in FIGS. 1 through 6, are arranged at the periphery of the forme cylinder 06, for example. FIG. 21 shows the angular positions of the forme cylinder 06, which is depicted by way of example, at which angular positions the respective valve 36 can be actuated, in order for a printing forme 01 to be either mounted or secured, on the forme cylinder 06, or removed or released, from it.

Figure 22:
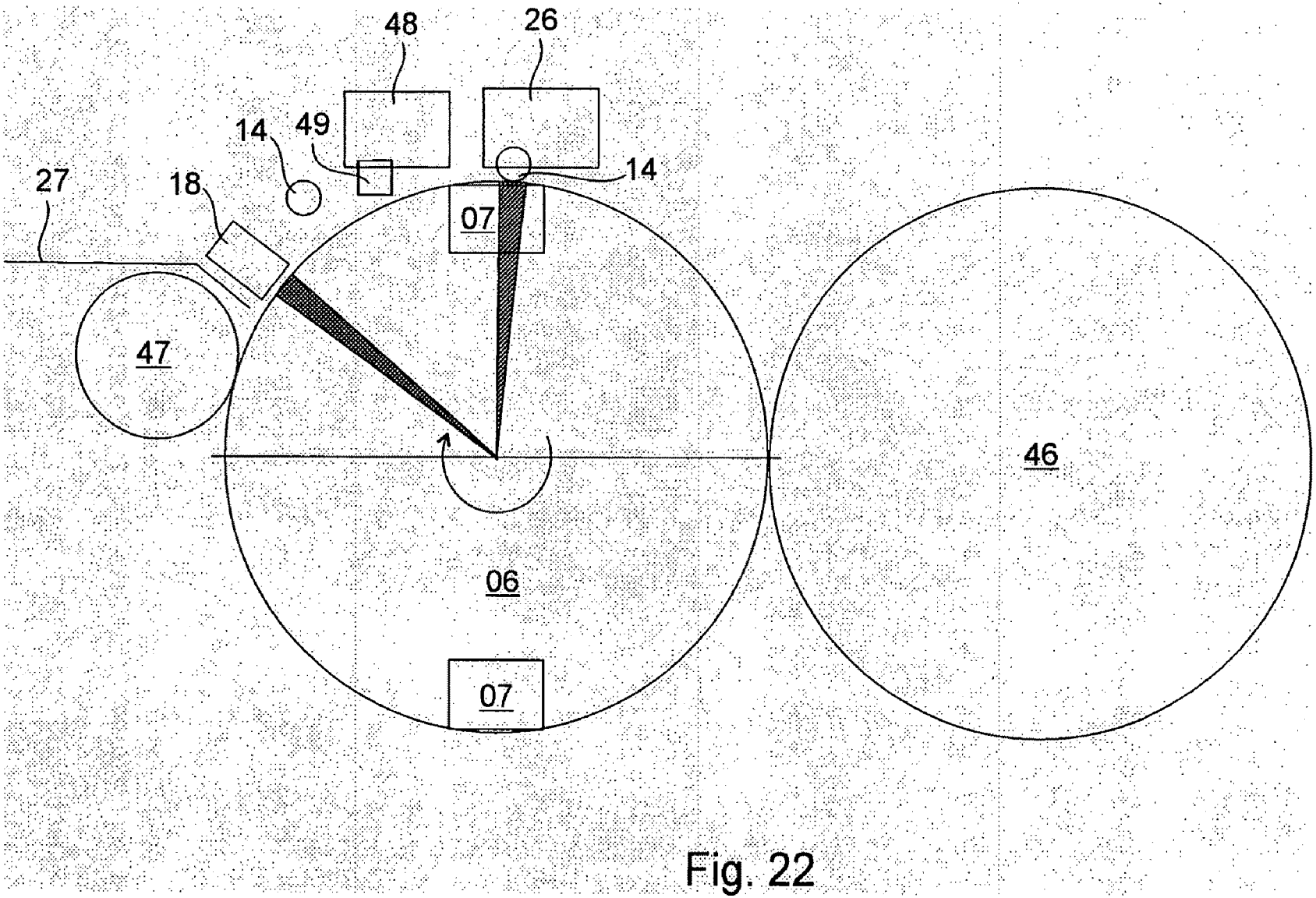
FIG. 22 a schematic arrangement of those sectors which are particularly relevant for mounting a printing forme on the forme cylinder, in accordance with FIG. 21.

In accordance with the example, which is represented in FIG. 21, when the forme cylinder 06 is in the angular positional $\alpha 1=0°$ during mounting of a printing forme 01 in the respective section A; B; C; D; E; F, the relevant holding device for the leading edge 02, or the leading end of the relevant printing forme 01, in the direction of production of the forme cylinder 06, can be selectively opened and closed. When the forme cylinder 06 is in the angular position $\alpha 2=4°$, during mounting of a printing forme 01 in the respective section A; B; C; D; E; F, the respective holding device for the rear edge 12, or for the trailing end of the printing forme 01, in the direction of production of the forme cylinder 06, is closed. When the forme cylinder 06 is in the angular position $\alpha 3=10°$, during anchoring of a printing forme 01 in the respective section A; B; C; D; E; F, the relevant holding device for the leading edge 02 of this printing forme 01 is opened or closed. In the angular range $\alpha 4$ of between 128° and 135°, during anchoring of a printing forme 01 in the respective section A;

B; C; D; E; F, the relevant holding device for the rear edge 12 of this printing forme 01 is first opened and is then closed again. When the forme cylinder 06 is in the angular position $\alpha 5$=170° during mounting of a printing forme 01 in the respective section A; B; C; D; E; F, the relevant holding device for the rear edge 12 of this printing forme 01 is opened. When the forme cylinder 06 is in the angular position $\alpha 6$=176°, during anchoring of a printing forme 01 in the respective section A; B; C; D; E; F, the relevant holding device for the leading edge 02 is closed. FIG. 22 again shows those circular sectors for the arrangement represented in FIG. 21 which are particularly relevant for the mounting of a printing forme 01 on this forme cylinder 06. When the forme cylinder 06 is in these angular positions, its valve 36, that is assigned to the respective section A; B; C; D; E; F, must be actuated.

Figure 23:
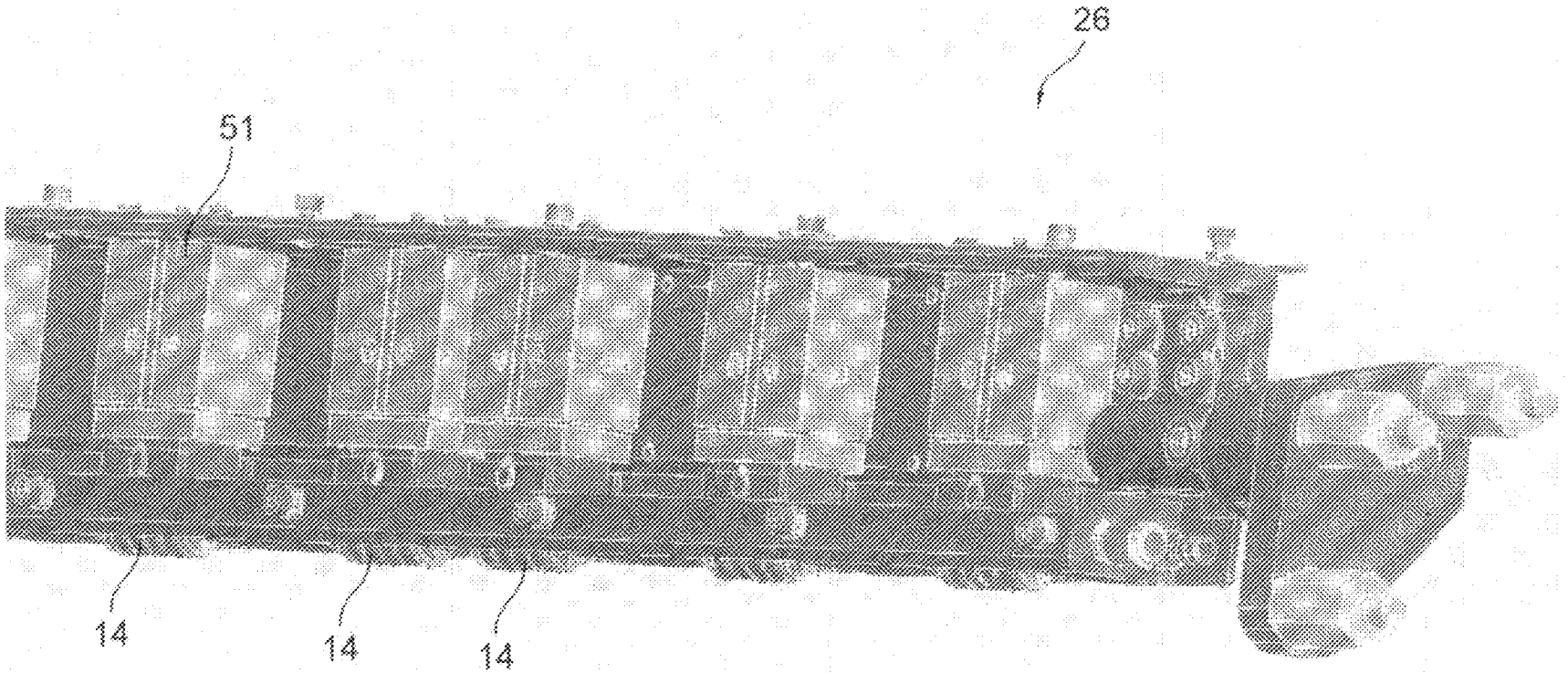
FIG. 23 a perspective representation of a first embodiment of a part of a roller strip, in accordance with FIGS. 1 to 6.

FIG. 23 again shows a part of the roller strip 26 which is also depicted in FIGS. 1 through 6. In this embodiment, each of the rollers 14 is assigned to at least one actuating element 51, which may be, for example, a pneumatic cylinder. Each roller 14 can thus preferably be selectively actuated via a computer unit which is assigned to the printing press. Each roller 14 can therefore be engaged against the forme cylinder 06 or can be disengaged from the cylinder, individually and independently of other rollers 14 in this roller strip 26.

Figure 24:
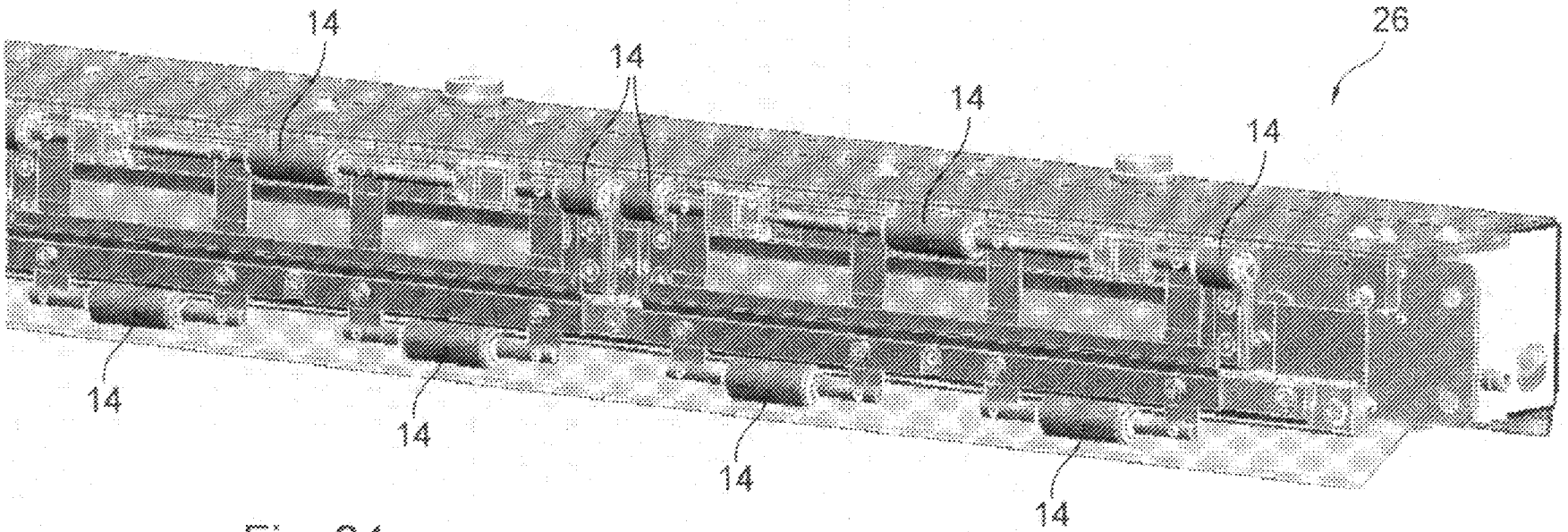
FIG. 24 a perspective representation of a second embodiment of the roller strip, in accordance with FIGS. 1 to 6.

FIG. 24 shows a part of another preferred embodiment of the roller strip 26, which is illustrated in FIGS. 1 through 6, in a view from below. This roller strip 26 is characterized in that it has a plurality of rollers 14 or roller elements 14 in each section A; B; C; D; E; F, which rollers 14 or roller elements 14 are respectively offset from one another in the circumferential direction of the forme cylinder 06.

Figure 25:
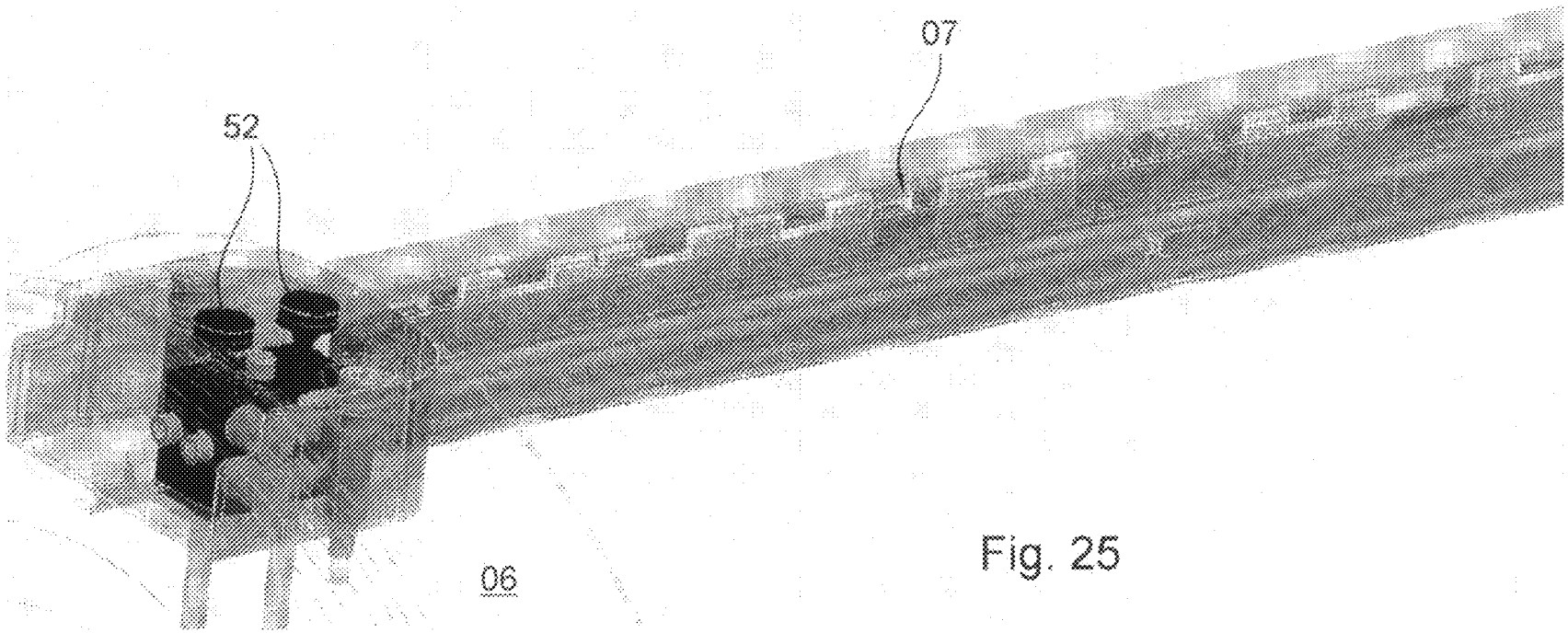
FIG. 25 a perspective representation of another embodiment of the forme cylinder in accordance with the present invention with a recess in its end surface, and with a groove extending axially parallel.
Figure 26:
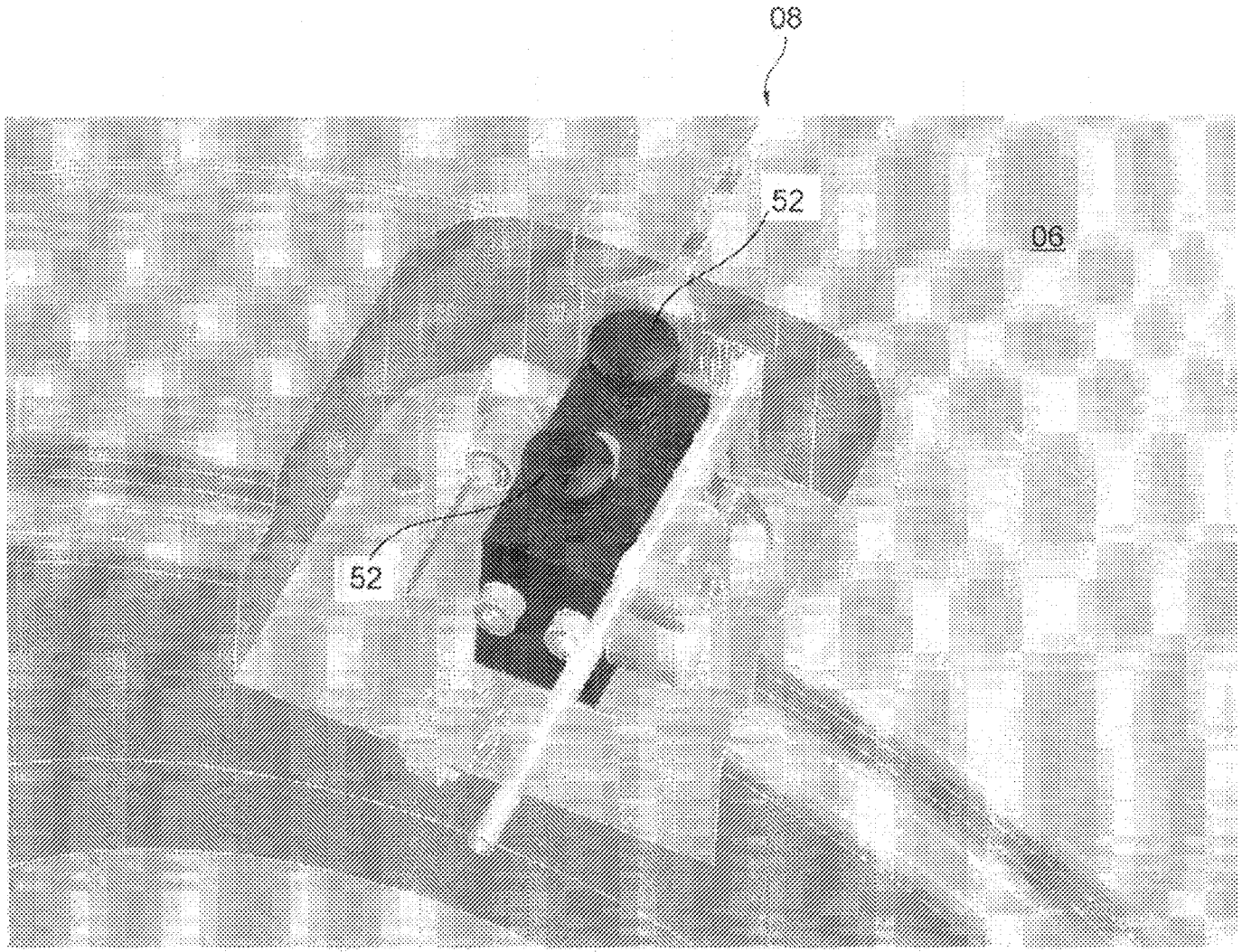
FIG. 26 a perspective representation of an enlarged section of a portion of the forme cylinder in accordance with FIG. 25.

FIG. 25 shows a perspective view of a part of another embodiment of the forme cylinder 06, with a recess at the end surface, and with a groove 07 extending axially parallel. Pneumatically actuable holding devices are arranged in the groove 07. Two manually actuable valves 36, for example, are located in the recess. These valves 36 do not have a self-locking mechanism, but instead act on the respective holding device as long as corresponding switching elements 52, such as contact switches 52, which act upon the valves 36, are actuated. FIG. 26 shows the forme cylinder 06 of FIG. 25 in an enlarged section, and from a different perspective. The recess of the forme cylinder 06 is shown, together with the switching elements 52 of the two manually actuable valves 36 and the groove 07, which is opened in the form of a slit by the opening 08.

Figure 27:
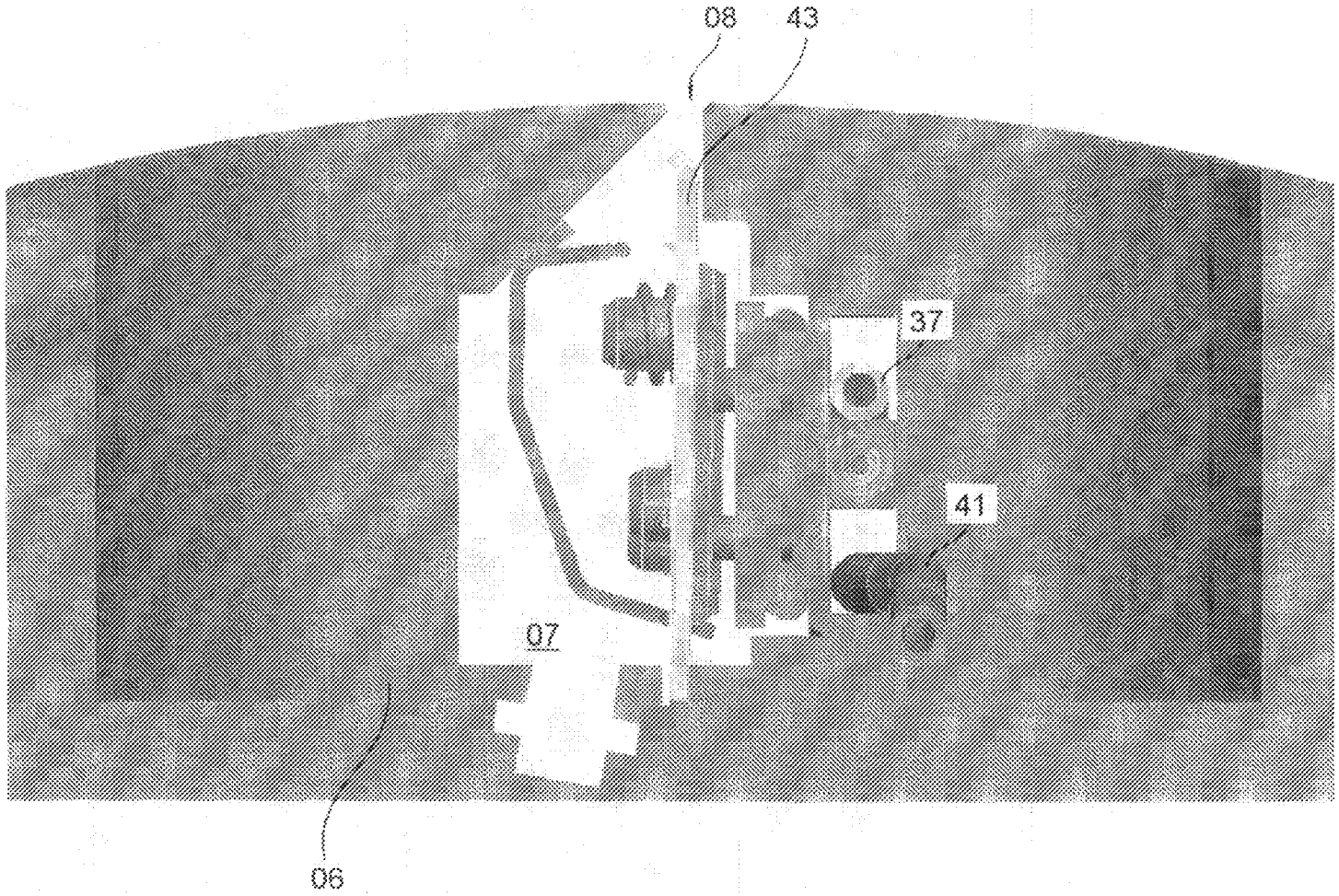
FIG. 27 a schematic cross-section, taken perpendicular to the axis of the forme cylinder, and showing holding devices arranged in the groove of the forme cylinder.
Figure 28:
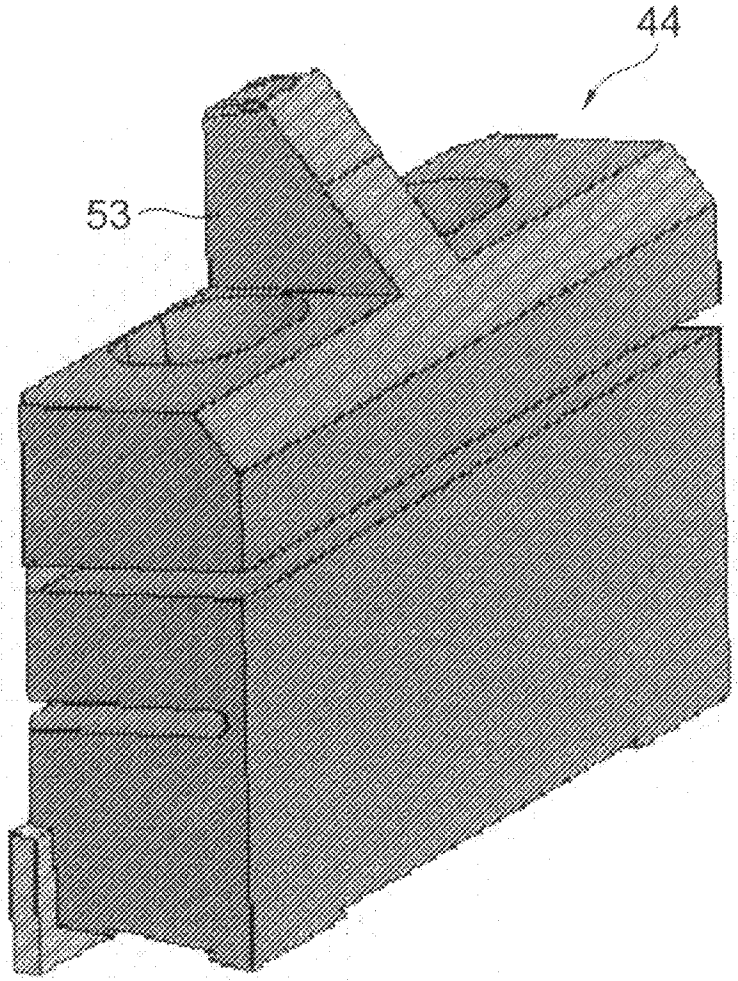
FIG. 28 a perspective representation of a clamping element of the plate or forme end holding device, and of a register element.
Figure 28:
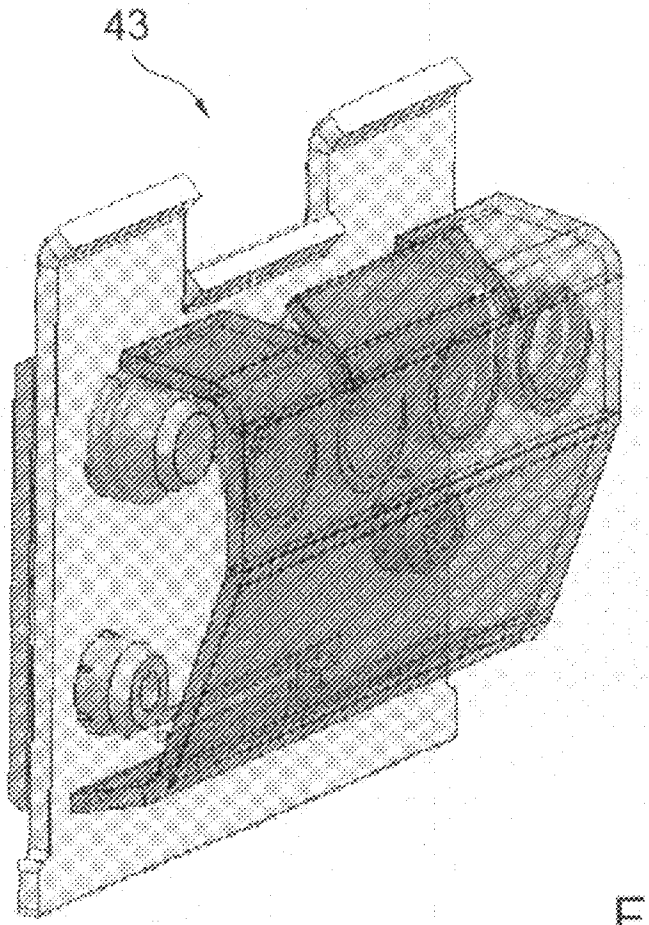

FIG. 27 shows a sectional view, taken perpendicular to the axis of the forme cylinder 06, of a section of one of the holding devices which are situated in the groove 07 of the forme cylinder 06. FIG. 28 shows an exploded perspective view of both an individual clamping element 43 of the holding device and a register element 44 that can be positioned in the groove 07 of the forme cylinder 06. The register element 44 can be adjusted, at least in its axial position in the groove 07 of the forme cylinder 06, and can be secured in this adjusted position. The register element 44 engages, through the provision of a projection 53 which is formed on it, for example, in a groove that is formed in the respective printing forme 01. A width of this projection 53, in the axial direction of the forme cylinder 06, and a corresponding width of the groove of the printing forme 01 are made to fit one another. Such a register element 44, which is used for the axial positioning of a printing forme 01 to be mounted, is located at the edge of each section A; B; C; D; E; F of the forme cylinder 06, for example, or preferably is mounted at the center of each section A; B; C; D; E; F of the forme cylinder 06, as seen in FIGS. 16 and 17.

Figure 29:
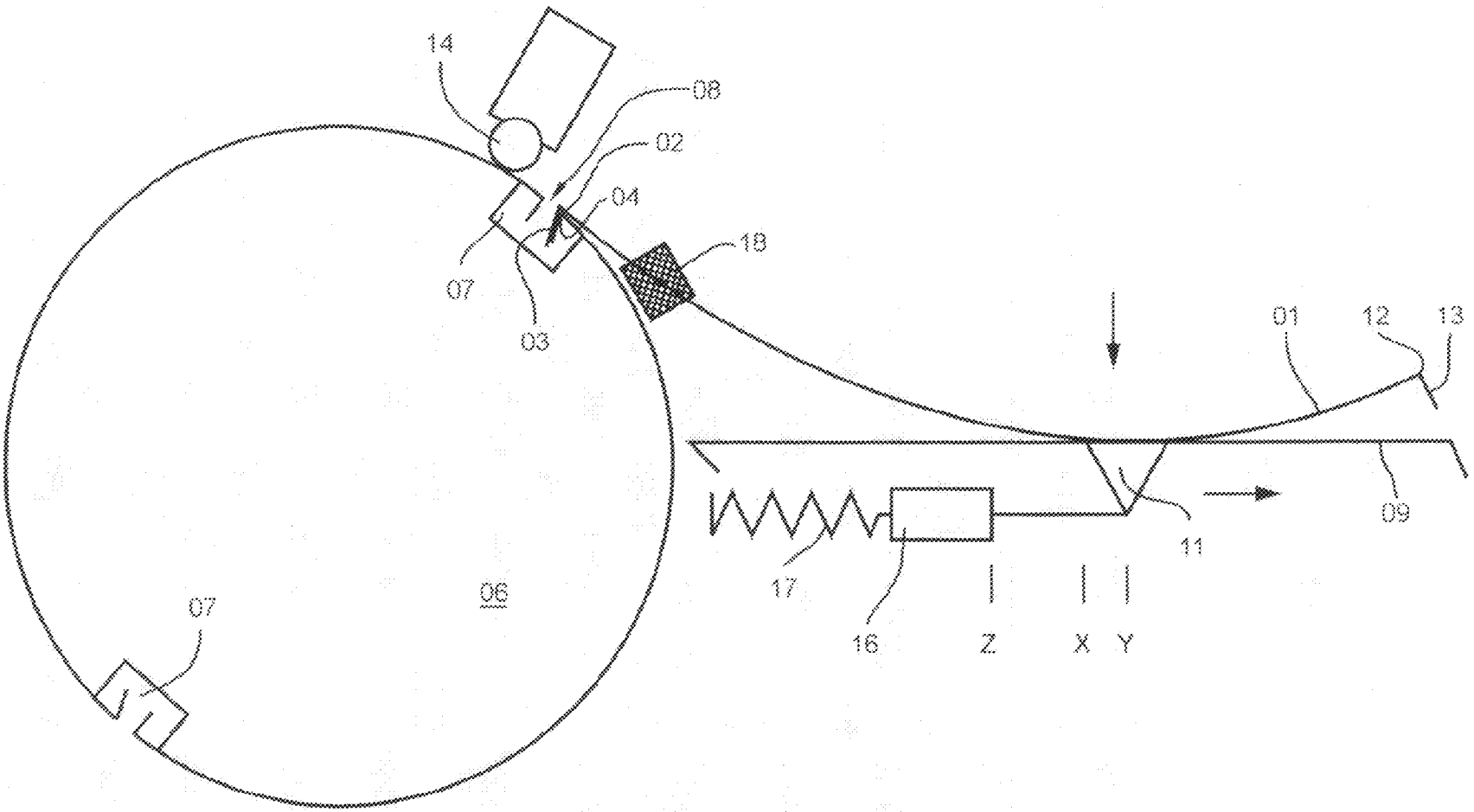
FIGS. 29 to 34 process steps undertaken during the mounting of a printing forme on a forme cylinder.

Mounting of at Least One Printing Forme:

As may be seen by referring to FIG. 29, the respective printing forme 01, which is to be mounted on cylinder 06 is manually suspended, preferably by its leading end suspension leg 03, which is bent at an acute angle at its leading edge 02, for example, from an edge 04 of an opening 08 which leads to a groove 07, which is arranged axially parallel in the forme cylinder 06, and which edge 04 defines the groove opening 08. In the case of an arrangement of multiple mounting positions, each for one printing forme 01, along the periphery of the forme cylinder 06, the forme cylinder 06 correspondingly has multiple grooves 07, that are offset from one another, on the outer periphery of the forme cylinder 06. For example, two such grooves 07 may be arranged offset 180° from one another. Once its leading edge 02 has been suspended at the respective groove opening 08, the respective printing forme 01 is preferably pressed manually onto a guard plate 09, that is structured in the form of a tray, such as, for example, a shaped metal sheet, as indicated in FIG. 29, by a directional arrow for the active force. The respective printing forme 01 flexes along its length, at least corresponding to the length of its suspension leg 13, which is preferably bent at approximately a right angle at its rear edge 12, under the pressure exerted on its side that bears the print image, until this suspension leg 13 at its rear edge 12 rests vertically on the guard plate 09, which is embodied, for example, as a flat surface, under the pressure exerted manually on the side of the respective printing forme 01 that bears the print image.

Figure 41:
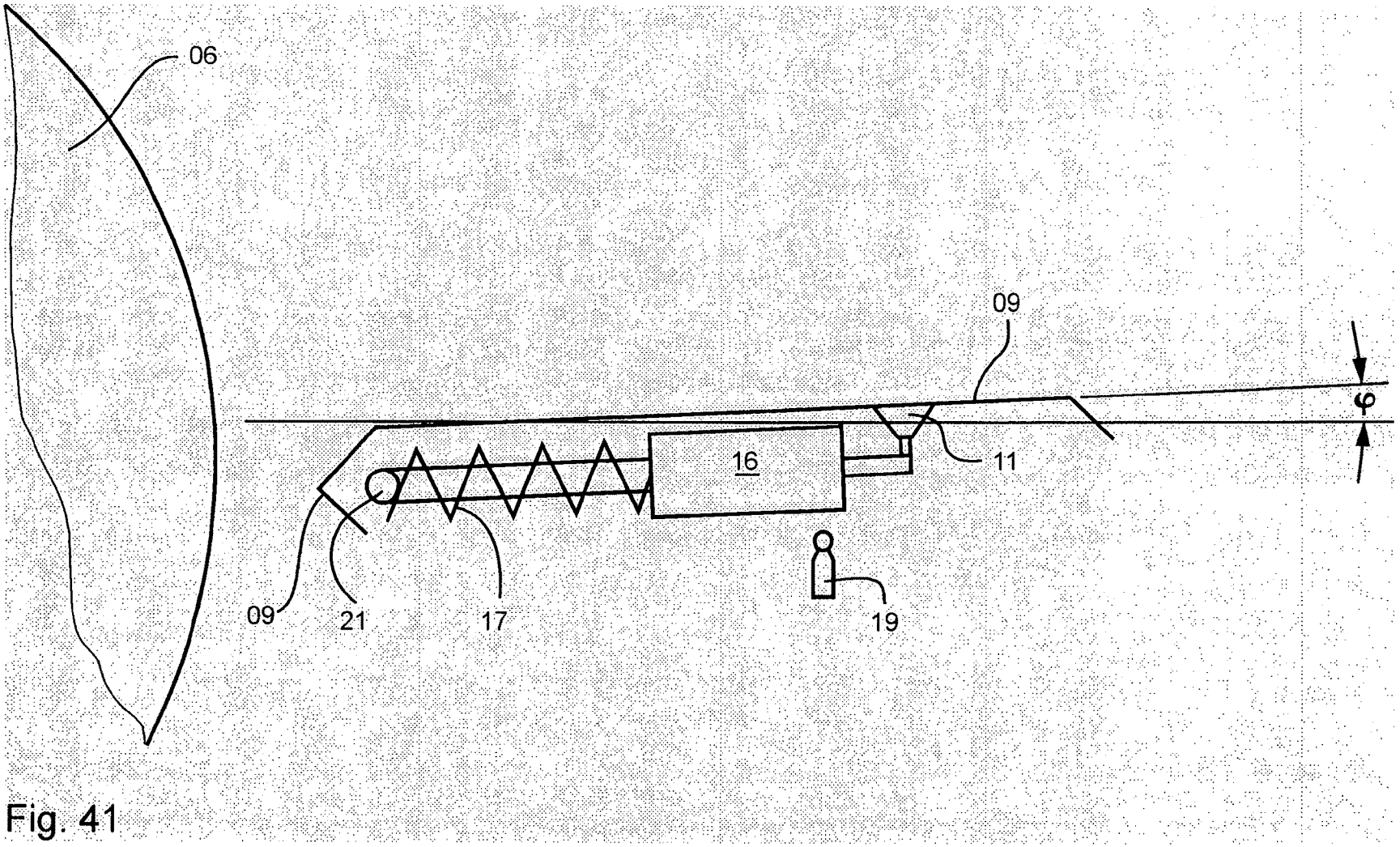
FIGS. 41 to 43 details of the plate holding device.

At least one printing forme holding assembly 11, which is positioned spaced from the forme cylinder 06, is preferably integrated into the guard plate 09. This printing forme holding assembly 11 is embodied as a suction element, for example, having an angular, round or oval cross-sectional surface, for example. The printing plate holding assembly 11 detects the printing forme 01, preferably by using a sensor 19 or switch 19, as shown in FIG. 41, and draws the printing forme 01 in by applying vacuum pressure, for example. The suction, for example, creates a non-positive connection between the respective printing forme 01 and the printing forme holding assembly 11 that is holding it.

The printing plate holding assembly 11 is situated, at least in the flat surface of the guard plate 09, so as to be movable via corresponding joint connections, for example, in order to enable the printing forme 01, which it holds in this flat surface of the guard plate 09, to be aligned. The at least one point of engagement of the at least one printing forme holding assembly 11 is located, for example, in the rear half of the printing forme 01, i.e., the half of the printing forme 01 that is situated farther from the forme cylinder 06, or in the rear one-third of the printing forme 01 to be aligned, and preferably is situated approximately at one-half the width of the printing forme 01 to be aligned. At the point of engagement, the printing forme holding assembly 11 produces a non-positive connection with the printing forme 01 to be aligned, and a connection that will remain secure for the duration of the non-positive connection, free from slip and play. The non-positive connection can preferably be engaged and disengaged via a control device.

Once this non-positive connection has been established, the movement of the printing forme holding assembly 11, which is movably arranged in the flat area of the guard plate 09, causes the printing forme 01 to also move in the flat area of the guard plate 09. The printing forme 01 is displaced in this plane, thus allowing it to be aligned relative to the edge 04 of the opening 08 that leads to the groove 07 which is located in the forme cylinder 06. Once the respective printing forme 01 has been aligned, true to register, on the guard plate 09, the now aligned printing forme 01 is drawn back away from the forme cylinder 06 by the printing forme holding assembly 11. The printing forme 01 is thereby drawn tight or is tensioned lengthwise between its leading edge 02 and the point of engagement of the printing forme holding assembly 11. The leading edge 02 of this printing forme 01 is thus drawn securely and straight along the edge 04 of the opening 08 that leads to the groove 07. The leading edge 02 of this printing forme 01 is then aligned true to register, so that it is parallel to the outline of this edge 04 of the opening 08. As the printing forme 01 is being drawn tight, the printing plate holding assembly 11, which holds the printing forme 01, leaves its original position X and moves to a position Y, which position Y is spaced farther from the forme cylinder 06, as indicated in FIG. 29 by dashed lines. The movement of the printing forme holding assembly 11, from its original position X to its position Y that is farther away from the forme cylinder 06, is executed via a drive 16, such as, for example, by a linear drive 16, the action of which linear drive 16 is indicated by a directional arrow which is extending away from the forme cylinder 06, and parallel to the surface of the guard plate 09. The process of aligning the respective printing forme 01 true to register is preferably performed when the relevant forme cylinder 06 is in the idle mode, or in other words, when it is not in rotation.

Figure 30:
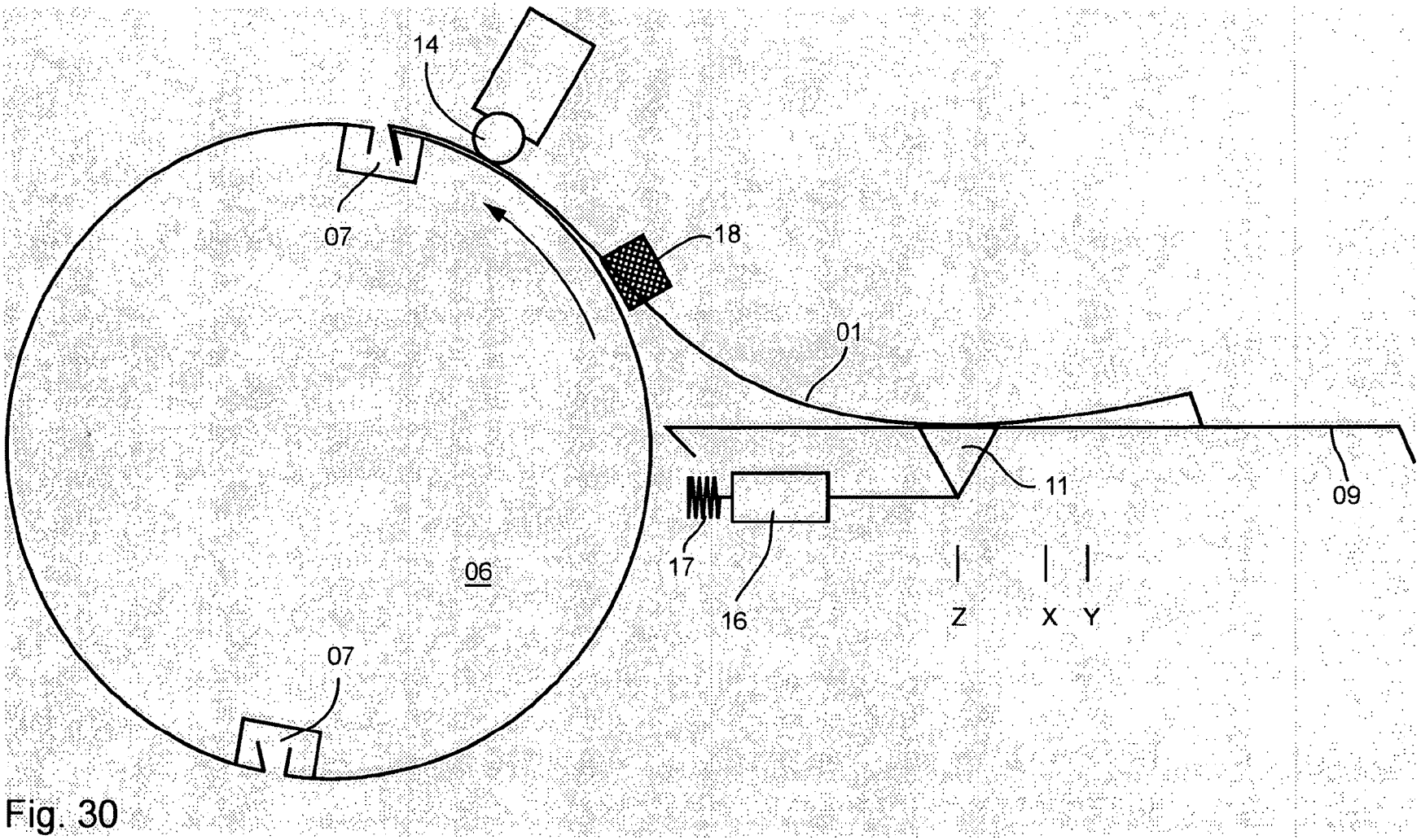
Figure 31:
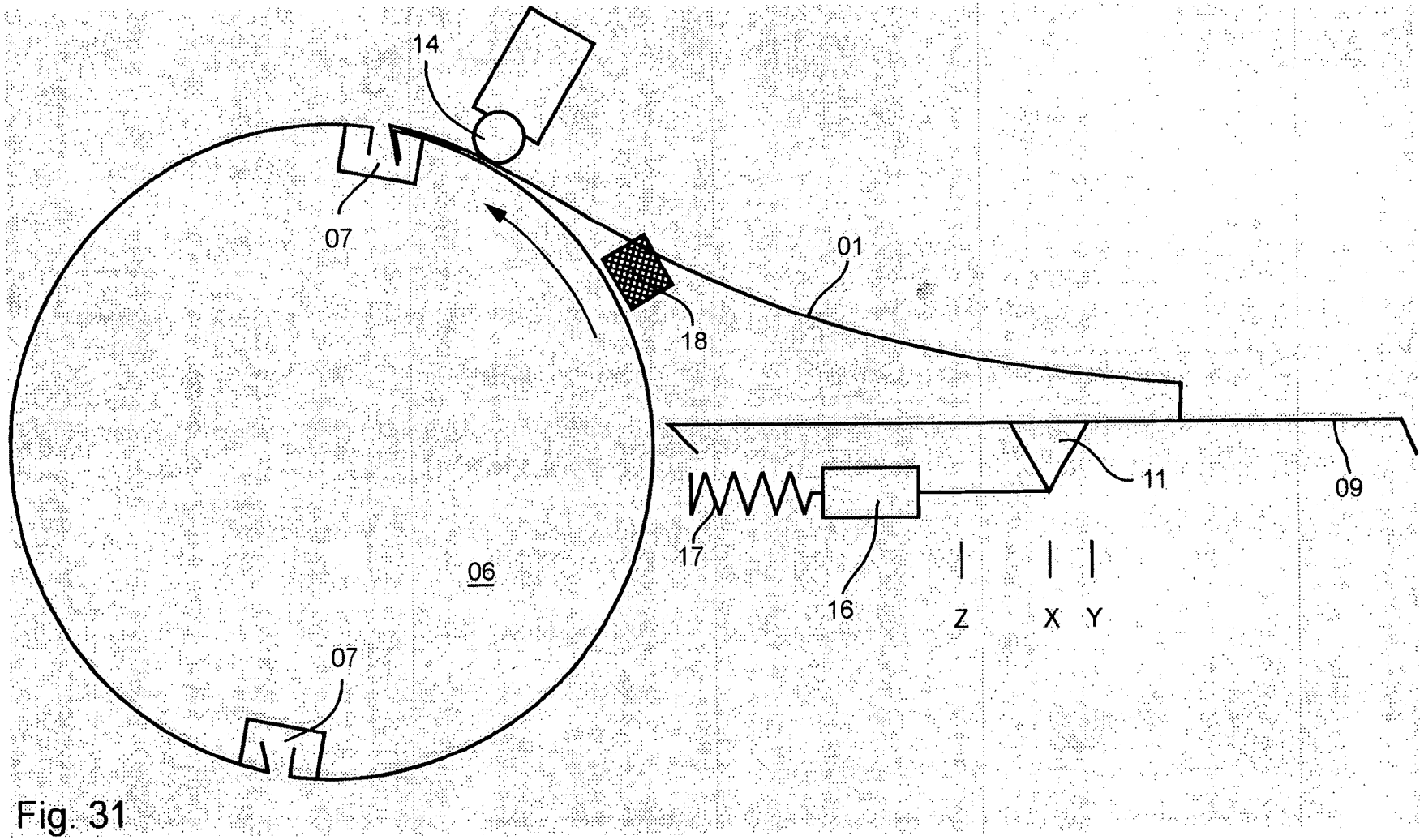
Figure 32:
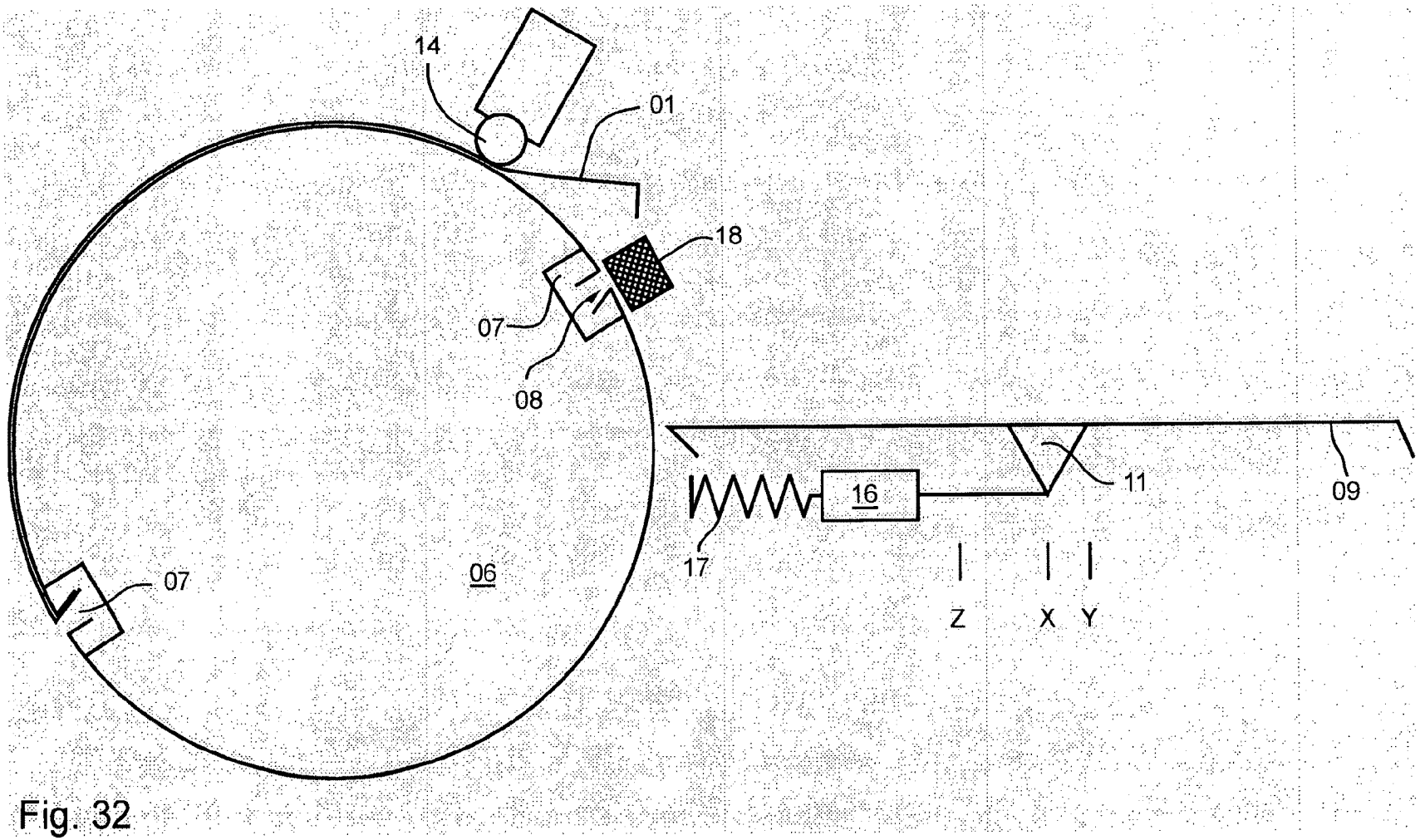
Figure 33:
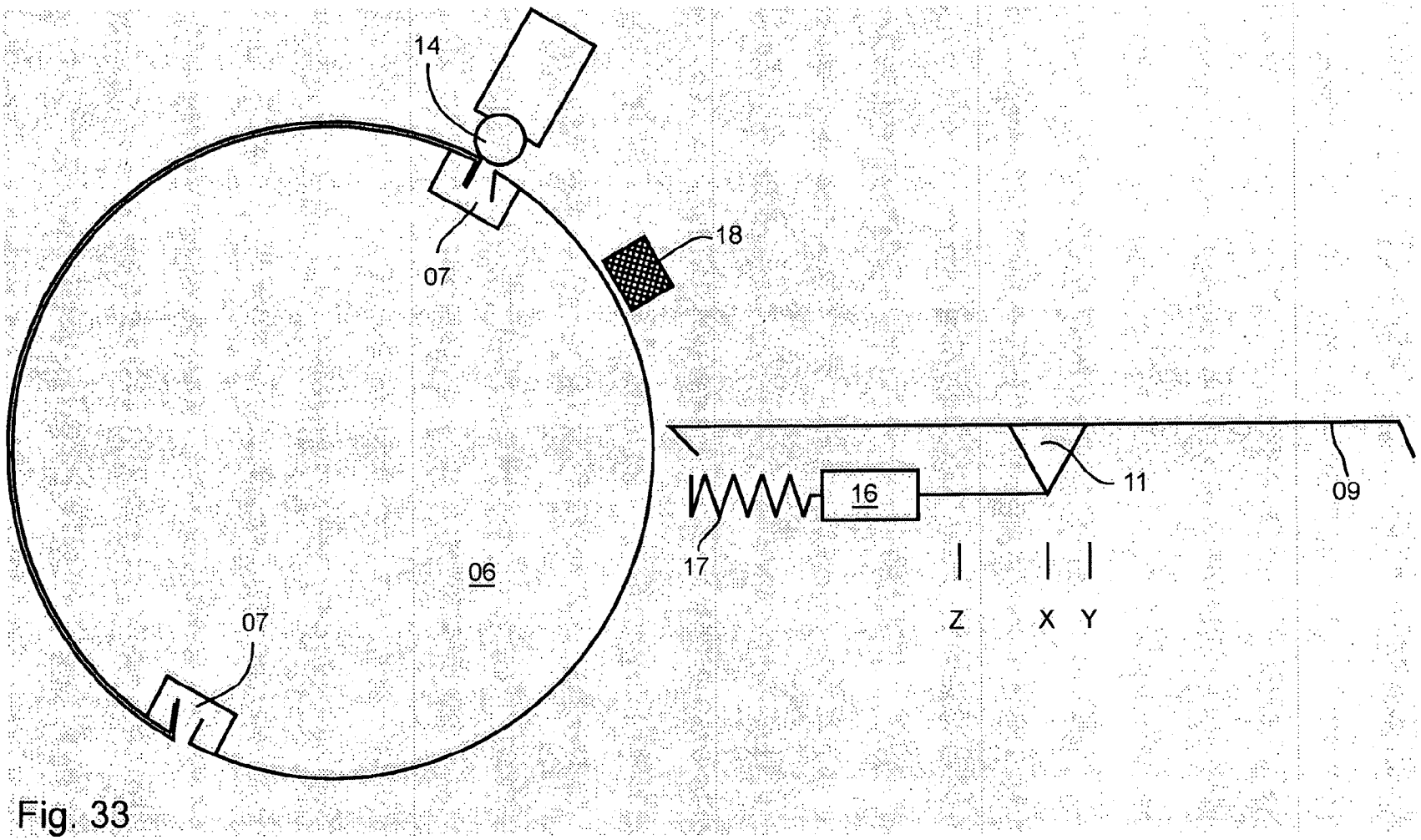
Figure 34:
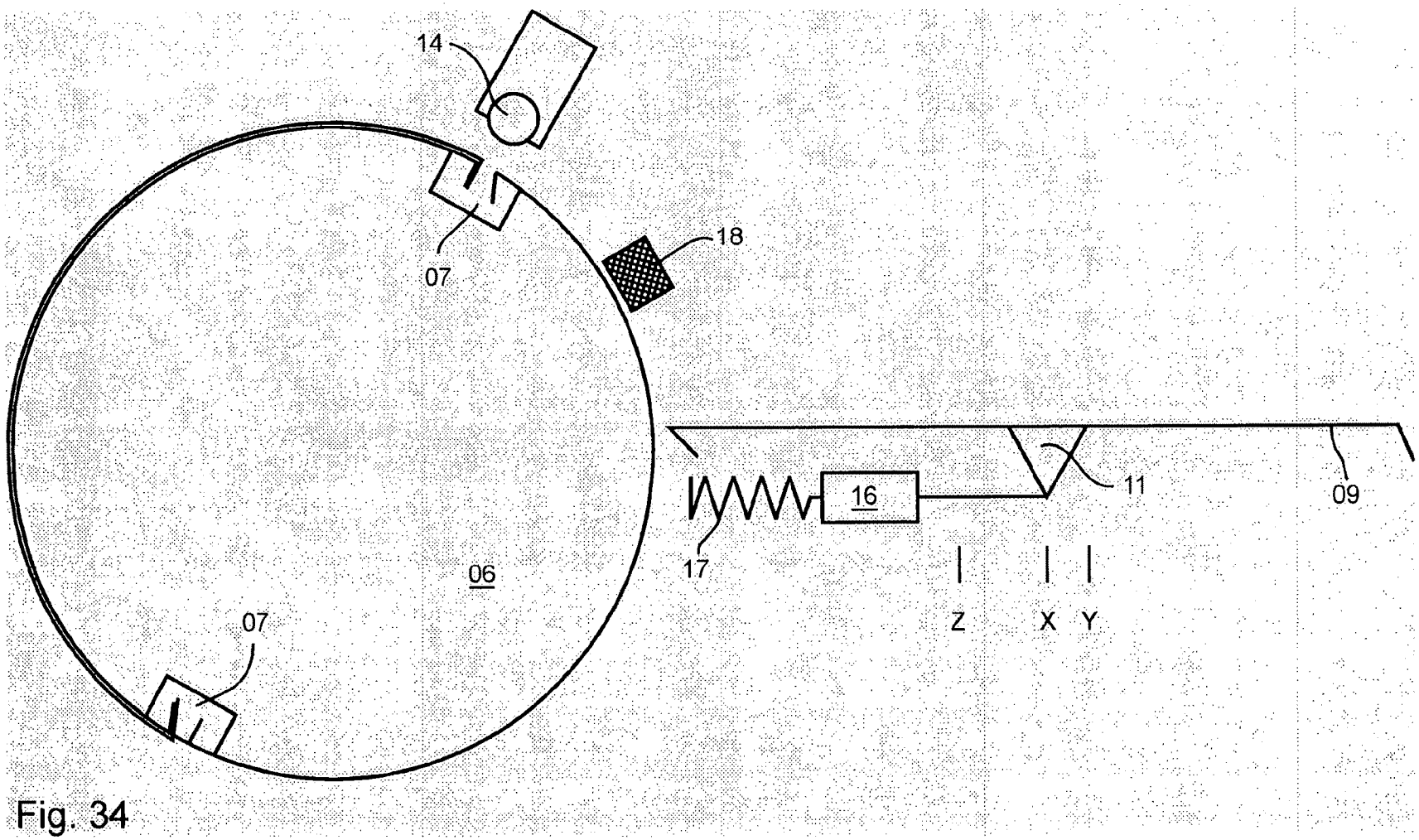

The forme cylinder 06 now begins to rotate in its direction of production, as indicated in FIG. 30 by a rotational directional arrow, in response to being actuated by a drive, which is not specifically shown. This rotational movement of the forme cylinder 06 begins to draw the printing forme 01, which is suspended at the edge 04 of the opening 08 that leads to the groove 07, onto its circumferential surface. The forme cylinder 06 first draws the leading edge 02 of the printing forme 01 under a pressure element 14, which is positioned stationary relative to the forme cylinder 06, and which is engaged against the circumferential surface of the forme cylinder 06, as shown schematically in FIG. 30. This pressure element 14, which is provided as a mounting aid, can be configured as a pressure roller 14, for example. In the case of the mounting of multiple printing formes 01, arranged side by side in the axial direction of the forme cylinder 06 the pressure roller strip can be embodied with the individual pressure elements 14 of this pressure roller strip which can preferably be engaged against or disengaged from the circumferential surface of the forme cylinder 06 individually and independently of the other pressure elements 14. As the respective printing forme 01 is pressed, by the at least one pressure element 14 that is assigned to it, against the circumferential surface of the forme cylinder 06, it continues to be held by the printing forme holding assembly 11 that is holding it. This forms a tensile force that acts away from the forme cylinder 06, for a certain period of time and/or along a certain path to be traversed by the printing forme 01. The printing forme holding assembly 11 holding the printing forme 01 is drawn by the rotational movement of the forme cylinder 06 from its position Y to its position X. Each of the printing formes 01 is urged against the forme cylinder by the pressure elements 14 which are assigned to the individual printing formes 01. These individual pressure elements 14 can be configured as a pressure roller strip. Individual pressure elements 14 of this pressure roller strip can preferably be engaged against or disengaged from the circumferential surface of the forme cylinder 06, individually and independently of the other pressure elements 14. As the respective printing forme 01 is pressed by the at least one pressure element 14 assigned to it against the circumferential surface of the forme cylinder 06, it continues to be held by the printing forme holding assembly 11 holding it, thus forming a tensile force that acts away from the forme cylinder 06, for a certain period of time and/or along a certain path to be traversed by the printing forme 01. The printing forme holding assembly 11, which is holding the printing forme 01, is moved by the rotational movement of the forme cylinder 06 from its position Y that is distant from the forme cylinder 06, beyond its original position X, to a position Z, which is closer to the forme cylinder 06. The printing forme holding assembly 11, which is holding the printing forme 01, therefore has at least three positions namely, in addition to its original position X, it also has the diametrically opposite positions Y and Z, each of which defines a limit of movement of the printing forme holding assembly 11. To maintain the tensile force which holds the printing forme 01 in a taut position, the printing forme holding assembly 11, which is holding the printing forme 01, can be moved against the force of a spring element 17, which is connected to the linear drive 16, for example.

The pressure elements 14, that are allocated to the individual printing formes 01, preferably take over and accomplish the securing of the respective printing formes 01, true to register, at the latest by the expiration of the set period of time during which the tensile force for tightening the printing forme 01 is to be maintained and/or once the printing forme 01 has traversed the distance which is established for this purpose. The printing forme holding assembly 11, which has been holding the respective printing forme 01, can be released from the respective printing forme 01. The non-positive connection between the printing forme 01 to be aligned and the respective printing forme holding assembly 11 is thus terminated. The active force, which was provided to the printing forme holding assembly 11 is eliminated, for example by switching off the suction force. The printing forme holding assembly 11, which has been holding the respective printing forme 01, then moves back to its respective original position X. The spring element 17, which was previously compressed during the mounting of the printing forme 01, can also be released again. However, as long as the printing forme holding device 11, which is holding the respective printing forme 01, continues to hold the respective printing forme 01, the position of the respective point of engagement of the at least one printing forme holding assembly 11 remains unchanged on the printing forme 01, as depicted schematically in FIG. 31.

The forme cylinder 06 then rotates to the position in which at least one command for a separate selection of a plate end holding device, which is assigned to the individual printing formes 01 and which is positioned in the groove 07 of the relevant forme cylinder 06, can be transmitted to a device 18, which receives and/or transmits this command in a contactless fashion. This forme cylinder position is determined, for example, when the opening 08 which leads to the groove 07 is located radially below this device 18. The device 18 is preferably situated in direct spatial proximity to the outer surface of the forme cylinder 06. With the corresponding command transfer, the plate end holding device, which is assigned to the respective printing forme 01 and which is situated in the groove 07, opens. The plate end holding device changes from a holding position to a released position, so that the trailing end suspension leg 13, which is bent at the rear edge 12 of the respective printing forme 01, can be inserted unimpeded into the opening 08 that leads to the groove 07 and can then be secured in the groove 07 by the plate end holding device that is located there, for example via clamping. Other printing formes 01 that are already positioned on the circumferential surface of the forme cylinder 06 remain secured on the circumferential surface of the forme cylinder 06. In each case, their plate end holding devices, which are situated in the groove 07, do not change from a holding position to a released position. With the control device 18, which receives and/or which transmits commands in a contactless manner, the respective plate end holding device, which is situated in the groove 07, can be individually selected and correspondingly actuated, as may be seen in FIG. 32.

Once the rear or trailing end suspension leg 13, that is bent at the rear edge 12 of the respective printing forme 01, has reached the opening 08 which leads to the groove 07, as a result of the continued rotational movement of the forme cylinder 06, this suspension leg 13 is pressed into the opening 08 which leads to the groove 07 by the pressure element 14, which is engaged against the circumferential surface of the forme cylinder 06. The plate end holding device, that is situated in the groove 07 and which is assigned to the respective printing forme 01, then moves from its released position back to its holding position, so that the rear or trailing end suspension leg 13 that is bent at the rear edge 12 of the respective printing forme 01 is secured in the groove 07 as may be seen in FIG. 33.

Once the rear or trailing end suspension leg 13, which is bent at the rear edge 12 of the respective printing forme 01, is secured in the groove 07, the respective pressure element 14 can be disengaged from the circumferential surface of the forme cylinder 06. This is depicted schematically in FIG. 34.

Figure 35:
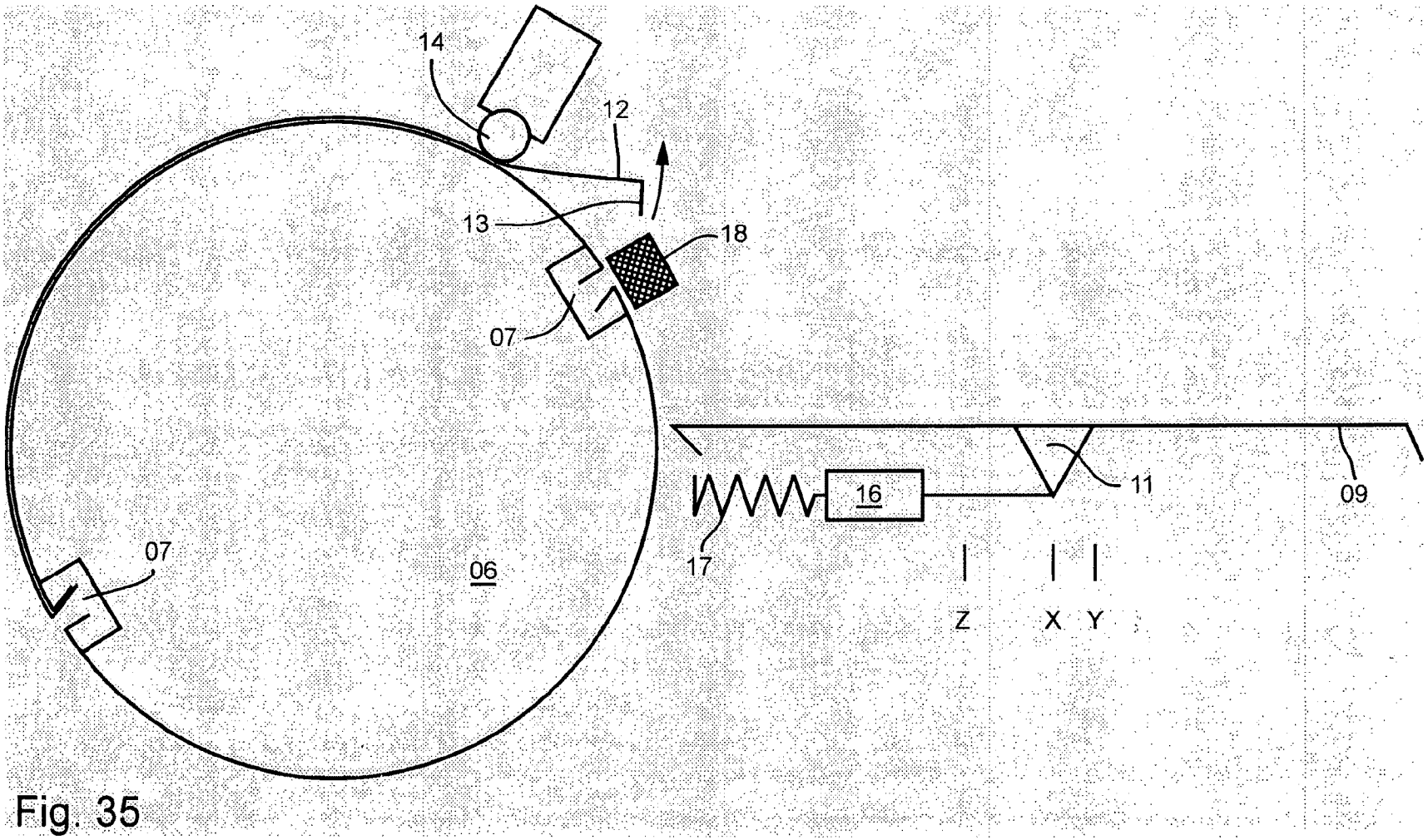
FIGS. 35 to 38 process steps undertaken during the removal of a printing forme from a forme cylinder.

Removal of at Least One Printing Forme:

The forme cylinder 06 rotates up to the position at which at least one command for a separate selection of the plate end holding device, which is situated in the groove 07 of the relevant forme cylinder 06 and which is assigned to the individual printing formes 01, can be transmitted to the control device 18 which receives and/or transmits this command in a contactless manner. The pressure element 14 which is assigned to the printing forme 01 that is to be removed, is engaged against the circumferential surface of the forme cylinder 06. The plate end holding device selected by the device 18, which plate end holding device is situated in the groove 07 and is assigned to the respective printing forme 01, moves from its holding position to its released position. The rear or trailing plate end suspension leg 13, which is bent at the rear edge 12 of the respective printing forme 01, pops out of the opening 08 that leads to the groove 07 by virtue of the bending elasticity of the printing forme 01, as is indicated in FIG. 35 by an arrow.

Figure 36:
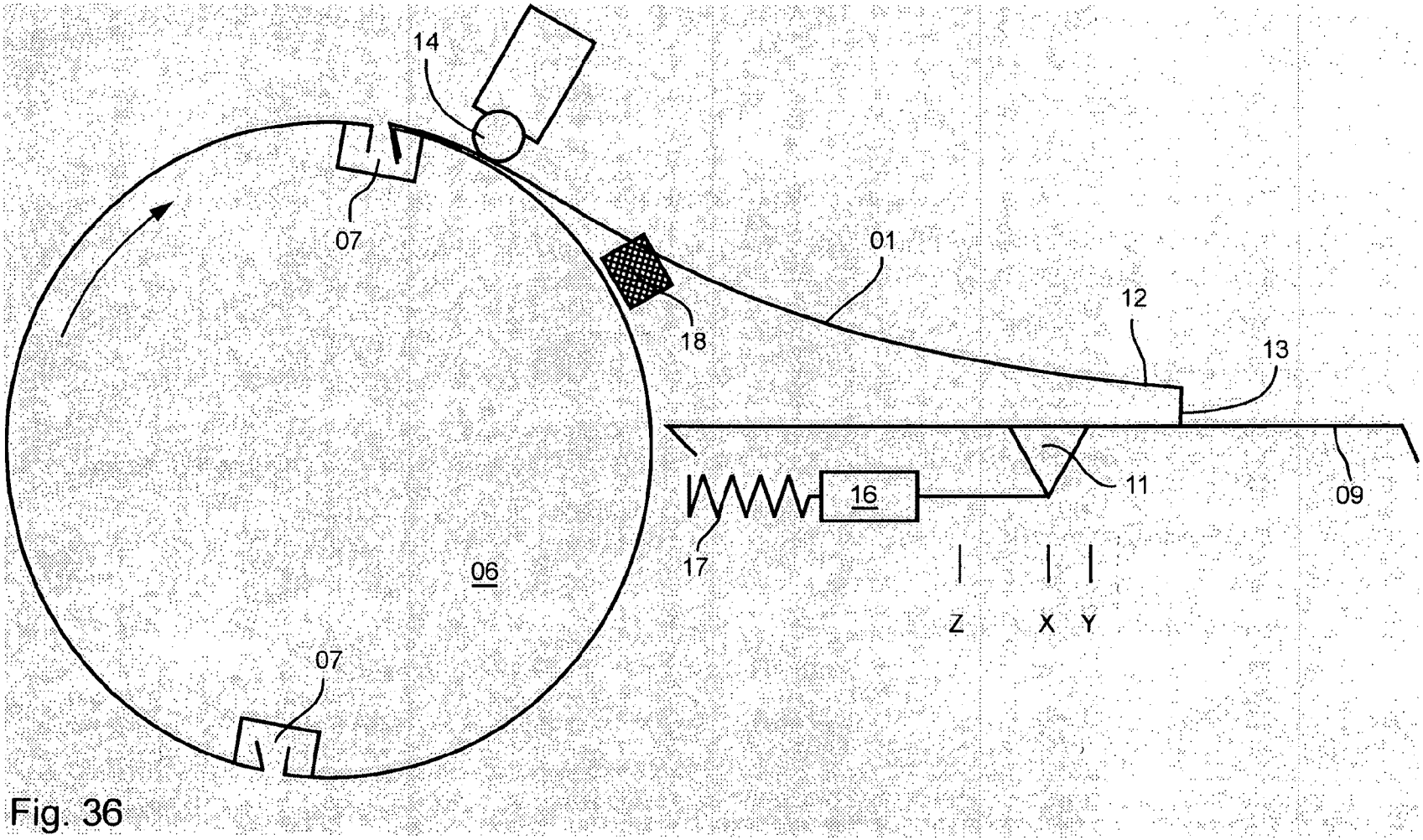

The forme cylinder 06 now rotates counter to its direction of production to a removal position, as may be seen in FIG. 36, in which removal position, rotation of the forme cylinder 06 pushes the rear edge 12 of the respective printing forme 01 onto the surface of the guard plate 09. The rear or trailing plate end suspension leg 13, which is bent at the rear edge 12 of this printing forme 01, can rest vertically on the surface of the guard plate 09, as is also depicted in FIG. 36.

Figure 37:
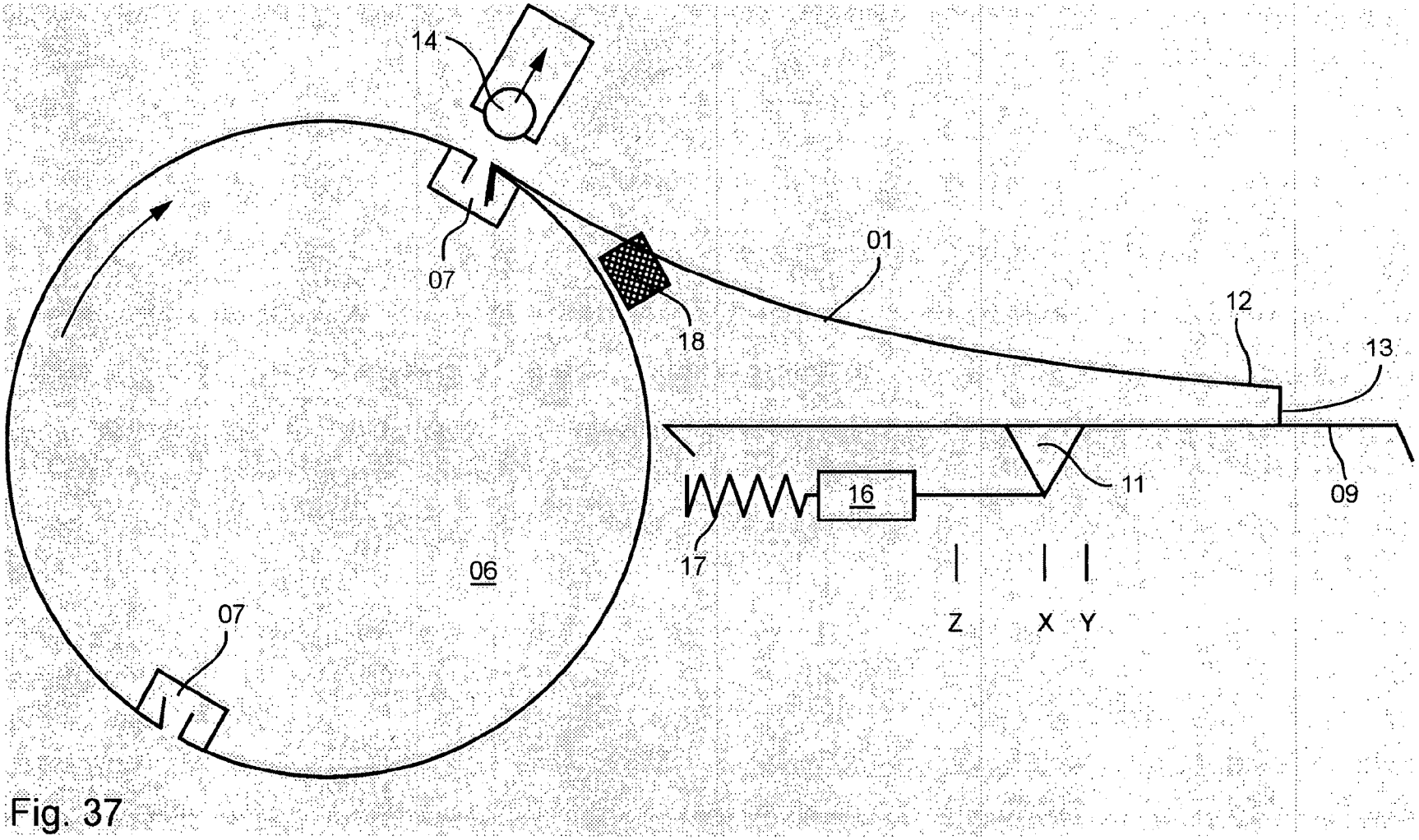

The pressure element 14, that is assigned to the particular printing forme 01 which is to be removed, is disengaged from the circumferential surface of the forme cylinder 06, for example once that particular pressure element 14, and the opening 08 that leads to the groove 07, on which the leading edge 02 of the printing forme 01 to be removed is held, are located radially opposite one another as a result of the rotation of the forme cylinder 06. The disengagement of the pressure element 14 is indicated in FIG. 37 by a directional arrow.

Figure 38:
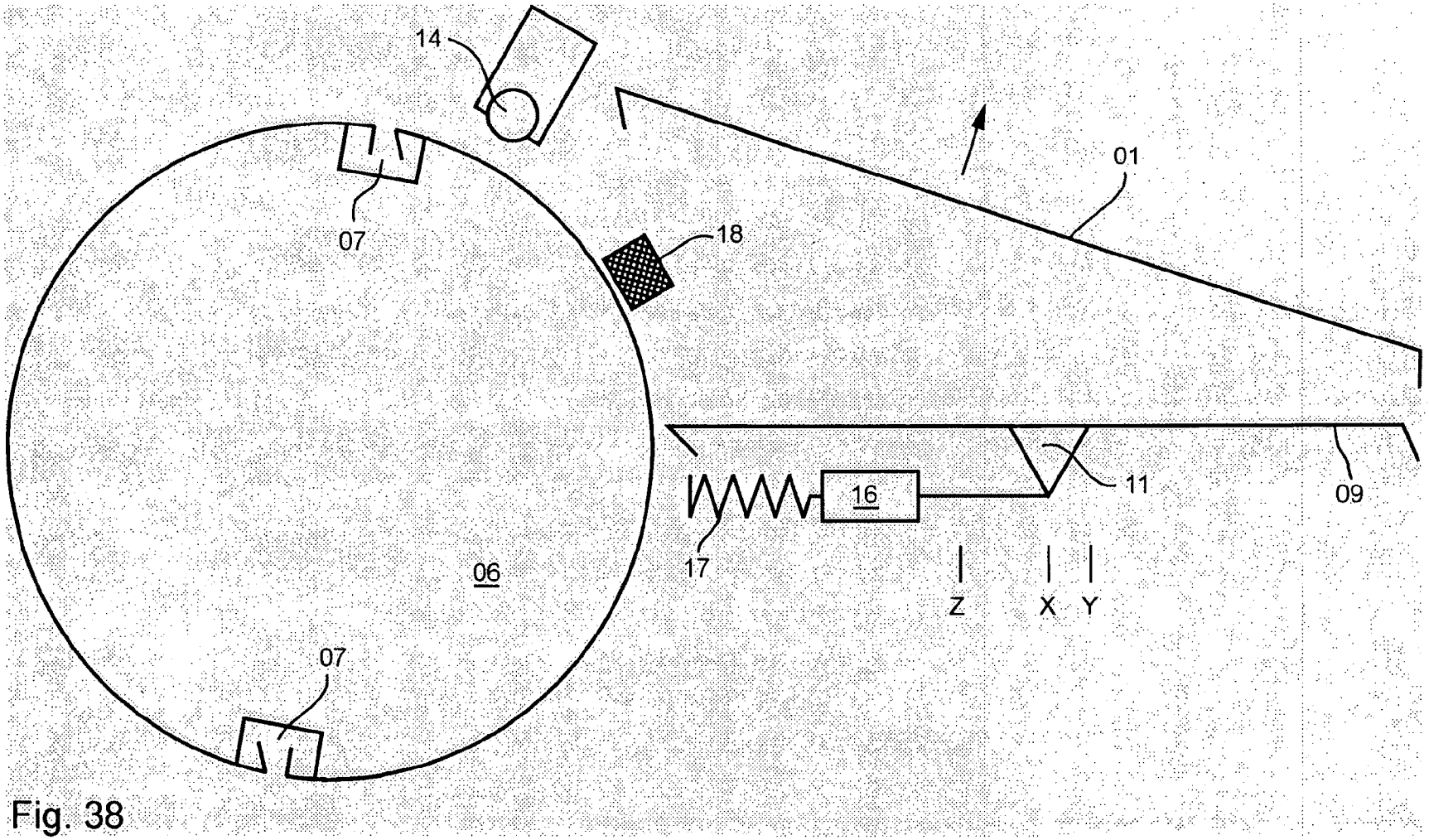

FIG. 38 shows a manual removal of the printing forme 01 from the forme cylinder 06 and from the surface of the guard plate 09, as indicated by a removal arrow, by way of example.

Figure 39:
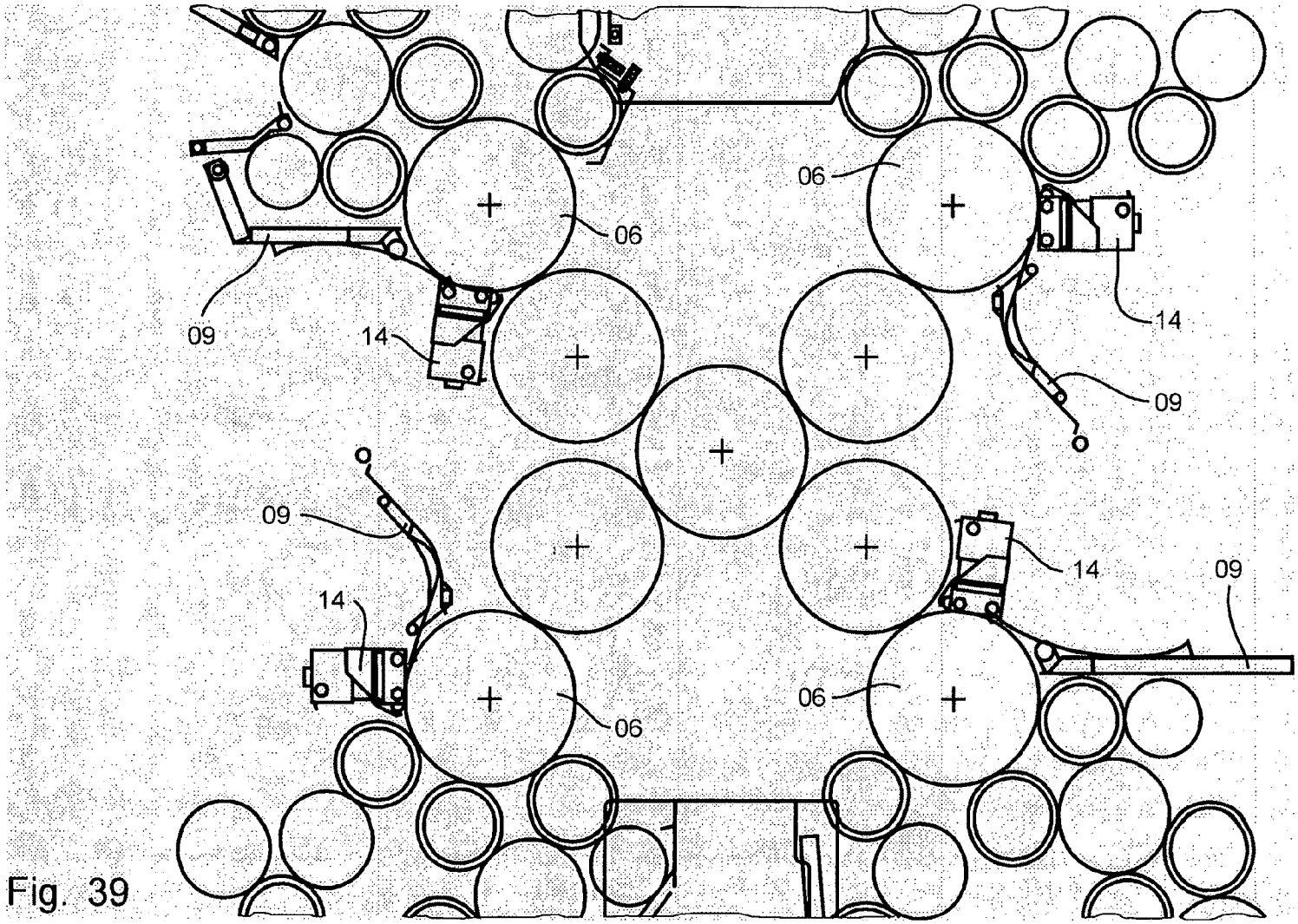
FIG. 39 a schematic depiction of arrangements of the plate holding device in a 9-satellite printing unit with double-circumference forme cylinders.

FIG. 39 shows a section of a 9-satellite printing unit, by way of example. In each printing couple, the device for use in mounting at least one flexible printing forme 01, true to register, on one of the forme cylinders 06 of this rotary printing press is positioned differently. In contrast to the configuration of this mounting device, as has been discussed and depicted in accordance with the FIGS. 29 through 38, the guard plates 09 in the 9-satellite printing unit, which is shown in FIG. 39, are at least partially engaged tangentially against the respective forme cylinder 06 in each of the four depicted printing couples.

Figure 40:
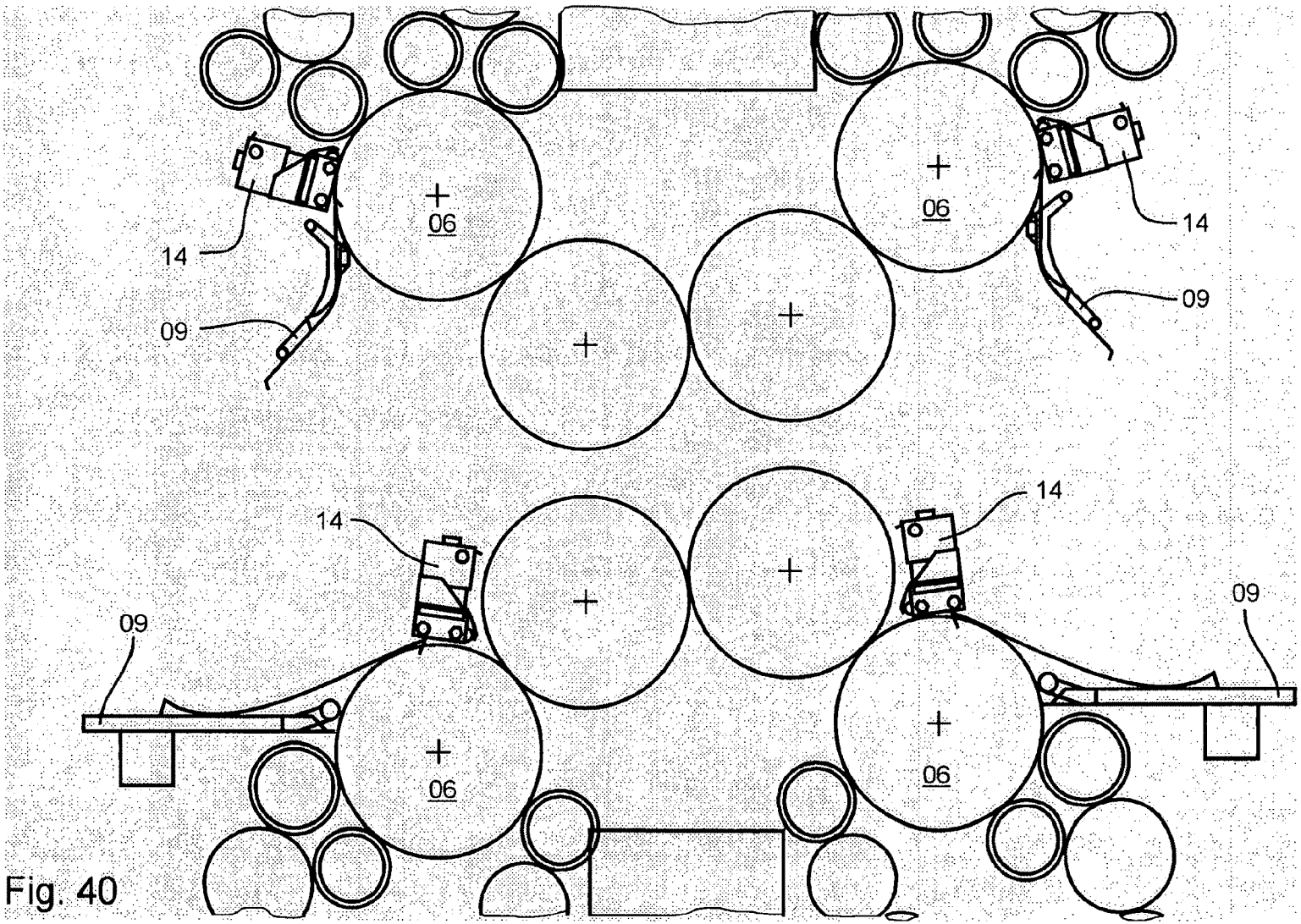
FIG. 40 a schematic depiction of arrangements of the plate holding device in an H printing unit.

FIG. 40 shows, by way of example, a section of an H printing unit. The device for mounting at least one flexible printing forme 01, true to register, on one of the forme cylinders 06 of this rotary printing press is positioned, on the upper printing couples, differently from its positioning on the lower printing couples. In the lower printing couples, the respective guard plates 09 are engaged substantially radially against the respective allocated forme cylinders 06. In the upper printing couples, the respective guard plates 09 are engaged substantially tangentially against the respectively assigned forme cylinders 06.

FIG. 41 shows an enlarged view of the printing forme holding assembly 11 which holds a printing forme 01 to be aligned, in accordance with FIGS. 29 through 40, in an unactuated position. The printing forme holding assembly 11 is located in its original position X, in which position the surface of the guard plate 09 can be spaced from its position when the holding device is actuated by an angle of rotation $\phi$. The printing forme holding assembly 11 is capable of pivoting around the angle of rotation $\phi$ around a preferably stationary point of rotation 21. The angle of rotation $\phi$ measures less than 15°, for example, preferably measures less than 10°, and especially measures less than 5°. In the unactuated position, the linear drive 16 which moves the printing forme holding assembly 11, for example, is positioned spaced from a switch 19, such as, for example, an electromechanical switch, that belongs to the holding device. Instead of a switch 19, a sensor 19, which preferably detects the respective printing forme 01 in a contactless manner, can also be provided. At least the printing forme holding assembly 11, its drive 16, the spring element 17, the sensor 19 or switch 19, and the surface of the guard plate 09 comprise parts of the holding device. In the case of multiple mounting positions, each of which is intended for one printing forme 01, and which multiple mounting positions are arranged side by side in the axial direction of the forme cylinder 06, one holding device of this type is provided for each of these printing formes 01. These holding devices can be employed together or individually and independently of one another.

Figure 42:
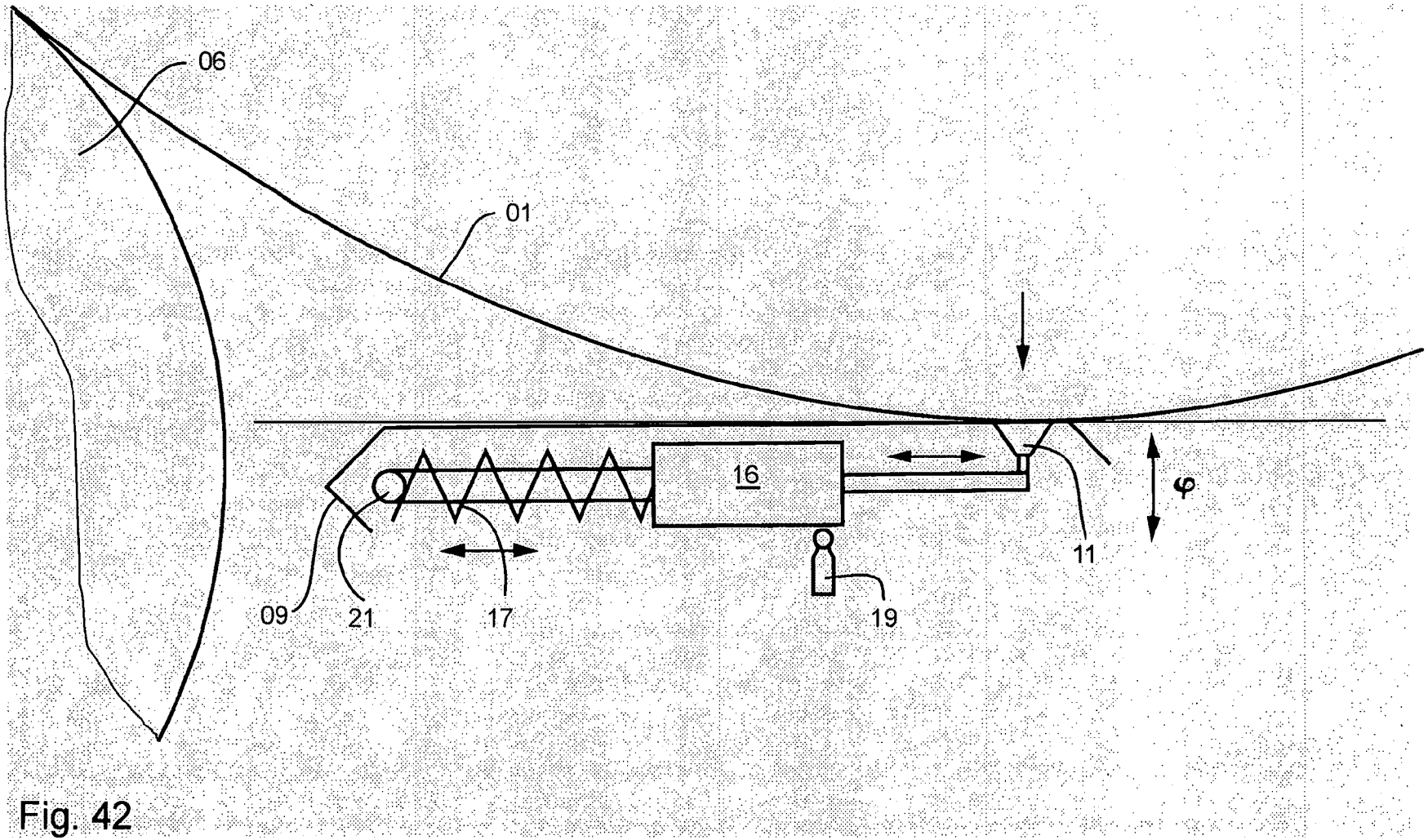

FIG. 42 shows an enlarged view of the printing forme holding assembly 11 which holds a printing forme 01 to be aligned, in accordance with FIGS. 29 through 40, in the position in which the printing forme 01 to be mounted is already aligned true to register and has been retracted to a position Y, which is farther away from the forme cylinder 06. The printing forme holding assembly 11 is pivoted around the point of rotation 21 by the angle of rotation $\phi$. This pivoting movement is executed as a result of the pressure which is exerted manually on the side of the respective printing forme 01 that bears the print image, as is indicated in FIG. 42 by an arrow. This pressure brings the reverse side of the printing forme 01 into direct contact with the printing forme holding assembly 11 of the holding device. At the same time, the pivoted printing forme holding assembly 11 also actuates the switch 19 that is assigned to it, which switch actuation is interpreted by a control device, which is a part of the holding device and which is preferably electronic, as the presence of a printing forme 01, which is to be mounted, on the surface of the guard plate 09. Once the switch 19 has been actuated and the printing forme holding assembly 11 has aligned the printing forme 01, which has been suspended at its leading edge 02 from the forme cylinder 06, true to register, the linear drive 16, which may be, for example, a pneumatic cylinder, and which moves the holding means 11, is actuated. This actuation is accomplished, preferably remotely, by the electronic control device, as indicated in FIG. 42 by a double arrow. The movement of the printing forme holding assembly 11 to a position Y that is farther away from the forme cylinder 06 causes the printing forme 01, which is suspended on the forme cylinder 06 to be tightened. The holding device has a preferably prestressed spring element 17, such as, for example, a compression spring 17, which is released when the printing forme holding assembly 11 is moved to the position Y that is farther away from the forme cylinder 06. However, a spring path of compression spring 17 is longer than the adjustment path of the linear drive 16 which moves the printing forme holding assembly 11. The spring path of the spring element 17 is also indicated by an arrow in FIG. 42. The adjustment path of the linear drive 16 which moves the printing forme holding assembly 11 measures between 250 mm and 500 mm, for example, and preferably measures between 300 mm and 400 mm.

Figure 43:
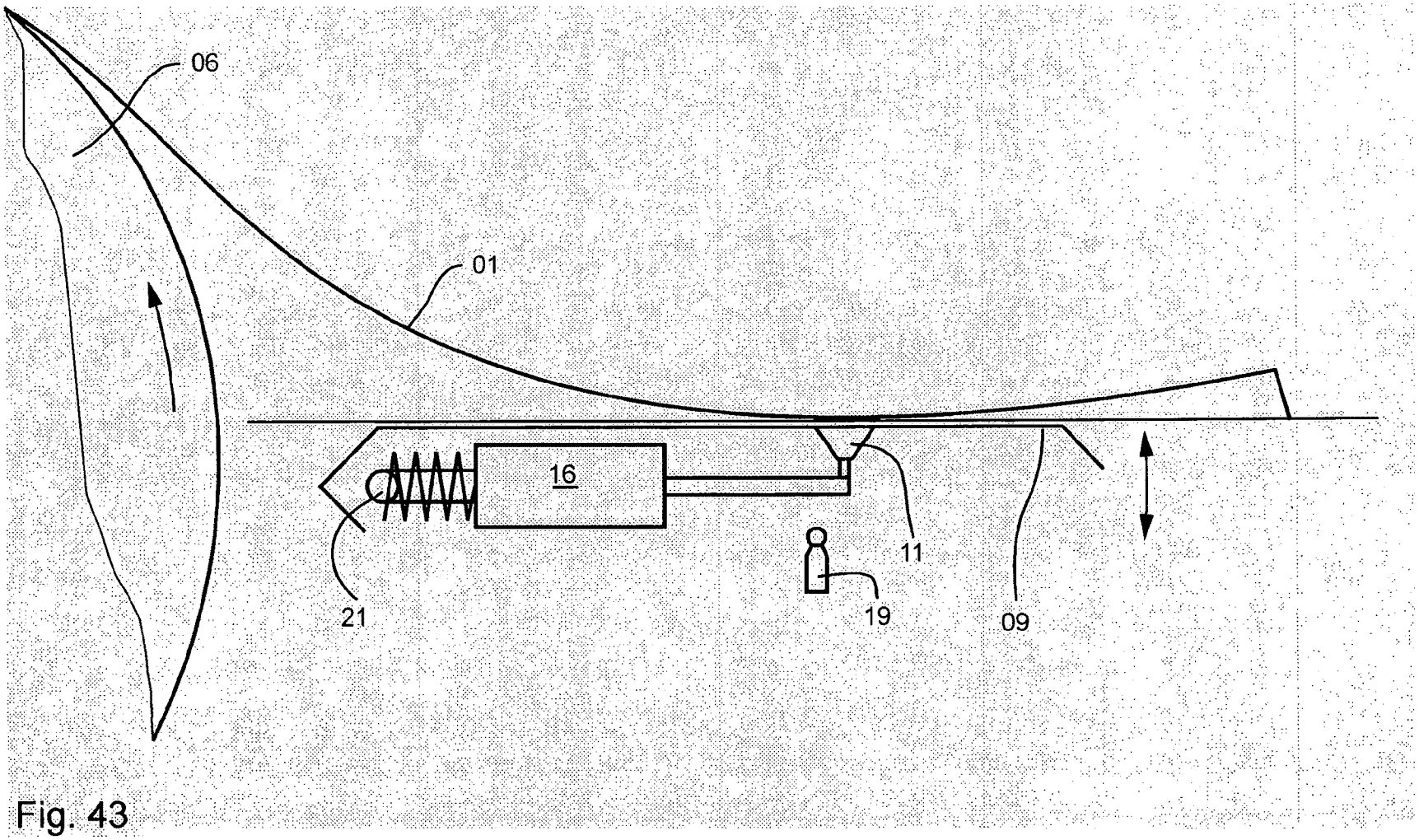

FIG. 43 shows an enlarged view of the holding device which holds a printing forme 01 to be aligned, in accordance with FIGS. 29 through 40, in the position in which the printing forme 01 to be mounted is being drawn onto the forme cylinder 06 as a result of the cylinder's rotational movement counter to the force of the spring element 17, which holds the printing forme 01 taut. In this case, the spring element 17 is compressed along its spring path until the printing forme holding assembly 11 has reached its position Z near the forme cylinder 06.

Figure 44:
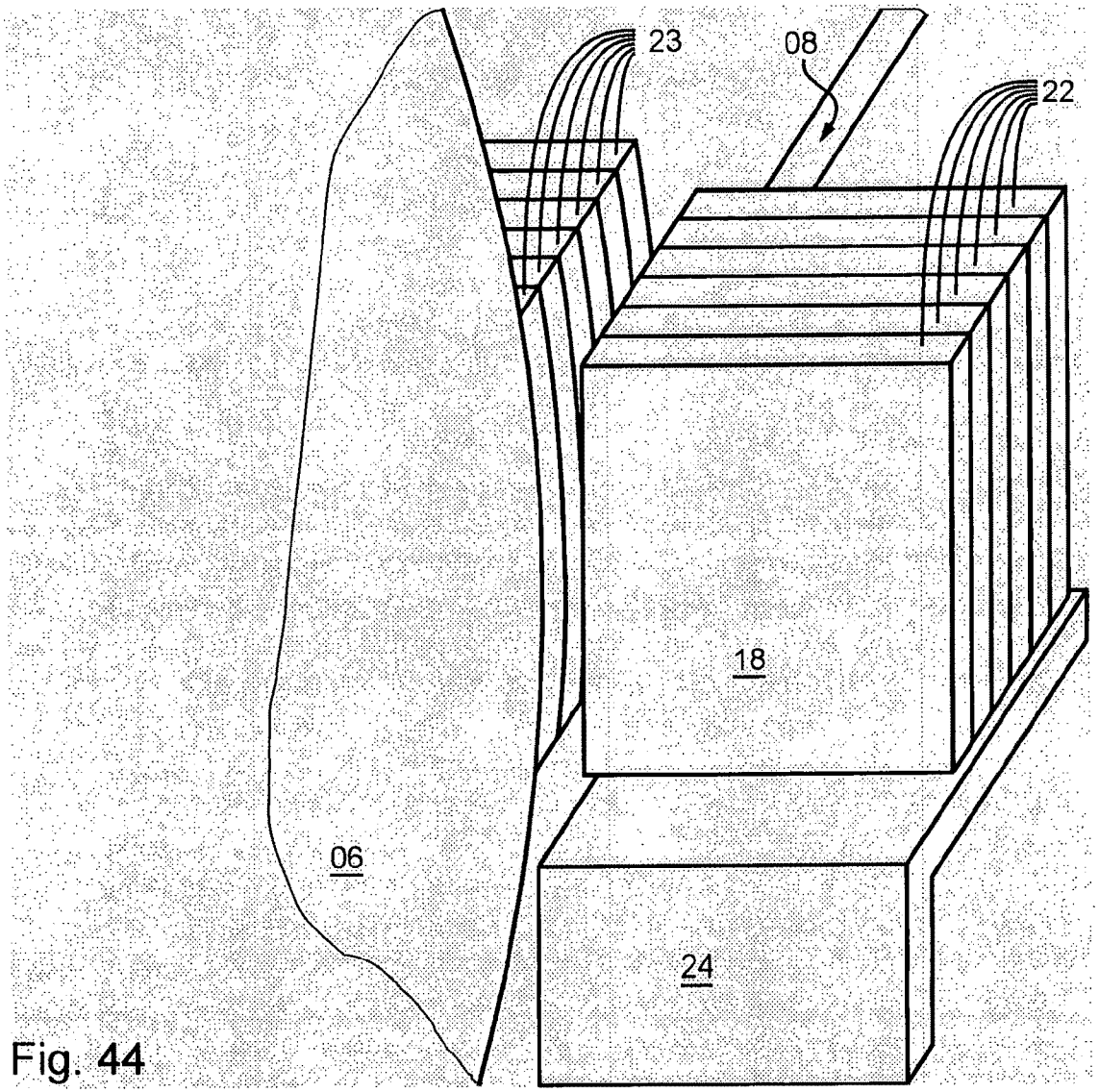
FIG. 44 a device which receives and/or transmits a command in a contactless fashion.

FIG. 44 shows a schematic, sectional representation of the control device 18, which receives and/or which transmits commands in a contactless manner, and with which plate end holding devices, that are situated in the groove 07 of the forme cylinder 06 and which are assigned to the individual mounting positions on the circumferential surface of the forme cylinder 06, can be selected and actuated. This control device 18 can have a plurality of transmitting and receiving units 22 mounted, for example, on a support 24, arranged side by side in the axial direction of the forme cylinder 06 and operating independently of one another. For each such transmitting and receiving unit 22, a corresponding counter unit is arranged on the forme cylinder 06 typically as corresponding transmitting and receiving units 23. The transmitting and receiving units 23, which are situated on the forme cylinder 06, are also arranged side by side, for example, in the axial direction of the forme cylinder 06. The transmitting and receiving units 23 on the forme cylinder 06 are situated, for example, in or on the groove 07 of that forme cylinder 06 and enter into an active connection with the transmitting and receiving units 22 that are situated, preferably stationarily, outside of the forme cylinder 06, through the opening 08 in the groove 07, for example, via a preferably mutual transmission of adjustment commands. The transmitting and receiving units 22, which are located outside of the forme cylinder 06, transmit an adjustment command, such as, for example, one initiated by a specific plate end holding device situated in the groove 07 of the forme cylinder 06, for example selected by an addressing process, to move from its holding position to its released position. The transmitting and receiving units 23 on the forme cylinder 06 can display the current position of a specific plate end holding device, which is situated in the groove of the forme cylinder 06, to show whether it is in its holding position or in its released position. This current position can be displayed on a control device which is situated outside of the forme cylinder 06, and can be displayed especially at the control station that is assigned to the printing press, in the form of a status message. The respective commands are preferably transmitted when the transmitting and receiving units 22, which are located outside of the forme cylinder 06, and the transmitting and receiving units 23, which are located on the forme cylinder 06, are positioned radially opposite one another as a result of a corresponding rotation of the forme cylinder 06. The transmitting and receiving units 22, which are located outside of the forme cylinder 06, can be embodied as separately selectable and activatable magnets, for example. The transmitting and receiving units 23, which are located on the forme cylinder 06, can be embodied as solenoid valves, for example, which solenoid valves can be controlled using the aforementioned magnets.

Figure 45:
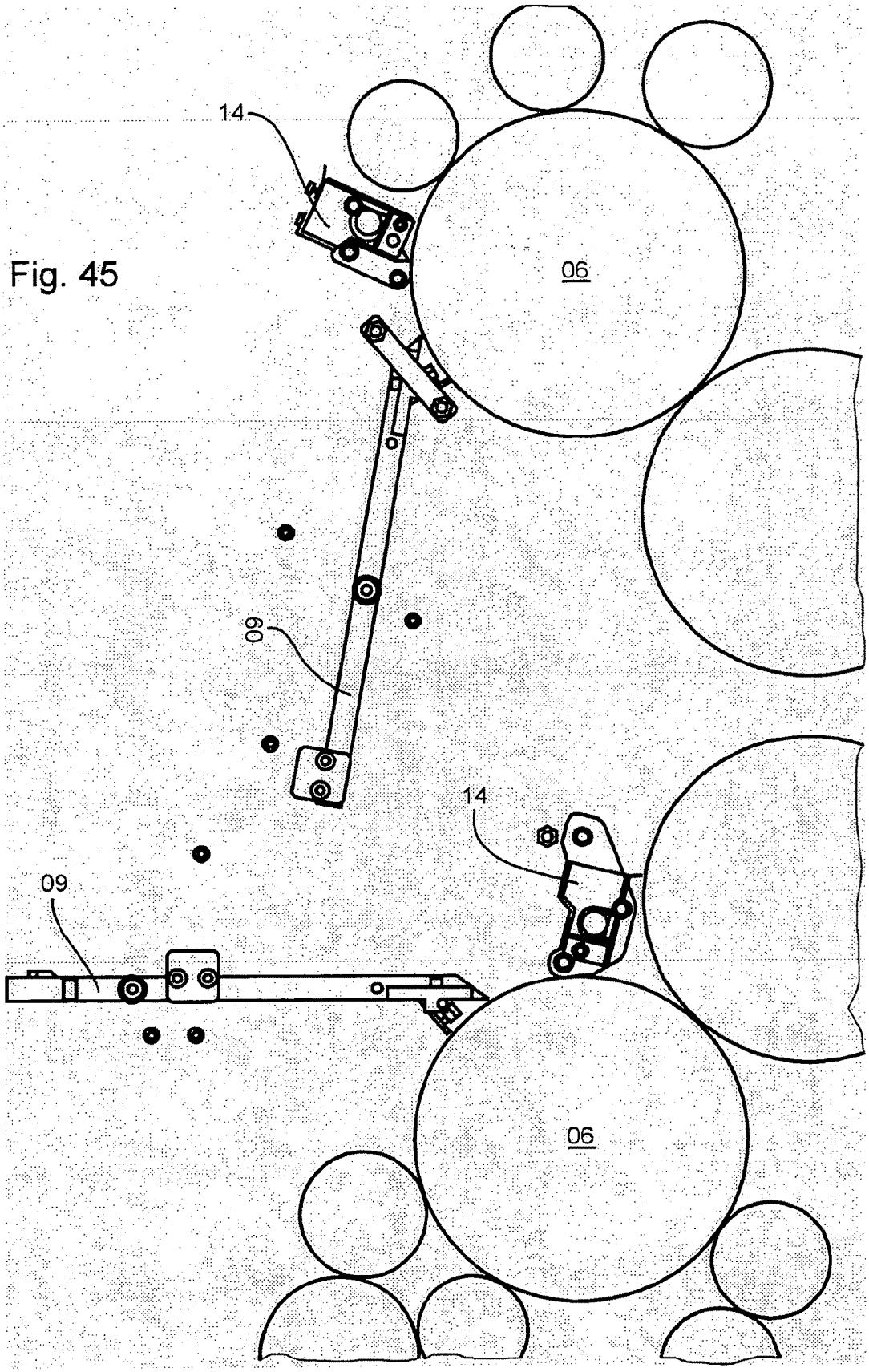
FIG. 45 a section of a printing unit with the respective plate holding device positioned rectilinearly, tangentially in relation to the forme cylinder.

FIG. 45 shows a section of a printing unit which is embodied as an H printing unit or as a satellite printing unit. A guard plate 09 for the relevant holding device is engaged rectilinearly, tangentially in relation to the respective forme cylinder 06. A printing forme 01, which is placed on the respective guard plate 09, and which is to be fed to the respective forme cylinder 06, is curved only within the scope of the length of the suspension leg 13 at the rear end 12 of that printing forme 01, in order to bring the reverse side of the printing forme 01 into direct contact with the printing forme holding assembly 11 of the respective holding device, i.e., in order to draw the printing forme 01 in via suction, for example.

Figure 46:
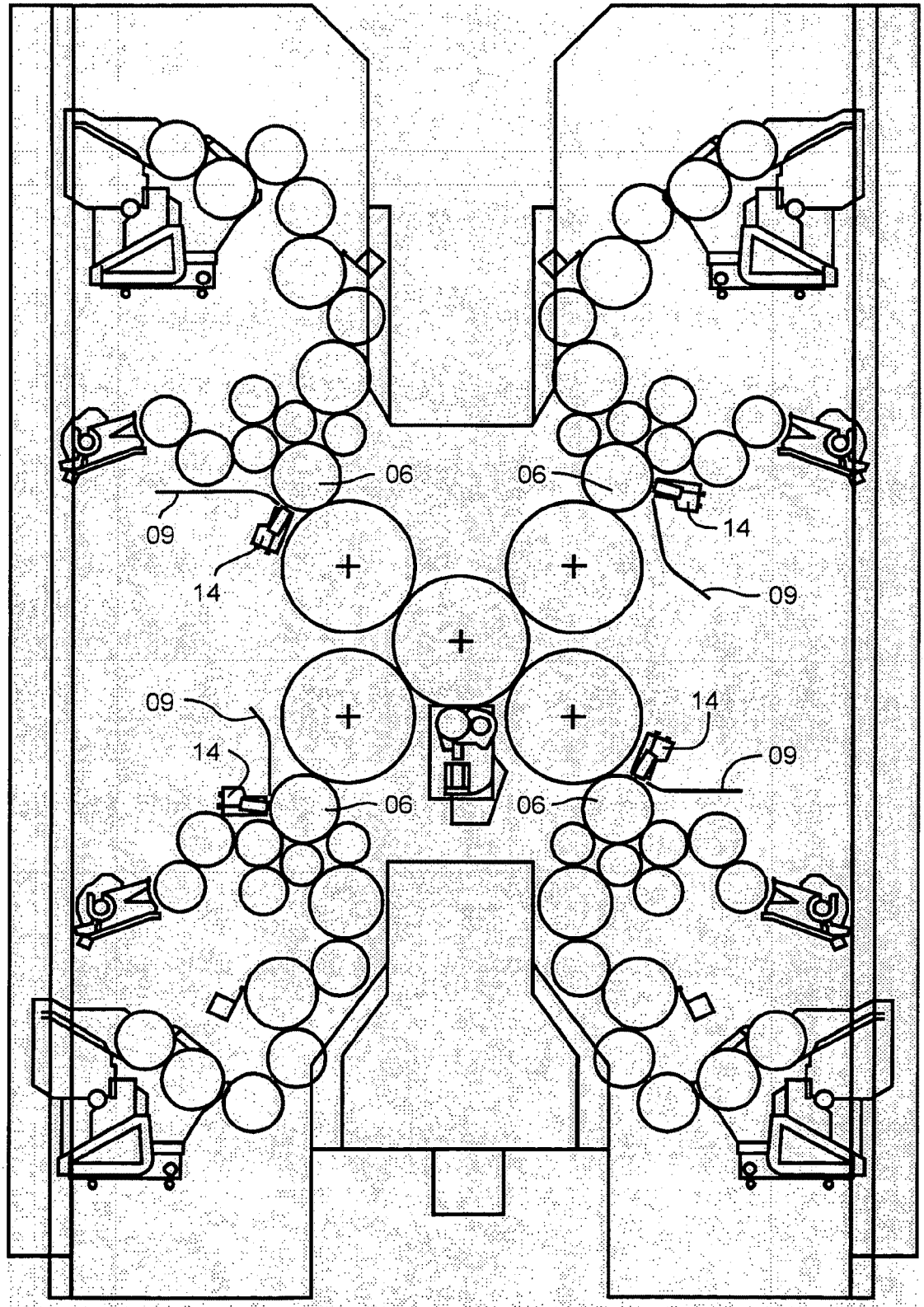
FIG. 46 a schematic depiction of arrangements of the plate holding device in a 9-satellite printing unit with single-circumference forme cylinders.

In FIG. 46, various arrangements of the holding device in a 9-satellite printing unit are again shown. The 9-satellite printing unit of FIG. 46 differs from the one that is shown FIG. 39 in that the 9-satellite printing unit of FIG. 46 has single-circumference forme cylinders 06, whereas the 9-satellite printing unit of FIG. 39 has double-circumference forme cylinders 06. The respective transfer cylinders are embodied, both in FIG. 39 and in FIG. 46, as double-circumference cylinders. The transfer cylinders can thus each transfer two print images, one in front of another, on its respective shell.

Single-circumference forme cylinders 06 have only a single printing forme 01 along their circumferential line, whereas double-circumference forme cylinders 06 can hold two printing formes 01, one in front of another, along their circumferential line. Double-circumference forme cylinders 06 also each have two grooves 07, which are offset by 180° from one another. A single-circumference forme cylinder 06 has only a single axially parallel groove 07, the opening 08 of which holds both the leading edge 02 and the trailing edge 12 of the same printing forme 01, to fasten it onto the forme cylinder 06. Due to the narrower diameter of a single-circumference forme cylinder, a rectilinear, tangential adjustment of a holding device on such a single-circumference forme cylinder 06 is more difficult to accomplish. The free space which is required for this adjustment is very limited in the area around the relevant single-circumference cylinder 06. Because of its larger diameter, a double-circumference forme cylinder 06 offers more opportunity for a rectilinear tangential adjustment of the guard plate 09 of a holding device at its circumferential line. On a single-circumference forme cylinder 06, the guard plate 09 of the holding device is preferably at least partially curved in structure in the direction in which the printing forme 01 is fed to the respective forme cylinder 06. This is assuming that the guard plate 09 of the particular holding device can be engaged tangentially in relation to the circumferential line of the relevant single-circumference cylinder 06. Therefore, the structure of the guard plate 09 of the respective holding device, whether the guard plate 09 is straight or curved, for example, and/or whether it is engaged radially or tangentially on the respective forme cylinder 06, should be based upon the concrete conditions of installation on the respective printing couple, which conditions are also dependent upon the diameter of the respective forme cylinder 06.

The forme cylinder in accordance with the present invention especially allows the following benefits to be achieved:

Because the printing forme 01 is held in a non-positive connection in a holding device that can be moved, and especially in such a holding device which can be pivoted, within a plane, it is possible to align the leading suspension edge 02 of the printing forme 01 true to register while simultaneously securing the printing forme 01.

Drawing the printing forme 01 backward causes it to be secured in its aligned position, after it has been suspended on the forme cylinder 06.

By using a spring-actuated holding device, the printing forme 01 is drawn onto the forme cylinder 06 in a defined, precisely positioned manner, and true to register.

The presence of a printing forme 01 can be automatically detected by the control device that controls the printing forme holding assembly 11. The mounting of the printing forme 01, and especially the process of drawing it onto the forme cylinder 06, can be performed mechanically and independently, and can be controlled by the control device. The control device for the printing forme holding assembly 11 and the control device 18 for the valves 36 and the control device for the pressure strip 26 are preferably embodied together in the control station belonging to the printing press.

The plate end holding devices, which are situated in the groove 07 of the forme cylinder 06, can be actuated separately for each printing forme 01. They can be controlled in a contactless manner using magnets, for example.

Only a single pressure element 14 is required for each printing forme 01 in the circumferential direction of the forme cylinder 06. Such a pressure element 14 can be embodied, for example, as a pressure roller 14 that can be engaged and disengaged. A pressure roller strip comprising a plurality of pressure elements 14, and arranged side by side for use with printing formes 01 which themselves are arranged side by side in the axial direction of the forme cylinder 06, can be much simpler in structure.

While preferred embodiments of a forme cylinder of a printing press comprising a plurality of sections in series on its circumferential surface in its axial direction, and printing couples comprising such forme cylinders, in accordance with the present invention, have been set forth fully and completely hereinabove, it will be apparent to one of skill in the art that various changes in, for example the drives for the cylinders, the specific printing formes used, the source of the compressed air and the like could be made without departing from the true spirit and scope of the present invention which is accordingly to be limited only by the appended claims.

What is claimed is:

1. A forme cylinder of a printing press comprising:

a forme cylinder body with a circumferential surface extending in an axial direction of said forme cylinder body;

a plurality of sections arranged in series on said circumferential surface in said axial direction, each said section being adapted to receive at least one printing forme;

at least one groove extending axially in said forme cylinder body and including an opening on said circumferential surface of said forme cylinder;

at least one holding device assigned to each respective one of said plurality of sections, and located in said at least one groove;

pneumatic actuating means for actuating each said respective at least one holding device by sections;

at least one recess in said forme cylinder body and being open at said circumferential surface and being outside of said plurality of sections;

a device in said at least one recess for distributing compressed air supplied to said forme cylinder to said respective ones of said plurality of sections;

an arrangement of a plurality of valves in said device and each being usable to activate at least one holding device in each said section; and at least one control device for said plurality of valves, said at least one control device being provided outside of said forme cylinder body, said plurality of valves each being actuable by said at least one control device in a contactless manner.

2. The forme cylinder of claim 1 wherein the number of said valves is at least as great as a number of said sections.

3. The forme cylinder of claim 1 wherein said control device, in its assignment to each of said valves, is oriented in a radial line of action toward said forme cylinder body circumferential surface.

4. The forme cylinder of claim 1 further including one of a magnetically and an induction actuable actuation device for each of said plurality of valves.

5. The forme cylinder of claim 4 wherein said actuation device is remotely actuable.

6. The forme cylinder of claim 1 further including an electromagnetic actuation device for each of said plurality of valves.

7. The forme cylinder of claim 6 wherein said actuation device is remotely actuable.

8. The forme cylinder of claim 1 wherein each of said plurality of valves is actuable using a magnet manually applied to said forme cylinder.

9. The forme cylinder of claim 1 wherein said magnet is part of a glove.

10. The forme cylinder of claim 1 wherein a radial distance between said at least one control device and the respective one of said plurality of valves is between 2 mm and 50 mm.

11. The forme cylinder of claim 1 wherein said actuating means for said valves are positioned spaced apart from each other in said axial direction of said forme cylinder body at a distance between 1 mm and 15 mm.

12. The forme cylinder of claim 1 wherein said plurality of valves selectively actuate said holding devices providing side by side in said groove by section.

13. The forme cylinder of claim 1 further including a Schmitz ring attached at each of two end surfaces of said forme cylinder.

14. The forme cylinder of claim 1 further including a Schmitz ring located at an end surface of said forme cylinder and defining said at least one recess in said cylinder body.

15. The forme cylinder of claim 1 further including a printing forme feed device engageable against said circumferential surface of said forme cylinder body and adapted to supply at least one printing forme to said forme cylinder body.

16. The forme cylinder of claim 1 wherein each said section has an axial width corresponding to a width of a printing forme to be supplied to each said section.

17. The forme cylinder of claim 1 wherein there are selectively one of two, four, six and eight sections axially on said forme cylinder circumferential surface.

18. The forme cylinder of claim 1 wherein each of said plurality of sections is of equal axial width.

19. The forme cylinder of claim 1 further including at least one axially extending channel in said forme cylinder body, said at least one groove extending into said at least one channel.

20. The forme cylinder of claim 1 wherein said at least one groove is an angular groove.

21. The forme cylinder of claim 1 further including first and second circumferentially offset grooves in said forme cylinder body.

22. The forme cylinder of claim 21 wherein said first and second grooves are diametrically opposite.

23. The forme cylinder of claim 1 wherein said at least one groove has a slit at said circumferential surface, said slit having a slit width, in a circumferential direction of said forme cylinder body, of no greater than 5 mm.

24. The forme cylinder of claim 1 wherein said pneumatic actuating means is a single compressed air intake.

25. The forme cylinder of claim 1 further including a compressed air intake device for supplying compressed air to said forme cylinder, said compressed air intake device including at least one remotely actuable operating position with respect to compressed air to be transmitted to said forme cylinder.

26. The forme cylinder of claim 25 wherein said compressed air intake device distributes compressed air to be distributed to said forme cylinder at said holding means assigned to said sections to said plurality of valves through a single compressed air line.

27. The forme cylinder of claim 25 wherein said compressed air intake device distributes compressed air to be distributed to said forme cylinder at said holding means assigned to said sections to said plurality of valves coaxially.

28. The forme cylinder of claim 25 further including a single compressed air intake device on said forme cylinder.

29. The forme cylinder of claim 25 wherein said plurality of valves are located in said recess in said forme cylinder, and wherein a single compressed air line in said forme cylinder body conducts compressed air from said compressed air intake device to said valves.

30. The forme cylinder of claim 25 wherein said compressed air intake device is a rotary intake.

31. The forme cylinder of claim 1 wherein said plurality of said valves which are located in said at least one recess and are combined to form a valve block.

32. The forme cylinder of claim 31 further including a junction box shared by all of said valves in said valve block and being located on said valve block, a plurality of pneumatic lines being attached to said junction box.

33. The forme cylinder of claim 32 wherein said pneumatic lines connected to said junction box are positioned in said groove.

34. The forme cylinder of claim 32 wherein said groove has a groove wall, and further wherein said junction box is secured to said groove wall.

35. The forme cylinder of claim 32 further including a quick connect coupling between said junction box and said valve block.

36. The forme cylinder of claim 32 wherein each of said plurality of pneumatic lines connected to said junction box of said valve block conducts compressed air to a specific one of said plurality of sections arranged side by side.

37. The forme cylinder of claim 32 wherein each of said plurality of pneumatic lines connected to said junction box of said valve block conducts compressed air to a center area of a specific one of said plurality of sections arranged side by side.

38. The forme cylinder of claim 1 wherein each said holding device for each said section is engageable with a bent leading end suspension leg of a printing forme held on said circumferential surface of said forme cylinder.

39. The forme cylinder of claim 38 wherein each said holding device has an end suspension leg holding position and an end suspension leg release position, each of said valves being usable to change an associated one of said holding devices between said holding position and said release position in response to an actuation of one of said valves.

40. The forme cylinder of claim 1 further including a computer associated with said printing press, said at least one control device being actuable by said computer.

41. The forme cylinder of claim 40 further including a control station for said printing press, said computer being in said control station.

42. The forme cylinder of claim 1 wherein said at least one control device includes a plurality of electrically controllable magnets arranged side by side and assigned to said valves.

43. The forme cylinder of claim 42 wherein said at least one control device actuates said valves in accordance with a specific angular position of said forme cylinder.

44. The forme cylinder of claim 1 further including a printing press frame and wherein said at least one control device is fixed to said frame.

45. The forme cylinder of claim 1 further including at least one pressure strip which extends axially parallel to said forme cylinder, the at least one pressure strip being allocated to said forme cylinder.

46. The forme cylinder of claim 45 wherein said at least one pressure strip is spaced from said forme cylinder circumference and is held, at both ends, in a frame of said printing press.

47. The forme cylinder of claim 45 wherein said pressure strip includes a plurality of roller elements spaced in an axial direction of said forme cylinder, the plurality of roller elements being each assigned to one of said plurality of sections.

48. The printing couple of claim 47 wherein said plurality of roller elements are engageable against said forme cylinder circumferential surface together.

49. The forme cylinder of claim 47 further including a roller element control device usable to control engagement of said roller elements against said forme cylinder circumferential surface.

50. The forme cylinder of claim 49 wherein each of said plurality of roller elements is engageable independently against its associated one of said plurality of sections.

51. The forme cylinder of claim 49 further including a shared control device for both said valves located in said forme cylinder and said roller elements of said pressure strip.

52. The forme cylinder of claim 1 further including a printing forme holding assembly positioned separately from said forme cylinder and usable to hold a printing forme to be supplied to one of said forme cylinder circumferential sections by a non-positive connection.

53. The forme cylinder of claim 52 further including one of sensor and a switch actuable by direct contact between said printing forme holding assembly and said printing forme, actuation of said sensor operating a printing forme holding assembly control device.

54. The forme cylinder of claim 52 further including a printing forme holding assembly control device adapted to control a holding force exerted on said printing forme by said printing forme holding assembly.

55. The forme cylinder of claim 54 further including a pressure strip including roller elements engageable with said printing formes on said forme cylinder circumference and further including a shared control device for said plurality of valves, said roller elements of said pressure strip and said non-positive connection between said printing forme holding assembly and associated ones of said printing formes.

56. The forme cylinder of claim 1 wherein said forme cylinder is a double-circumference forme cylinder with two of said grooves offset circumferentially by 180°.

57. The forme cylinder of claim 1 wherein said forme cylinder is a single-circumference forme cylinder with only one said groove.

58. A printing couple comprising the forme cylinder of claim 1, further including a transfer cylinder cooperating with said forme cylinder, said transfer cylinder being a double-circumference cylinder.

59. The forme cylinder of claim 1 wherein said printing press is one of an H-shaped printing unit and a nine-cylinder satellite printing unit.

60. The forme cylinder of claim 1 wherein said at least one control device is oriented in a radial line of action toward said forme cylinder circumferential surface.

* * * * *